US007632381B2

(12) United States Patent
Lah

(10) Patent No.: US 7,632,381 B2
(45) Date of Patent: Dec. 15, 2009

(54) SYSTEMS FOR PROVIDING CONTINUOUS CONTAINMENT OF DELAYED COKER UNIT OPERATIONS

(75) Inventor: Ruben F. Lah, West Jordan, UT (US)

(73) Assignee: Curtiss-Wright Flow Control Corporation, Falls Church, VA (US)

( * ) Notice: Subject to any disclaimer, the term of this patent is extended or adjusted under 35 U.S.C. 154(b) by 471 days.

(21) Appl. No.: 11/111,480

(22) Filed: Apr. 20, 2005

(65) Prior Publication Data

US 2006/0076225 A1 Apr. 13, 2006

Related U.S. Application Data

(60) Provisional application No. 60/607,373, filed on Sep. 3, 2004, provisional application No. 60/564,449, filed on Apr. 22, 2004, provisional application No. 60/275,527, filed on Mar. 12, 2001.

(51) Int. Cl.
*C10B 33/00* (2006.01)
*C10B 1/00* (2006.01)

(52) U.S. Cl. ..... 201/3; 202/242; 202/245; 202/246; 175/75; 175/220

(58) Field of Classification Search ..... 202/242, 202/245, 246; 175/220, 75; 422/105, 211, 422/239; 48/61; 700/266, 274; 429/12, 429/17

See application file for complete search history.

(56) References Cited

U.S. PATENT DOCUMENTS

| | | | | |
|---|---|---|---|---|
| 2,245,554 | A | 6/1941 | Court | 134/24 |
| 2,317,566 | A | 4/1943 | Utterback | 202/96 |
| 2,717,865 | A | 9/1955 | Kimberlin et al. | 208/106 |
| 2,761,160 | A | 9/1956 | Manning | 15/104.07 |
| 3,379,623 | A | 4/1968 | Forsyth | 202/252 |
| 3,617,480 | A | 11/1971 | Keel | 208/50 |
| 3,716,310 | A | 2/1973 | Guenther | 417/552 |
| 3,837,356 | A | 9/1974 | Selep et al. | 137/375 |
| 3,852,047 | A | 12/1974 | Schlinger et al. | 44/24 |
| 4,253,487 | A | 3/1981 | Worley et al. | 137/375 |
| 4,275,842 | A | 6/1981 | Purton et al. | 239/446 |
| 4,531,539 | A | 7/1985 | Jandrasi et al. | 137/375 |
| 4,626,320 | A | 12/1986 | Alworth et al. | 201/2 |
| 4,666,585 | A | 5/1987 | Figgins et al. | 208/131 |
| 4,726,109 | A | 2/1988 | Malsbury et al. | 29/402.08 |
| 4,738,399 | A | 4/1988 | Adams | 239/447 |
| 4,797,197 | A | 1/1989 | Mallari | 208/131 |
| 4,929,339 | A | 5/1990 | Elliott, Jr. et al. | 208/131 |
| 4,960,358 | A | 10/1990 | DiGiacomo et al. | 414/684 |
| 5,024,730 | A | 6/1991 | Colvert | 202/270 |
| 5,035,221 | A | 7/1991 | Martin | 123/451 |
| 5,041,207 | A | 8/1991 | Harrington et al. | 208/131 |
| 5,048,876 | A | 9/1991 | Wallskog | 285/364 |

(Continued)

*Primary Examiner*—N. Bhat
(74) *Attorney, Agent, or Firm*—Kirton & McConkie; Michael F. Krieger

(57) ABSTRACT

The present invention relates to a safety system during the entire delayed coker operation. The present invention preferably comprises a coke drum; a first coke drum de-header system coupled to the bottom of the coke drum; a second coke drum de-header system coupled to the top of the coke drum; a containment system coupled to the second coke drum de-header system; and a remote switching system. Hence, the present invention provides system for cutting coke within a coke drum with increased safety, efficiency and convenience.

29 Claims, 41 Drawing Sheets

U.S. PATENT DOCUMENTS

| | | | | |
|---|---|---|---|---|
| 5,228,825 | A | 7/1993 | Fruchtbaum et al. | 414/684 |
| H1442 | H | 6/1995 | Edgerton et al. | 196/125 |
| 5,464,035 | A | 11/1995 | Heinecke | 137/312 |
| 5,785,843 | A | 7/1998 | Antalffy et al. | 208/131 |
| 5,816,787 | A | 10/1998 | Brinkerhoff et al. | 417/521 |
| 5,876,568 | A | 3/1999 | Kindersley | 202/242 |
| 5,947,674 | A | 9/1999 | Malsbury et al. | 414/216 |
| 6,039,844 | A | 3/2000 | Malik | 202/227 |
| 6,066,237 | A | 5/2000 | Kindersley | 202/242 |
| 6,113,745 | A | 9/2000 | Maitland et al. | 202/262 |
| 6,117,308 | A | 9/2000 | Ganji | 208/131 |
| 6,223,925 | B1 | 5/2001 | Malsbury et al. | 220/328 |
| 6,228,225 | B1 | 5/2001 | Meher-Homji | 202/250 |
| 6,240,946 | B1 * | 6/2001 | Beasley | 137/15.06 |
| 6,254,733 | B1 * | 7/2001 | Lu et al. | 202/245 |
| 6,264,797 | B1 | 7/2001 | Schroeder et al. | 201/39 |
| 6,264,829 | B1 | 7/2001 | Antalffy et al. | 208/131 |
| 6,367,843 | B1 * | 4/2002 | Fetzer | 285/24 |
| 6,565,714 | B2 | 5/2003 | Lah | 202/245 |
| 6,644,567 | B1 * | 11/2003 | Adams et al. | 239/566 |
| 6,935,371 | B2 | 8/2005 | Stares | 137/625.37 |
| 7,037,408 | B2 * | 5/2006 | Wilborn et al. | 201/2 |
| 7,112,261 | B1 * | 9/2006 | TerWisscha et al. | 201/2 |
| 7,117,959 | B2 * | 10/2006 | Lah | 175/67 |
| 2002/0157897 | A1 | 10/2002 | Hofmann et al. | 181/214 |
| 2002/0166862 | A1 | 11/2002 | Malbury et al. | 220/214 |
| 2002/0170814 | A1 | 11/2002 | Lah | 202/214 |
| 2003/0047153 | A1 | 3/2003 | Kubel et al. | 123/214 |
| 2003/0089589 | A1 | 5/2003 | Malsbury | 202/262 |
| 2003/0127314 | A1 | 7/2003 | Bell et al. | 202/262 |
| 2003/0185718 | A1 | 10/2003 | Sellakumar | 422/17 |
| 2004/0118746 | A1 * | 6/2004 | Wilborn et al. | 208/131 |
| 2006/0086539 | A1 * | 4/2006 | Koerner et al. | 175/220 |

* cited by examiner

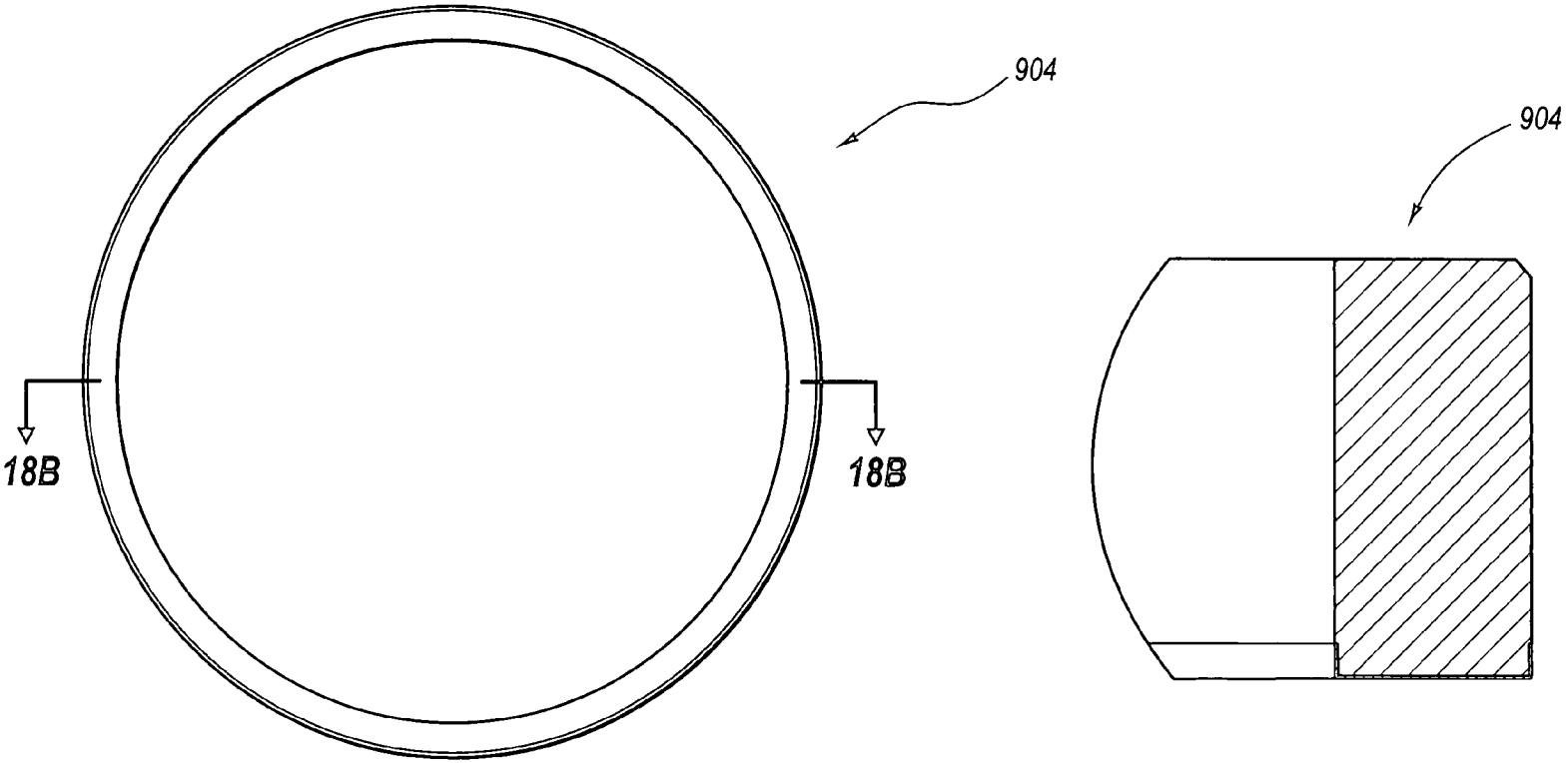
Fig. 18A
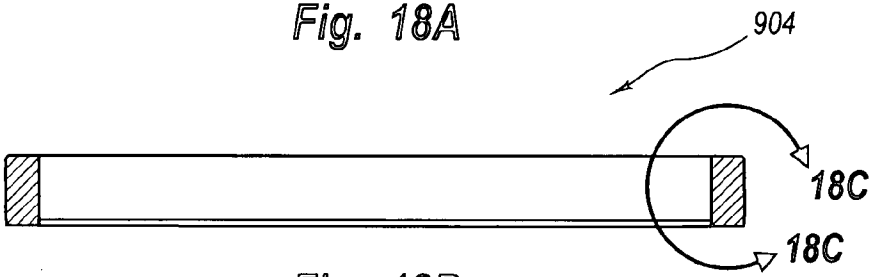
Fig. 18B
Fig. 18C

SYSTEMS FOR PROVIDING CONTINUOUS CONTAINMENT OF DELAYED COKER UNIT OPERATIONS

RELATED APPLICATIONS

This application claims priority to U.S. Provisional Patent Application Ser. No. 60/607,373, filed Sep. 3, 2004, entitled, "Systems and Methods for Providing Continuous Containment of Drill Stem During Decoking;" and to and to U.S. patent application Ser. No. 10/997,234, filed Nov. 24, 2004, entitled, "Systems and Methods for Remotely Determining and Changing Cutting Modes During Decoking," which claims priority to U.S. Provisional Patent Application Ser. No. 60/564,449 filed Apr. 22, 2004; and to U.S. patent application Ser. No. 10/997,834, filed Nov. 24, 2004, entitled "Valve System and Method for Unheading a Coke Drum," which claims priority to U.S. patent application Ser. No. 10/731,874, filed Dec. 9, 2003, entitled, "Valve System and Method for Unheading Coke Drum," and to U.S. patent application Ser. No. 10/096,301, filed Mar. 11, 2002, entitled, "Coke Drum Bottom De-Heading System," now issued as U.S. Pat. No. 6,660,131; and to U.S. patent application Ser. No. 09/946,917, filed Sep. 5, 2001, entitled, "Coke Drum Bottom De-Heading System," now issued U.S. Pat. No. 6,565,714, which claims priority to U.S. Provisional Patent Application Ser. No. 60/275,527, filed Mar. 12, 2001, entitled, "Coke Drum Bottom De-Heading System." Each of these related applications is incorporated by reference herein in their entirety.

BACKGROUND OF THE INVENTION

1. Field of the Invention

The present invention relates to a system for removing solid carbonaceous residue (hereinafter referred to as "coke") from large cylindrical vessels called coke drums. This removal process is often referred to as "decoking. In particular the present invention relates to a safety system for providing uncompromised and continuous containment for protecting operators during the entire delayed coker operation.

2. Background and Related Art

Petroleum refining operations in which crude oil is processed to produce gasoline, diesel fuel, lubricants and so forth, frequently produce residual oils that have very little value. The value of residual oils can be substantially increased when processed in a "delayed coker unit." Residual oil, when processed in a delayed coker is heated in a furnace to a temperature sufficient to cause destructive distillation in which a substantial portion of the residual oil is converted, or "cracked" to usable hydrocarbon products and the remainder yields petroleum coke, a material composed mostly of carbon. A large vessel hereafter called a "coke drum" is provided at the furnace outlet to allow sufficient residence time for the hydrocarbons to complete destructive distillation reaction. The typical coke drum is a large, upright, cylindrical, metal vessel that may, for example, be in the order of approximately 90-100 feet in height (27.4-30.4 meters) and 20-30 feet in diameter (6.1-9.1 meters), although the actual structural size and shape of the coke drum can vary considerably from one installation to another.

Typically, a delayed coking unit has an even number of coke drums. The production of coke is a batch process. Coker feedstock is deposited as a hot liquid slurry in a coke drum. Lighter hydrocarbons which are products of destructive distillation flow out the top of the coke drum. Heavier material remains in the coke drum. When a coke drum is filled, residual oil from the furnace is diverted to another coke drum. The liquid mass remaining in the coke drum cools and is quenched as a part of the process. Solid coke formed as the drum cools must be removed from the drum so that the drum can be reused. While coke is being cooled in one or more drums and while the cooled coke is being extracted from one or more drums, other drums are employed to receive the continuous production of coke feedstock as a part of the delayed coker process.

Residual oil is heated to a temperature of typically about 900° F. (477.4.degree. C.). The oil flows directly from the furnace to a coke drum. The liquid mass enters the drum, typically flowing through an opening in the bottom of the drum and, as the liquid level rises, the thermal cracking continues and layers of coke are laid down and solidify as the coke drum is cooled. Eventually the coke drum is filled substantially full with a solid mass.

When a coke drum is filled to the desired capacity, and after feedstock is diverted to another drum, steam is typically introduced into the drum to strip hydrocarbon vapors off of the solid material. The drum remains substantially full of coke that, as it cools, hardens into solid material.

It is a standard procedure to cool coke in a drum by the admission of steam then followed by water, that is, to cool the coke after the hydrocarbon vapors have been stripped off.

After a coke drum has been filled, stripped and then quenched so that the coke is in a solid state and the temperature is reduced to a reasonable level, quench water is drained from the drum through piping to allow for safe unheading of the drum. The bottom opening is uncovered, that is unheaded, to permit removing coke. Shot coke may have plugged off the drain line preventing a complete draining of the drum. Shot coke may also be loosely packed inside the drum and may "cave in" in an avalanche-like fashion and spilling onto the switch deck area below the coke drum causing substantial operating delay and creating potential hazards to personnel. Operating personnel are required to exercise reasonable caution to avoid coke hot water and hot vapors that may be released when a cave-in occurs. Procedures required to minimize the potentially harmful effects of a cave-in usually take a substantial amount of time and are not always completely effective. Once the unheading is complete, the coke in the drum is cut out of the drum by high pressure water jets. If the drum contains shot coke further avalanches my occur.

In some installations, a coke chute is located in a channel below the switch deck floor with a coke pit below it. Once the coke drum head is removed, the chute is raised to mate with the coke drum bottom flange. This process may not be completely satisfactory in that there is exposure to an avalanche of shot coke when raising the chute and the chute may be overwhelmed or may not function in the event of a cave in.

Often a pair of coke drums cycle between coking and decoking. One coke drum is coking, while the other is decoking (quenching, followed by remotely opening the joints then decoking the drum). In the decoking phase coke is removed from the coke drums by high pressure hydrostatic drilling. A drill bit is lowered into the coke drum through a drum-top deheading system and coke, cut by the drilling action, falls through a decoke chute attached to an opening in the bottom of the coke drum created when a drum-bottom deheading system removes a closure away from said opening.

Safely preparing a coke drum for decoking involves the following steps: (1) removing the working surface opening cover creating an opening in the working surface for the coke to pass; (2) remotely aligning and engaging a closure transport to the drum-bottom closure; (3) remotely energizing the drum-bottom closure to the coke drum; (4) remotely unlocking, disconnecting and separating the coke drum from the inlet pipe; (5) remotely unlocking the drum-bottom closure from the coke drum; (6) remotely disengaging the drum-bottom closure from the coke drum in a controlled manner; (7) remotely removing the drum-bottom closure from the opening in the bottom of the coke drum; (8) remotely producing and securing a passageway between the bottom opening of the coke drum to the opening in the working surface, i.e. a decoke chute; (9) remotely unlocking and moving the drum-top closure from the opening in the top of the coke drum; (10) lowering the drill bit into the coke drum through the opening in the top of the coke drum; and (11) engaging and locking the drilling head to the drum-top deheading system.

Safely preparing a decoked coke drum for coking involves the following steps: (1) remotely replacing, aligning and locking the drum-top closure to the coke drum once the drill bit is removed from the coke drum; (2) remotely decommissioning the decoke chute and replacing the working surface opening cover; (3) remotely aligning and locking the open ends of the inlet piping together, which reconnects the coke drum to the inlet pipe; (4) remotely replacing, aligning and locking the drum-bottom closure to the opening at the bottom of the coke drum.

Currently most cokers employ workers to manually perform some or all of the foregoing steps. Any of these steps can be hazardous to workers, but by far the most dangerous steps are in the transition from the coking phase to the decoking phase. Here a closed and quenched coke drum must be opened to allow the evacuation of coke from the coke drum.

Workers are most frequently harmed while performing the following steps: (1) manually unlocking, disconnecting and separating the coke drum from the inlet pipe; (2) manually unlocking the drum-bottom closure from the coke drum; or (3) manually disengaging the drum-bottom closure from the coke drum. Further workers are often harmed when pressurized gasses are released from the top of the deheading unit.

Coke is supposed to support itself in the coke drum when an opening is created at the drum-bottom; however, this cannot be assured. The flow of loose coke and quench water or other materials from other types of vessels can be very hazardous for workers performing functions during the opening of the vessels. This hazard exists until a secure passageway is present between the opening of the vessel and where the material is ultimately destined. In the case of a coking unit, the material is due to fall in a hole in a working surface located beneath the unit and towards an ultimate destination below the working surface. An even more hazardous environment is a coker design to produce "shot coke" where the coke will not support itself in the coke drum.

For all the above reasons, decoking a coke drum has been a relatively cautious and slow process especially when shot coke is produced and may expose workmen to a disagreeable and potentially dangerous environment. It is this situation to which the present invention is directed. This invention provides improved safety when working around coke drums that substantially reduces the exposure of workmen to the hazardous conditions that may be associated with unheading, the initial steps of unloading a coke drum, and the process of decoking the drum. It also benefits operations because it reduces the time required to safely return the coke drum back to service after removing the coke from the coke drum.

SUMMARY OF THE INVENTION

The present invention relates to a safety system for providing uncompromised and continuous containment of the entire delayed coker operation. A preferred embodiment of the present invention comprises a continuous containment system, a top valve/gate system, a bottom deheader system and a switching system, which allows operators to remotely switch the coke cutting apparatus between boring and cutting modes.

Some embodiments of the present invention feature a system comprising: (a) a coke drum having at least one port therein, said coke drum receiving byproduct material from a manufacturing system and process; (b) at least one de-header valve removably coupled to the coke drum for regulating the port of the coke drum and for allowing repeated de-heading and re-heading of the coke drum, said de-header valve comprising (1) a main body having an orifice dimensioned to align with the port of the coke drum when the de-header valve is coupled thereto; (2) a valve closure operably supported by the main body, wherein the valve closure is capable of being actuated to oscillate between an open and closed position with respect to the orifice of the de-header valve and the port of the coke drum; (3) means for supporting the valve closure; (4) a continuously maintained metal to metal contact seal between the valve closure and the means for supporting the valve closure that contributes to valve isolation, wherein the contact seal functions to shear any coke or other byproduct material that has accumulated near the port of the coke drum, thus effectively de-heading the coke drum upon actuation of the valve closure; (5) means for actuating the valve closure; (c) a drill stem containment system which provides continuous containment for the drill and drill stem while the drill is decoking, while the drill stem is being raised and/or while the drill stem is in a fully raised position; and (d) a remotely switchable cutting system that allows an operator to remotely activate the cutting of coke within a coke drum, and to remotely switch between the "boring" and the "cutting" modes, while cutting coke within a coke drum reliably, and without raising the drill bit out of the coke drum for mechanical alteration or inspection.

Some embodiments of the present invention comprise devices and/or systems used to de-head or unhead a vessel containing a fluid, distillate, or unconsolidated debris byproduct produced from a manufacturing process, such as the several types of coke produced from a petroleum refinery process, as well as to the several methods employed for unheading a vessel utilizing such devices or systems. Preferred embodiments of the present invention comprise at least one unheading valves, and associated methods. In alternative embodiments of the present invention various de-header valves may be coupled to a coke drum, particularly at its top and/or bottom openings, wherein the valve functions to safely, effectively, and efficiently de-head or unhead the coke drum following the manufacture of coke, or other byproducts, and to facilitate the removal of coke during the decoking process.

Some embodiments of the present invention feature a coke drum de-header system comprising: (a) a coke drum having at least one port therein, said coke drum receiving by product material from a manufacturing system and process; (b) a de-header valve removably coupled to the coke drum for regulating the port of the coke drum and for allowing repeated de-heading and re-heading of the coke drum, said de-header valve comprising (1) a main body having an orifice dimensioned to align with the port of the coke drum when the de-header valve is coupled thereto; (2) a valve closure operably supported by the main body, wherein the valve closure is capable of being actuated to oscillate between an open and closed position with respect to the orifice of the de-header valve and the port of the coke drum; (3) means for supporting the valve closure; (c) a continuously maintained metal to metal contact seal between the valve closure and the means for supporting the valve closure that contributes to valve isolation, wherein the contact seal functions to shear any coke or other byproduct material that has accumulated near the port of the coke drum, thus effectively de-heading the coke drum upon actuation of the valve closure; and (d) means for actuating the valve closure.

In some embodiments of the invention the de-header valve is removably coupled to and seals against the flanged portion of a coke drum and over its port much the same way a conventional flange or head unit would be attached. In some embodiments the de-header valve is equipped with a valve closure that regulates the closing and opening of the coke drum, or rather regulates the opening and closing of the coke drum port and its associated throughput. Thus, in a closed position, the de-header valve and coke drum are prepared to receive the byproduct feed from the refinery process used to manufacture coke. As the coke drum is being filled during one stage of a decoking process, the de-header valve, and particularly the valve closure, is actuated and positioned in a closed position, wherein a seal is formed between the valve closure and the means for supporting the valve closure. Once the coke drum is filled, the valve closure is again actuated causing it to transition from a closed position to an open or semi-opened position. This opening action functions to shear any coke or other debris that accumulated on the valve closure or at or near the port of the coke drum, thus effectively de-heading the coke drum.

In some embodiments shearing occurs because of the continuously maintained metal to metal contact between the valve closure and the means for supporting the valve closure. As the valve closure is caused to move, its metal surface slides about the metal surface of the means for supporting the valve closure, thus shearing the coke from and otherwise breaking its connection or attachment with the valve closure. Once the valve is opened and the coke drum de-headed, the coke may be removed from the coke drum using commonly known methods, techniques, and equipment.

The de-header valve and/or de-header valves of the present invention may comprise one of several forms or types of valves. For example, but not limiting in any way, the de-header valve comprises a valve-type selected from the group comprising a plug valve, a ball or globe valve, a flexible wedge gate valve, a parallel slide gate valve, a solid wedge gate valve, a blind goggle valve and a sliding blind gate valve. Each of these valve-types, although functioning somewhat differently, are designed to comprise a continuously maintained metal to metal contact seal to create valve isolation and to provide the means for shearing the coke from the valve closure, thus de-heading the coke drum. As such, the coke drum de-heading system provides unique advantages over prior art or prior related de-heading systems, namely the de-heading of a coke drum without having to physically remove bulky, dangerous flange or head units.

An advantage of the present invention is its ability to provide a simple, yet effective de-heading system comprising a de-header valve having a movable valve closure that oscillates or moves back and forth about the means for supporting the valve closure to de-head a coke drum and simplify the decoking process. Another advantage of the present invention is the ability to de-head the coke drum without having to physically remove the head or flange unit, and to do so at a remote location with little or no manual requirements. Other advantages will be apparent to one skilled in the art.

In a preferred embodiment, the means for supporting the valve closure comprises a seat support system. The seat support system may comprise any arrangement or configuration of seats, depending upon the type of valve, the needs of the system, system specifications, or any other contributing factors. In one exemplary configuration, the seat support system comprises an upper and lower seat existing on either side of the valve closure, wherein the upper seat and lower seat may be independent from one another. Still further, the upper and lower seat may be comprised of either a static or dynamic nature, such that one may be static and the other dynamic, both dynamic, or both static.

In another exemplary embodiment, the seat support system comprises a single seat situated or disposed between the main body of the de-header valve and the valve closure. In this configuration, the single seat applies a continuous force to the valve closure throughout its oscillation. The single seat may be a floating or dynamic seat, or it may be a static seat, again depending upon the type of valve, the needs of the system, system specifications, or any other contributing factors.

In several embodiments, the biasing necessary to maintain bug term sealing is provided by the gate itself. Several gates are biased against the seat to provide the same contact that would occur if the seat were biased toward the gate.

In a preferred embodiment, the seat support system advantageously provides a floating seat concept to the de-header valve using at least one dynamic, live loaded seat. This floating dynamic, live loaded seat is continuously loaded against the valve closure to create a biased relationship between the seat(s) and the valve closure. The floating seat concept is accomplished using one or a combination of biasing members, such as heavy coil springs arrayed at close centers around the perimeter of the seat ring; externally live loaded and sealed seat force applicators arrayed at quadrants around the floating seats; and/or a full perimeter flexible inconnel bellow seal spring placed between the floating seat and the seat retaining ring. One embodiment of the present invention utilizes a floating two piece gate to provide a floating seal with a static seat. The tow plates that form the gate are biased away from each other to seal against the seat. A floating or dynamic seat or gate provides many advantages, a primary one being that the seat support system and the valve closure are able to flex and distort in response to the rigorous and changing pressures and forces induced thereon during the coke manufacturing process and filling of the coke drum.

In another exemplary embodiment, means for supporting the valve closure comprises the main body itself. In this embodiment, no seats are required as various structural modifications can be made to the main body to support the valve closure. However, it is contemplated that a seat may be used to support the valve closure on one side and the main body on the other.

The continuously maintained contact seal comprises a sealing system that seals directly against the valve closure. This may be a point to point sealing system. The seal preferably consists of or is a result of the metal to metal seating between the valve closure and the means for supporting the valve closure, such as upper and lower seats. Moreover, an identifiable and calculated force is created or induced between these two components and maintained in a continuous manner as the valve closure oscillates between its open and closed positions. In one exemplary embodiment, the amount of force required to properly seal the valve closure and the means for supporting the valve closure is provided via a seat support system, wherein one or more of the seats may be a floating or dynamic seat coupled to a seat adjustment mechanism designed to control the amount of force exerted on the valve closure through or by the seat.

Some embodiments of the coke drum de-header system further comprises a steam purge system. The system utilizes pressure valves and steam purge inlet valves, as well as emergency vent valves to monitor and control pressure within the system and to prevent inadvertent venting of the steam to atmosphere.

Some embodiments of the coke drum de-header system further comprises an internal coke containment system that provides or maintains total isolation of the coke within the system. The internal coke containment system comprises the metal to metal contact seal described herein, as well as a unique component configuration existing within the bonnets of the de-header valve.

In another exemplary embodiment of the present invention the header valve of the present invention is a hydraulically driven blind goggle valve.

Some embodiments of the present invention comprise systems that allow containment of the drill and drill stem.

One embodiment of the present invention allows an operator to safely participate in the decoking process by providing a containment system, which is not compromised during the entire delayed coker operation. Preferred embodiments of the containment system provides continuous containment for the drill and drill stem while the drill is decoking, while the drill stem is being raised or while the drill stem is in a fully raised position. Thus, in one embodiment of the present invention the entire delayed coker operation is continuously contained by a containment system.

In a preferred embodiment of the present invention the continuous containment system can be remotely vented. There are several embodiments of remote venting that are contemplated by the present invention. The remote venting could be accomplished by attaching a venting system to the containment system so that surges of excess pressure during the decoking process could be dispelled to areas not inhabited by operators. For example, a cylindrical chimney like apparatus could be appended to the continuous containment system which would allow pressurized gases to be released to an elevation substantially above that of the operating deck. Alternatively, a chimney like apparatus could be attached to the continuous containment chamber with tubing that would allow excess or pressurized gases to be released below the coke barrel during the decoking process.

In another embodiment of the present invention the continuous containment system would provide a drill stem guide. The drill stem guide could be manufactured to have large or small tolerances for the drill stem. That is, the drill stem may fit tightly or given some space to move laterally within the drill stem guide. Another embodiment of the drill stem guide is a pancake of three plates functionally related to one another such the three plates operate to control lateral and vertical movements of the drill stem to desired tolerances while simultaneously preventing blowback of steam or solid matter from the top of the coke drum. In a preferred embodiment of the drill stem guide low tolerances are used such that the space between the drill stem, and the drill stem guide are insufficient to allow for release of gases, particularly surges of pressurized gases that would result in unsafe conditions on the operators deck. Thus, with low tolerance the excess gases released during the decoking process would be forced to vent through a remotely vented system, or be contained within the continuous containment system. In another preferred embodiment of the drill stem guide the guide would consist of a plate which covers the top of the enclosed continuous containment system. Wherein the guide would be able to move up and down inside the continuous containment system to allow the drill system to be raised for maintenance, and to be lowered into the coke barrels without comprising the continuous containment system.

In a further embodiment of the present invention the continuous containment system would possess a means for allowing access to the enclosed drill and drill stem for maintenance purposes or other forms of visual or tactile inspection. In a preferred embodiment of the maintenance access port the maintenance door could then be on hinges which would allow the door to open and close. In the closed position the door could be secured with various locking devices.

Some embodiments of the present invention comprise a system that allows an operator to remotely activate the cutting of coke within a coke drum and at the same time, apprises the operator of the status of the cutting modes taking place within the coke drum during the coke-cutting process.

Some embodiments of the safety system allow an operator to remotely activate the cutting of coke within a coke drum, and to remotely switch between the "boring" and the "cutting" modes, while cutting coke within a coke drum reliably, and without raising the drill bit out of the coke drum for mechanical alteration or inspection. Further, the present invention allows an operator to determine the status of the cutting modes taking place within the coke drum during the coke-cutting process. Hence, the present invention provides a system for cutting coke within a coke drum with increased safety, efficiency and convenience.

One embodiment of the switching system features the use of a three-wall ball valve, a union and a specialized drill bit. In this preferred embodiment, the system is comprised of a cutting liquid tank filled with water or other liquid. A pipe is attached to this tank and water flows from it into a high-pressure pump. In the high-pressure pump, the water is pressurized. After leaving the high-pressure pump, the pressurized water then flows into another pipe which divides into two pipes. One of the two pipes created from this division is a boring water delivery pipe and the other is a cutting water delivery pipe. In one embodiment of the present invention the delivery pipe is separated into two pipes by a three-way ball valve. The three-way ball valve prevents the pressurized water from flowing into both pipes simultaneously. Further, an operator may visualize with certainty which pipe the pressurized water is in, and consequently, the status of coke-cutting mode within the coke drum.

In some embodiments of the switching system the two pipes extend parallel to each other for a distance. After such a distance, the two delivery pipes integrate to form an integrated boring and cutting water delivery pipe. This integrated boring and cutting water delivery pipe appears as a "pipe within a pipe." Specifically, the boring water delivery pipe becomes an inner pipe, while the cutting water delivery pipe concentrically encompasses the boring water delivery pipe on the outside becoming an outer pipe. The two pipes do not fluidly communicate with each other. The two pipes enable pressurized fluid to flow through either of the two pipes to the same overall device, the cutting head. Because the switch valve allows water to flow only through either the inner, boring water delivery pipe, or the outer delivery pipe, cutting water deliver pipe, water is delivered only to boring or cutting outlet nozzles of the cutting head respectively. In another embodiment, the two pipes run parallel until reaching a union at the top of the drilling stem.

In some embodiments of the switching system the integrated boring and cutting water delivery pipe attaches to, or is an integral part of a union. From a lower part of the union, a rotatable integrated boring and cutting drill stem, with the same dimensions and diameters as the integrated boring and cutting delivery pipe, extends vertically downward. This rotatable integrated boring and cutting drill stem features a motor that is also activated by the external switch. The motor enables the drill stem to rotate. The similarity in dimensions enables the integrated boring and cutting water delivery pipe to fluidly communicate with the drill stem. At the same time, the union between the two pipes prevents the integrated boring and water delivery pipe from rotating yet allows the rotatable integrated boring and cutting drill stem to rotate. The rotatable integrated boring and cutting drill stem has an inner pipe and an outer pipe. At a lower end of the drill stem, there is a cutting head with nozzles that allow the pressurized water to be ejected therethrough to cut the coke away from the interior of the coke drums. The cutting head has boring and cutting nozzles. The boring nozzles eject high pressure fluid in a downward angle to produce the bore hole, and the cutting nozzles eject high pressure fluid in a direction roughly perpendicular to the drill stem.

In some embodiments of the switching system the rotatable integrated boring and cutting drill stem is activated by a remote switching means. One embodiment of the present invention is characterized by the feature that high pressure fluid cannot flow into the cutting nozzles and the boring nozzles of a cutting head at the same time. After the cutting head has been inserted into the top of the coke drum, pressurized fluids are ejected through a plurality of nozzles in the cutting head at a pressure sufficient to cut and dislodge coke from the vessel. When an operator actuates the switch valve pressurized fluids are allowed to flow into the boring water delivery pipe through the union into the inner pipe of the integrated boring and cutting drill stem, into the cutting head and out one or more nozzles dedicated to cutting the bore hole in the coke. As the cutting head descends through the coke barrel, pressurized water enters the drill stem through the inner pipe ejecting fluid through a plurality of nozzles attached to the cutting head at a pressure sufficient to bore coke from the vessel. Thus, a bore hole is drilled through the coke using the nozzle or plurality of nozzles, which eject high pressure liquids in a downward direction from the cutting head.

In some embodiments of the switching system after the initial bore hole is completed, the flow of high pressure fluid is remotely switched to a plurality of nozzles attached to the cutting head at a pressure sufficient to cut and dislodge the remainder of coke from the vessel. This switching is accomplished by actuating a switch valve, which is in a position remote from the coke barrel. In one embodiment of the present invention the operator remotely switches the flow of fluid from the boring nozzles to the cutting nozzles by turning the handle of a three-way ball valve, which is in a location remote from the vessel being decoked. Thus, when the cutting head has successfully completed its boring stroke the switch valve is activated allowing pressurized fluid to flow into the cutting water delivery pipe, but not into the boring water delivery pipe. The pressurized fluid flows through the cutting water delivery pipe then enters the outer pipe of the integrated boring and cutting drill stem and is ejected from the cutting nozzles of the cutting head to begin cutting the coke away from the interior of the coke drum. Subsequently, the remainder of coke in the drum is cut and dislodged from the vessel.

Thus, in some embodiments of the invention the entire boring and cutting processes are activated by the external switch, which activates the switch valve located where the pipe divides into the boring water delivery pipe and the cutting water delivery pipe. The process is controlled by the external switch mechanism. Therefore, the operator is able to determine which mode, either boring or cutting, the rotatable integrated boring and cutting drill stem is in without having to remove the cutting head from the coke drum during the entire coke-cutting process.

In some embodiments of the present invention, the switch valve is controlled by a central processing unit, or other means, rather than a live operator. Thus, it is contemplated by the present invention that the switch valve could be controlled from a control room wherein an operator remotely controls the entire decoking process utilizing mechanical and electrical apparatus to remotely dictate the flow during the decoking process. The present invention comprises several objectives which achieve previously unknown models of efficiency and safety in the art. Accordingly, it is an object of some embodiments of the present invention to provide a system for cutting coke that is controlled from a remote location through an external switching mechanism. The present invention provides a system for coke-cutting wherein the drill stem does not need to be removed to change from boring to cutting mode, but rather, modes can be changed remotely from boring to cutting or from cutting to boring. The present invention provides a system for coke-cutting, wherein the rotatable integrated boring and cutting drill stem does not clog because switching from boring to cutting is controlled by a remote switch, precluding both modes from operating simultaneously.

Some embodiments of the switching system comprise a system for coke-cutting, wherein a physical symbol is connected to said switch valve so that the operational status, i.e., boring and cutting modes, is manifested externally to an operator. The present invention provides a system for coke-cutting can be used with current coke-cutting techniques.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

FIG. 3-B illustrates a cut-away side view of the wedge plug-type de-header valve of FIG. 3-A;

FIG. 4-B illustrates a cut-away side view of the ball-type de-header valve of FIG. 4-A;

FIG. 5-B illustrates a top view of the adjusting wedge gate-type de-header valve of FIG. 5-A;

FIG. 5-C illustrates a cut-away side view of the adjusting wedge gate-type de-header valve of FIG. 5-A;

FIG. 6-B illustrates a top view of the flexible wedge gate-type de-header valve of FIG. 6-A;

FIG. 6-C illustrates a cut-away side view of the flexible wedge gate-type de-header valve of FIG. 6-A;

FIG. 7-B illustrates a top view of the parallel slide gate-type de-header valve of FIG. 7-A;

FIG. 7-C illustrates a cut-away side view of the parallel slide gate-type de-header valve of FIG. 7-A;

FIG. 8-B illustrates a top view of the solid wedge gate-type de-header valve of FIG. 8-A;

FIG. 8-C illustrates a cut-away side view of the solid wedge gate-type de-header valve of FIG. 8-A;

FIG. 9-B illustrates a top view of the sliding blind gate-type de-header valve of FIG. 9-A;

FIG. 9-C illustrates a cut-away side view of the sliding blind gate-type de-header valve of FIG. 9-A;

FIG. 12-B illustrates a top view of an embodiment of a goggle valve, claimed in the invention, in a partially open position;

FIG. 12-C illustrates a top view of an embodiment of a goggle valve, claimed in the invention, in a fully open position;

FIG. 12-D provides several illustrations of an embodiment of a goggle valve as claimed in the invention;

FIG. 18 illustrates an embodiment of a static seat;

DETAILED DESCRIPTION OF THE INVENTION

Figure 1:
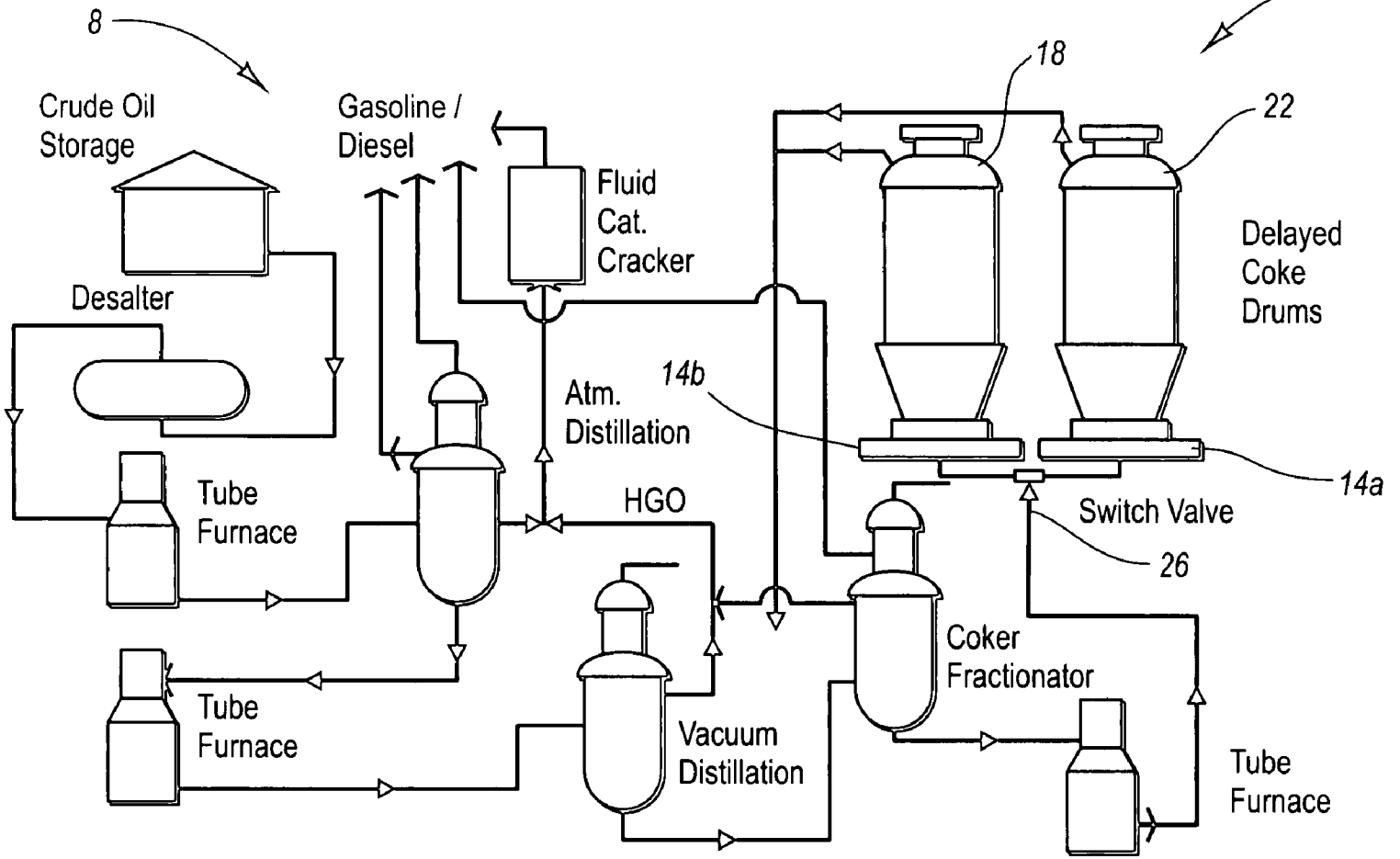
FIG. 1 illustrates, generally, an exemplary refinery process, wherein refinery byproducts are routed to a series of coke drums for the manufacture of coke, and wherein the coke drums are equipped with the de-header valves of the present invention.

It will be readily understood that the components of the present invention, as generally described and illustrated in the figures herein, could be arranged and designed in a wide variety of different configurations. Thus, the following more detailed description of the embodiments of the system, device, and method of the present invention, as represented in FIGS. 1 through 45, is not intended to limit the scope of the invention, as claimed, but is merely representative of the presently preferred embodiments of the invention.

The presently preferred embodiments of the invention will be best understood by reference to the drawings wherein like parts are designated by like numerals throughout. Although reference to the drawings and a corresponding discussion follow below, the following more detailed description is divided into sections. The first section pertains to and sets forth a general discussion of the delayed coking process, including the process and effects of de-heading a coke drum at the end of a coke manufacturing cycle. The second section pertains to and sets forth the coke drum de-heading system, including the variety of valves or valve-types that may be utilized in the coke drum de-heading system and within a delayed coking process, as well as the various methods for utilizing the system within a delayed coking or other similar environment. The third section pertains to the continuous containment system. The fourth section pertains to the remote switching system. It is noted that these sections are not intended to be limiting in any way, but are simply provided as convenience to the reader.

Embodiments of the whole safety system for delayed decoker operation may be fully remotely operated from the control room. In the past operators have determined the status and progress of cutting through vibration and acoustic emission feedback. In embodiments of this invention this can be replicated by placing sensors on the drum, that when connected to a graphical user interface indicate to the operator whether proper cutting is occurring or whether the cutting process needs to be reversed, the drill raised a little, and the cutting recommenced to clean the sides of the drum of coke.

In some embodiments in order for the safety system to be reliably operated there must be a system of interlocks between the switch valve the isolation valve and the top and bottom deheading valves to indicate that the valves are in the appropriate position for the sequential operations to occur. In some embodiments the values must all have position sensors that are reliable and the program logic must be able to account for changes in torque over long periods of time so the valves retain repeatable thrust.

1. General Discussion on the Delayed Coking Process

In the typical delayed coking process, high boiling petroleum residues are fed to one or more coke drums where they are thermally cracked into light products and a solid residue—petroleum coke. The coke drums are typically large cylindrical vessels having a top head and a conical bottom portion fitted with a bottom head. The fundamental goal of coking is the thermal cracking of very high boiling point petroleum residues into lighter fuel fractions. Coke is a byproduct of the process. Delayed coking is an endothermic reaction with a furnace supplying the necessary heat to complete the coking reaction in a drum. The exact mechanism is very complex, and out of all the reactions that occur, only three distinct steps have been isolated: 1) partial vaporization and mild coking of the feed as it passes through the furnace; 2) cracking of the vapor as it passes through the coke drum; and 3) cracking and polymerization of the heavy liquid trapped in the drum until it is converted to vapor and coke. The process is extremely temperature-sensitive with the varying temperatures producing varying types of coke. For example, if the temperature is too low, the coking reaction does not proceed far enough and pitch or soft coke formation occurs. If the temperature is too high, the coke formed generally is very hard and difficult to remove from the drum with hydraulic decoking equipment. Higher temperatures also increase the risk of coking in the furnace tubes or the transfer line. As stated, delayed coking is a thermal cracking process used in petroleum refineries to upgrade and convert petroleum residuum into liquid and gas product streams leaving behind a solid concentrated carbon material, or coke. A fired heater is used in the process to reach thermal cracking temperatures, which range upwards of 1,000° F. With short residence time in the furnace, coking of the feed material is thereby "delayed" until it reaches large coking drums downstream of the heater. In normal operations, there are two coke drums so that when one is being filled, the other may be purged of the manufactured coke. These coke drums are large structures that are approximately 25-30 meters in height and from 4 to 9 meters in diameter. They are equipped with a top blind flange closure or orifice that is typically about 1.5 meters in diameter, and a bottom blind flange orifice that is typically about 2 meters in diameter.

In a typical petroleum refinery process, several different physical structures of petroleum coke may be produced. These are namely, shot coke, sponge coke, and/or needle coke (hereinafter collectively referred to as "coke"), and are each distinguished by their physical structures and chemical properties. These physical structures and chemical properties also serve to determine the end use of the material. Several uses are available for manufactured coke, some of which include fuel for burning, the ability to be calcined for use in the aluminum, chemical, or steel industries, or the ability to be gasified to produce steam, electricity, or gas feedstock for the petrochemicals industry.

To produce the coke, a delayed coker feed originates from the crude oil supplied to the refinery and travels through a series of process members and finally empties into one of the coke drums used to manufacture coke. A basic refinery flow diagram is presented as FIG. 1, with two coke drums shown. The delayed coking process typically comprises a batch-continuous process, which means that the process is ongoing or continuous as the feed stream coming from the furnace alternates filling between the two or more coke drums. As mentioned, while one drum is on-line filling up with coke, the other is being stripped, cooled, decoked, and prepared to receive another batch. In the past, this has proven to be an extremely time and labor intensive process, with each batch in the batch-continuous process taking approximately 12-20 hours to complete. In essence, hot oil, or resid as it is commonly referred to, from the tube furnace is fed into one of the coke drums in the system. The oil is extremely hot and produces hot vapors that condense on the colder walls of the coke drum. As the drum is being filled, a large amount of liquid runs down the sides of the drum into a boiling turbulent pool at the bottom. As this process continues, the hot resid and the condensing vapors cause the coke drum walls to heat. This naturally in turn, causes the resid to produce less and less of the condensing vapors, which ultimately causes the liquid at the bottom of the coke drum to start to heat up to coking temperatures. After some time, a main channel is formed in the coke drum, and as time goes on, the liquid above the accumulated coke decreases and the liquid turns to a more viscous type tar. This tar keeps trying to run back down the main channel which can coke at the top, thus causing the channel to branch. This process progresses up through the coke drum until the drum is full, wherein the liquid pools slowly turn to solid coke. When the first coke drum is full, the hot oil feed is switched to the second coke drum, and the first coke drum is isolated, steamed to remove residual hydrocarbons, cooled by filling with water, opened, and then decoked. This cyclical process is repeated over and over again throughout the manufacture of coke.

The decoking process is the process used to remove the coke from the drum upon completion of the coking process. Due to the shape of the coke drum, coke accumulates in the area near and attaches to the flanges or other members used to close off the opening of the coke drum during the manufacturing process. To decoke the drum, the flanges or members must first be removed or relocated. In the case of a flanged system, once full, the coke drum is vented to atmospheric pressure and the top flange (typically a 4-foot diameter flange) is unbolted and removed to enable placement of a hydraulic coke cutting apparatus. After the cooling water is drained from the vessel, the bottom flange (typically a 7-foot-diameter flange) is unbolted and removed. This process is commonly known as "de-heading" because it removes or breaks free the head of coke that accumulates at the surface of the flange. As indicated above, de-heading a coke drum can be a very dangerous procedure, namely because of the size of the flanges, the high environmental temperatures within the drum, the potential of loose coke to fall, and other reasons. Once the flanges are removed, the coke is removed from the drum by drilling a pilot hole from top to bottom of the coke bed using high pressure water jets. Following this, the main body of coke left in the coke drum is cut into fragments which fall out the bottom and into a collection bin, such as a bin on a rail cart, etc. The coke is then dewatered, crushed and sent to coke storage or a loading facility.

2. Coke Drum Valve/De-Heading System

Although the present invention is intended to cover both top and bottom de-heading systems, or rather the de-heading system of the present invention may be applicable and utilized on both the top and bottom openings of a coke drum, the following detailed description and preferred embodiments will be discussed in reference to a bottom de-heading system only. One ordinarily skilled in the art will recognize that the invention as explained and described herein for a coke drum bottom de-heading system may also be designed and used as a coke drum top de-heading system, and that the following discussion pertaining to the bottom de-heading system is limited to such. In fact a preferred embodiment of the invention comprises both a top and bottom de-heading system.

The present invention describes a valve system and method for unheading or de-heading a coke drum following the manufacture of coke therein. As the present invention is especially adapted to be used in the coking process, the following discussion will relate specifically in this manufacturing area. It is foreseeable however, that the present invention may be adapted to be an integral part of other manufacturing processes producing various elements or by products other than coke, and such processes should thus be considered within the scope of this application. For example, it is contemplated that the present invention de-header system and de-header valves may be utilized within other critical service applications, such as inlet feed line isolation, blowdown isolation, fractionator isolation, and back warming.

Prior to reciting the specifics of the present invention, it should be noted that the present invention system and method is designed to have or possess significant functional, utility, and safety advantages over prior related designs and systems. These should be kept in mind when reading the following detailed disclosure.

The system of many of the embodiments of the present invention are capable of automatic and repeated unheading (or de-heading) of a coke drum with little or no manual intervention required at or nearby the coke drum. Thus, safety and efficiency are both dramatically increased. The system of many of the embodiments of the present invention reduces the total de-heading to re-heading time to less than 10 minutes. Such a time is a drastic improvement over the times of prior art de-heading systems. In several embodiments of the present invention, the de-header valve may be removably fixed or coupled directly to the coke drum flange, or to a transition spool above the de-header valve, as well as to a stationary coke chute below the device, which chute discharges directly into a collection bin or rail car. In several embodiments of the present invention, the system has the flexibility to allow safe drainage of coke and drum water through its outlet port and into the pit without any spillage onto the de-heading deck. In several embodiments of the present invention, the system is designed and constructed in a way to ensure long term operation without clogging or being operationally obstructed by coke particles, chunks, resid, or any other foreign matter. In several embodiments of the present invention, the system is designed to be able to demonstrate, with absolute certainty, at all times and at all local and remote locations that it is positively isolating. In several embodiments of the present invention, the system is virtually maintenance free except for long term parts replacement during scheduled shutdowns. Consequently, there are virtually no maintenance costs beyond the scheduled maintenance times. In several embodiments of the present invention, the system is capable of incorporating diagnostic capabilities that allow real time assessment and trending of the condition of sealing components during normal operations, in order to facilitate planned maintenance. In several embodiments of the present invention, the system is easy to install as compared with other systems, and is capable of being serviced in the field or on-site. In several embodiments of the present invention, the system is cost competitive with existing technology, yet significantly outperforms this technology in virtually every aspect. In several embodiments of the present invention, the de-header valve and system functions to increase the throughput of the delayed coking system. The de-header system may be configured to allow drainage or water through the port, and drainage of water and coke through the port. In several embodiments of the present invention, the system comprises a simple mechanical design and is extremely simple to operate. In several embodiments of the present invention, the system is totally enclosed from the top head of the coke drum to the receiving area or collection bin, thus no exposure to personnel, the unheading deck, or to plant equipment. In several embodiments of the present invention, all required safety interlocks are incorporated. In several embodiments of the present invention, operating costs are low. For instance, there are no head gaskets or feed line coupling gaskets to replace at each drum cycle; nor are there any feed line coupling or alignment systems to maintain; there is no water flushing required after each cycle; there is no disassembly, cleaning, and re-assembly required after each cycle; and there are no parts or tools that need replacing at each cycle. In several embodiments of the present invention, the de-header valve and system comprises a steam purged body that utilizes a diagnostics tool, that regulates body temperature, and that creates a barrier against coke migration. In several embodiments of the present invention, the de-header valve may be quickly assembled and installed onto a coke drum and disassembled and uninstalled from a coke drum, and is re-buildable on-site during shutdowns.

Specifically regarding safety issues, there is no exposure to coke drum contents whether onto the de-heading deck, to personnel, anywhere or at anytime during the coke drum de-heading process, or during any automated, manual, or inadvertent operation of the de-header valve during a switching cycle. In one embodiment of the present invention, the system comprises a simple, redundant hydraulic design with one hydraulic power unit and one cylinder, and one supply and one return hydraulic line. Therefore, there is less exposure to possible leaks during commissioning and startup as well as less opportunity for accidental or inappropriate normal operation. Further, the system comprises a positive mechanical lockout device in the form of a lockout pin, that may be incorporated during both open and closed positions of the valve. Still further, a compact hydraulic backup device for the open and close functions is supplied with the system, or is easily installed at the site, without exposing personnel. Still further, coke drum inlet feed line coupling and alignment devices are not required, therefore, there are no inlet line-coupling gaskets to replace or clean following each drum cycle, or exposure to personnel due to coupling misalignment and leakage.

Several embodiments of the present invention comprise a simple redundant hydraulic design as described above. The system also comprises one major moving part instead of multiple moving parts as found on existing devices and systems. This significantly increases the ease of operation, as well as the durability of the system because there is less that can go wrong or less moving parts that can malfunction. Moreover, the isolation and containment of the coke provide a clean operating atmosphere that contributes to the durability and robust nature of the system.

In some embodiments of the invention, there are no head gaskets to replace after each drum cycle or after a failed coke drum pressure test. Furthermore, very little to no routine maintenance is required during normal operation. Still further, certain embodiments of the invention comprise a compact and basic operating control console that can be strategically located and installed with minimal effort and with all desired safety interlocks. Some embodiments of the invention internal diagnostic capabilities that allow the operator to schedule maintenance to coincide with planned shutdown times. Another embodiment of the invention comprises no water flushing of moving parts is required. In other embodiments of the invention, the coke drum inlet feed line coupling and alignment devices are not required, thus there are no inlet line coupling gaskets to replace or clean after each cycle. In other embodiments of the invention, minimum spare parts are required to be kept on hand, thus parts and storage costs can be reduced. In other embodiments of the invention, the system can be configured to allow drainage of the drum water directly through the port on the coke drum.

Several embodiments of the present invention are easy to operate and maintain, only an open and closed function is required, there is no water flushing of moving parts required, there is no head gasket surface cleaning required, which in most cases is difficult to perform and requires special tools, there are minimal spare parts required, and the operating system may be strategically located and compact and easy to use.

Many embodiments of the invention are designed to be used on either the top or bottom ports of the coke drum. Moreover, the invention may be designed for use in other industries or for other critical use systems.

These several advantages presented herein are not to be limiting in any way. Indeed, other advantages beyond these are contemplated and will be apparent to one skilled in the art.

Turning to the Figures of the present invention and a more detailed analysis, FIG. 1 depicts, generally, a petroleum manufacturing and refinery process 8 having several elements and systems present (identified, but not discussed). In addition to these elements, petroleum manufacturing and refinery process 8 further comprises a coke drum de-heading system 10 that includes first and second delayed coke drums 18 and 22, respectively, and de-header valves 14-*a* and 14-*b* attached thereto. As mentioned, there are typically at least two coke drums in simultaneous operation so as to permit the ongoing manufacture and refinery of petroleum as well as its coke byproduct. While first coke drum 18 is online and being filled via feed inlet 26, second coke drum 22 is going through a decoking process to purge the manufactured coke contained therein. Thereafter, when first coke drum 18 has reached capacity, feed inlet 26 is switched to second coke drum 22 that has just previously been purged of its contents, whereby first coke drum 18 is primed for the decoking process where its contents will be purged. This cyclical process, commonly referred to as batch-continuous, allows the refinery to maintain continuous uninterrupted operation. Of course there may be only one coke drum or a plurality of coke drums present. Although FIG. 1 is illustrative of a petroleum manufacturing and refinery process having two coke drums in series, and although the discussion and preferred embodiments illustrated, described, and discussed herein focus on a coke drum de-heading system, one ordinarily skilled in the art will recognize that the present invention may be applicable or adapted to a number of different processes in which a function similar to the coking process is present.

Figure 2:
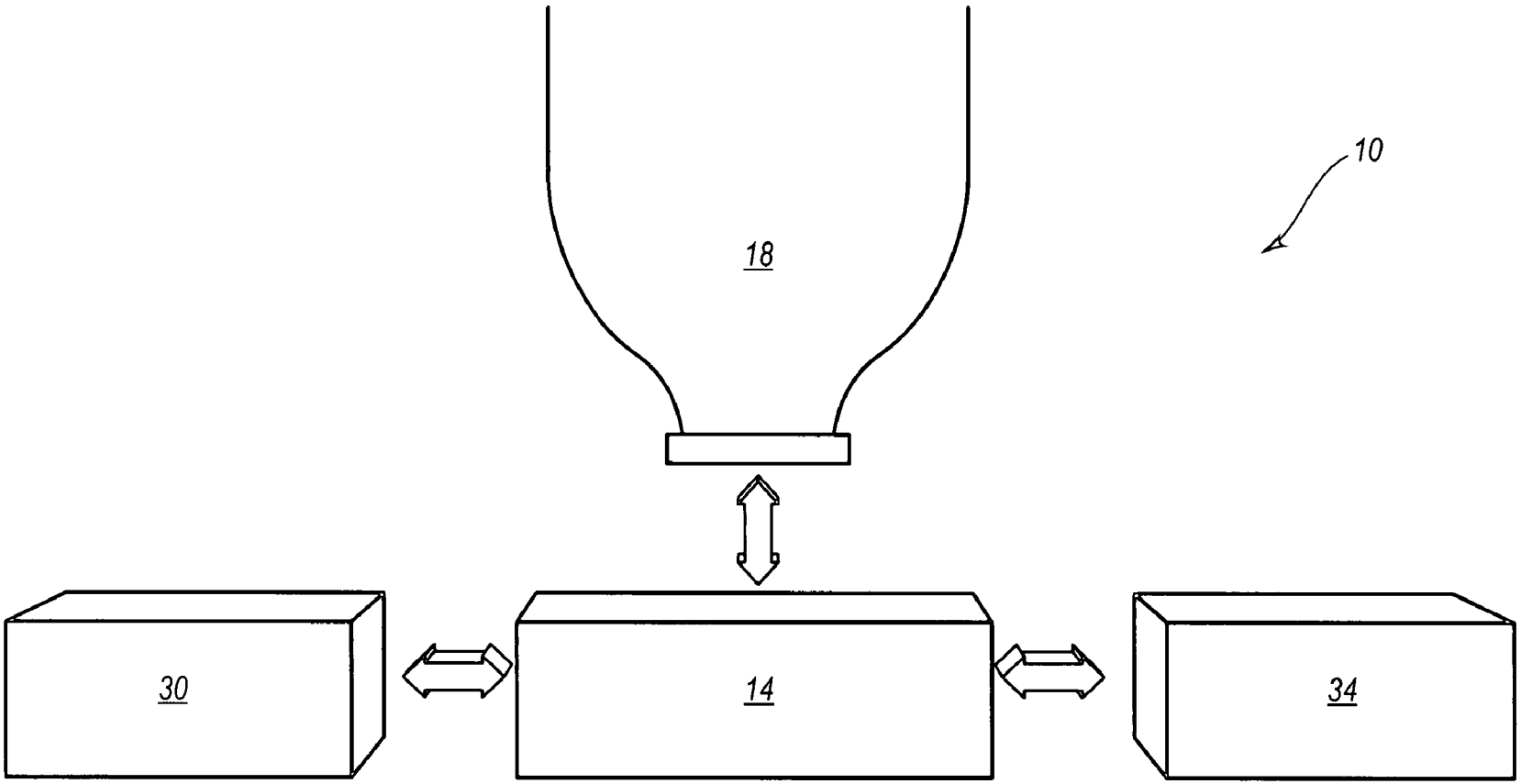
FIG. 2 illustrates a general diagram representative of any type of de-header valve as it connects to a coke drum and upper and lower bonnet within a coke drum de-heading system according to an exemplary operating environment of the present invention.

With reference to FIG. 2, shown is a generic diagram depicting a general coke drum de-heading system 10. Coke drum de-heading system 10 comprises a de-header valve 14 that removably couples to a coke drum 18 using various known means in the art. De-header valve 14 typically couples to coke drum 18 at its flanged port or opening, much the same way a flanged head unit would be attached in prior related designs. De-header valve 14 is shown further attaching to upper and lower bonnets 30 and 34, respectively.

De-header valve 14 is shown generically because it is intended that de-header valve 14 may comprise a variety of valve types. For example, de-header valve 14 may comprise a plug valve, a ball or globe valve, a flexible wedge gate valve, a parallel slide gate valve, a solid wedge gate valve, a goggle valve and a sliding blind gate valve.

Essentially, the variety of de-header valves each have only one major moving part, the valve closure (not shown), which assures simplicity, reliability, and ease of maintenance. The surfaces of means for supporting the valve closure (e.g., the dual, metal seat surfaces in some embodiments), the body interior, and all internal parts are fully protected and isolated from any process media in the fully open or fully closed positions. The materials used in the construction of all sealing parts are resistant to corrosion, and are designed for exceptionally high metal to metal cycle duty. The seals of the de-header valve are designed to cleanly break the bond between the coke and the exposed surface of the valve closure at each stroke. The total thrust required for this action combined with the thrust required to overcome seating friction and inertia is carefully calculated and is accomplished by actuating the valve closure, thus causing it to relocate or transition from a closed to an open position.

During the initial stages of coking, the surfaces of the valve closure will distort due to uneven heat distribution throughout its thickness. Thus, in order to compensate for thermal expansion and thermal distortion of the valve closure during heat up, the externally live loaded and dynamic metal seats of the de-heading valve are designed to articulate axially and transversely as well as conform to the induced camber of the valve closure at maximum differential temperature. This unique capability, combined with a continuously pressurized body, assures the integrity of the seal across the de-heading valve at all times during the switching cycle.

Figure 3A:
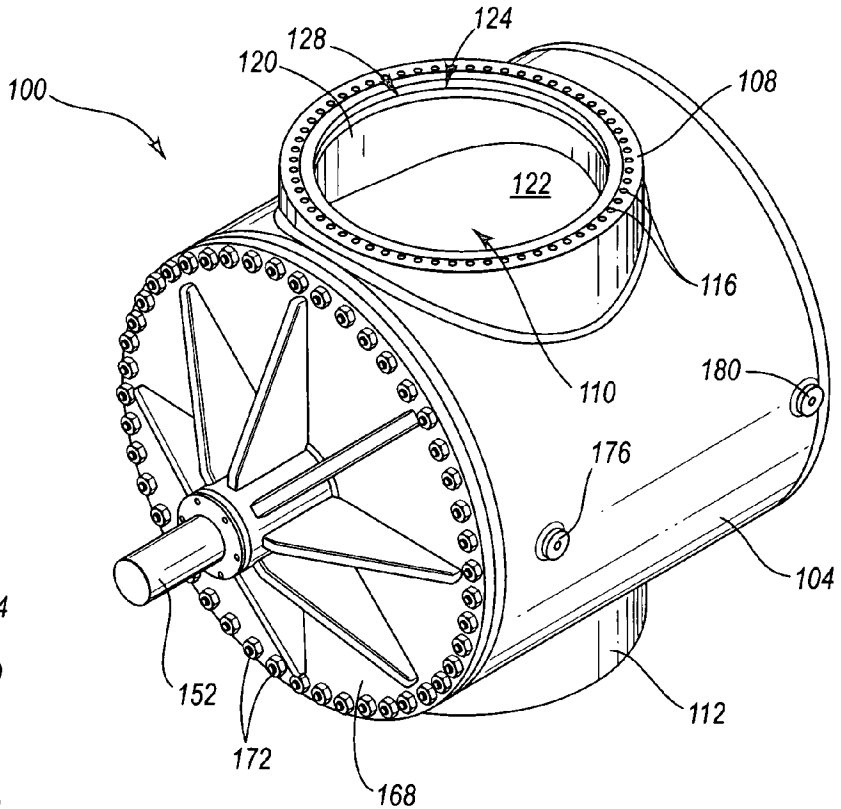
FIG. 3-A illustrates a perspective view of a wedge plug-type de-header valve according to one exemplary embodiment of the present invention.
Figure 3B:
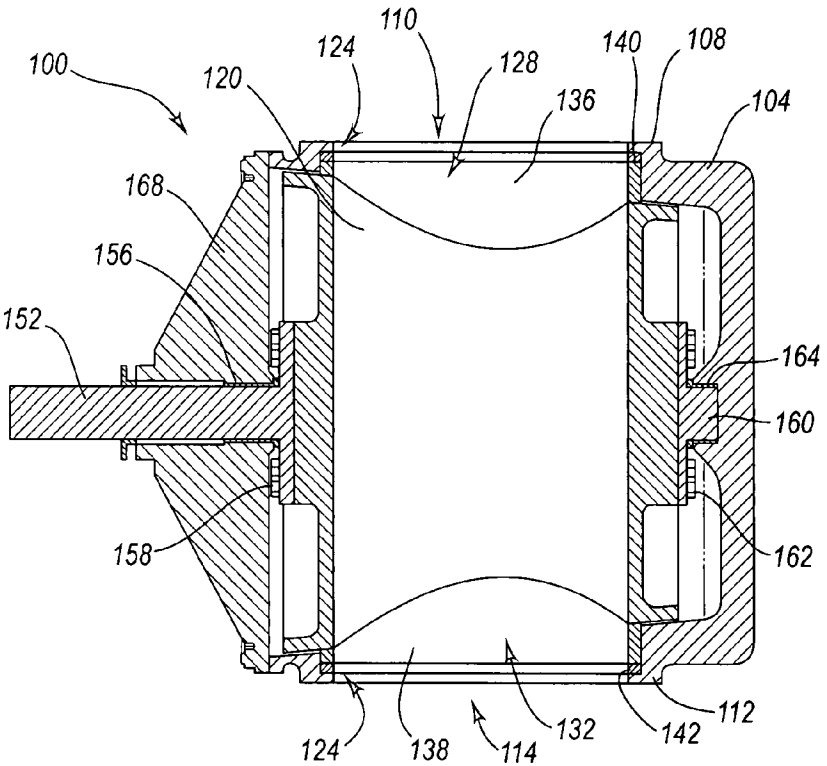

FIGS. 3-A and 3-B illustrate various views of a plug-type de-header valve 100 according to one exemplary embodiment of the present invention. In this embodiment, plug-type de-header valve 100 comprises a main body 104 that is capable of being removably coupled to a coke drum (not shown). As shown, plug-type de-header valve 100, and particularly main body 104, comprises a first flanged portion 108 and a second flanged portion 112. Main body 104 is attached to bonnet 168 via attachment means, such as bolt connection 172. First flanged portion 108 comprises a flange having an opening 110 comprising a diameter that mates or fits and aligns with a complimentary flange and opening or port of similar diameter on a coke drum. Second flanged portion 112 comprises a flange having an opening 114 comprising a diameter that mates or fits and aligns with a complimentary flange and opening or port of similar diameter on an attaching member. Plug-type de-header valve 100 is removably coupled to a coke drum via first flanged port 108 using any known connection means. Connection means may be a bolt connection, such as bolt connection 116 as shown, or any other suitable connection. First flanged port 108 functions as an inlet for plug-type de-header valve 100 and receives coke and other residual material therein from the coke drum. Second flanged port 112 functions as an outlet through which the manufactured coke and other material may pass to be further disposed within a catch basin of some sort.

Plug-type de-header valve 100 further comprises a valve closure 120 housed or contained within main body 104. Valve closure 120 may comprise a cylindrical shape, a conical shape, or any other suitable shape for a plug valve as known in the industry. As shown, valve closure 120 comprises a substantially conical shape having curved or convex sides. Valve closure further comprises an orifice 122 extending through valve closure 120. Valve closure 120 is caused to rotate within main body 104 and within a seat support system 124 that functions to hold valve closure 120 in place during operation of the valve, as well as to facilitate the de-heading of the coke drum. As valve closure 120 is rotated, orifice 122 is brought in and out of alignment with flanged port 108 and associated opening 110 and flanged port 112 and associated opening 114, thus opening and closing, respectively, plug-type de-header valve 100. Valve closure 120 is caused to rotate by outside actuating means (not shown), typically in the form of a powered motor, that couples to valve stem 152 as commonly known in the art. Valve stem 152 extends through bonnet 168 and into the interior of main body 104, where it subsequently attaches to valve closure 120 using attachment means, such as bolt connection 158.

Opposite valve stem 152 on the other side of valve closure 120 is stub shaft 160 that is also coupled to valve closure 120 via connection means, such as bolt connection 162. Upon actuation, valve stem 152 turns upon bearings 156 lodged and supported within bonnet 168, while stub shaft 160 turns upon bearings 164 lodged and supported within main body 104. Bearings 156 and 164 function to ensure proper concentric motion of valve stem 152 and valve closure 120 within main body 104, as well as to reduce rotational friction and help overcome encountered inertia. As valve stem 152 and stub shaft 160 are fixed to valve closure 120, induced or driven rotation of these components functions to also drive the rotation of valve closure 120. The rotation of valve closure 120 in this manner effectively opens and closes plug-type de-header valve 100, or rather allows plug-type de-header valve 100 to regulate the throughput of an attached coke drum.

Plug-type de-header valve 100 further comprises means for supporting valve closure 120 during its rotational phases as it moves back and forth from an open position to a semi-opened position and closed position. In the exemplary embodiment shown, means for supporting valve closure 120 comprises a seat support system 124 comprising an upper seat assembly 128 disposed within flanged port 108 and a lower seat assembly 132 disposed within flanged port 112. Seat support system 124 functions to support valve closure 120 as it is caused to rotate within main body 104, as well as to provide and maintain a continuous contact seal against valve closure 120 throughout its rotations as it opens and closes or regulates the throughput of a coke drum. Seat support system 124 may comprise several seat configurations at its upper and lower seat assemblies, including, but not limited to, dual, independent floating or dynamic seats, dual, independent static seats, a combination of a static and a floating or dynamic seat, or no seats altogether, wherein the support for valve closure 120 comes directly from the main body 104 itself or some other support member or system.

In the preferred embodiment shown, seat support system 124 comprises dual, independent seats as part of both its upper seat assembly 128 and lower seat assembly 132. Specifically, upper seat assembly 128 comprises a static seat, seat 136, and lower seat assembly 132 also comprises a static seat, seat 138. Of course, the present invention also contemplates that either upper or lower seat assemblies 128 and 132 of plug-type de-header valve 100 may comprise a floating or dynamic, live loaded seat opposite a static seat, wherein the live loaded dynamic or floating seat would function to adjust to changing pressures and other induced conditions. Moreover, it is contemplated that either upper or lower seat assemblies 128 and 132 of the present invention plug-type de-header valve 100 may each comprise a live loaded floating or dynamic seat.

It will be obvious to one skilled in the art that any combination of floating, static, or similar type seats may be utilized by the various de-header valves of the present invention. As such, the embodiment shown in each of the Figures herein is not meant to be limiting in any way.

In the preferred embodiment, static seats 136 and 138 are securely fastened or coupled to de-header valve 100 and are disposed within seat retainers 140 and 142, respectively. Static seats 136 and 138 may or may not be adjustable depending upon design and intended use considerations. In the event one embodiment calls for a live loaded dynamic or floating seat, this seat will preferably be a moveable and adjustable seat that is energized from without the process stream via a live seat adjustment mechanism. The function of the dynamic, live loaded seat is to provide point to point fine tuning of the system, and particularly the valve closure as it is sealed between upper and lower seats 136 and 138. Various sealing members, such as O-rings, may be used to seal the seats and their adjacent seat retainers to de-header valve 100.

In another exemplary embodiment, means for supporting valve closure 120 comprises a support system provided by main body 104, without requiring some type of a seat support system. In this particular embodiment, main body 104 will comprise some type of surface adapted or made to contact valve closure 120 in a similar manner as the seat support system described above, wherein main body 104 will be capable of functioning in a similar manner to provide support of valve closure 120 and to create a continuous contact seal therebetween.

It is important to note that in each of the embodiments discussed above, it is preferable that a continuous contact seal be created between valve closure 120 and means for supporting valve closure 120, meaning that during the coke manufacturing process, as well as the back and forth rotation of valve closure 120 from an open position, to a semi-opened position, and finally to a closed position, with respect to the opening or port of a coke drum, the created contact seal is never broken or breached, but its integrity is maintained at all times. This continuous contact seal is preferably a metal to metal contact seal that performs several functions and has several advantages. First, the contact seal creates, or at least contributes to, valve isolation, wherein an isolated environment is provided, such that no material is allowed to escape outside the sealed area and into the main body or other parts of the de-header valve, the area outside the de-header valve (e.g., the unheading deck), or other areas. Various steam purge systems 176, condensate management systems 180, and coke containment systems (not shown) also function to regulate pressure within the de-header valve, to contain the material within designated areas, and to maintain valve isolation. Second, the continuous contact seal helps to keep various components of the de-header valve clean and free of the product material as these materials are not allowed beyond the sealed area. Third, as a result of the load exerted upon valve closure 120 and resulting tight tolerances existing between valve closure 120 and upper and lower seats 136 and 138, the rotation of valve closure 120 between upper and lower seats 136 and 138 causes a grinding and polishing effect to occur. In a preferred embodiment, upper and lower seats 136 and 138, as well as valve closure 120 are made of metal, thus providing a metal to metal contact or metal to metal seal, or otherwise referred to as metal to metal seating of valve closure 120. This metal to metal seating is a unique aspect of the present invention in relation to coke drum de-heading. The metal to metal seating increases the durability of the system as there are no non-metal parts, such as vinyl or rubber, used to seal the seats to valve closure 120. Metal to metal seating allows the system to achieve a higher consistency of sealing, while at the same time providing extended wear and durability. In addition, the metal to metal sealing allows the system, and specifically the sealing within the system, to be fine-tuned as needed. Fourth, as the valve closure 120 is actuated and rotated from a closed position to an open position, the contact seal existing between the surface of valve closure 1120 and the surface of means for supporting a valve closure functions to break up or shear the manufactured coke that has accumulated on or near the surface of valve closure 120, thus effectively de-heading the coke drum and facilitating the decoking process. Other functions and advantages may be realized by one skilled in the art.

Figure 4A:
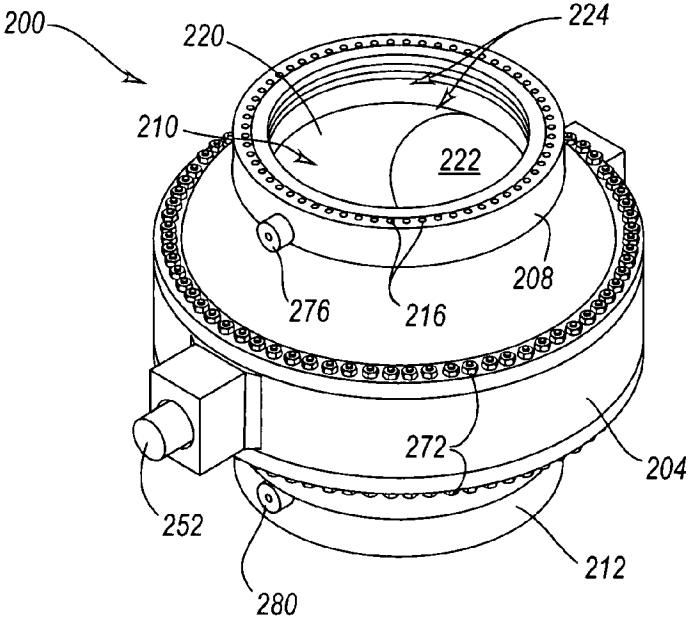
FIG. 4-A illustrates a perspective view of a rotary ball-type de-header valve according to one exemplary embodiment of the present invention.
Figure 4B:
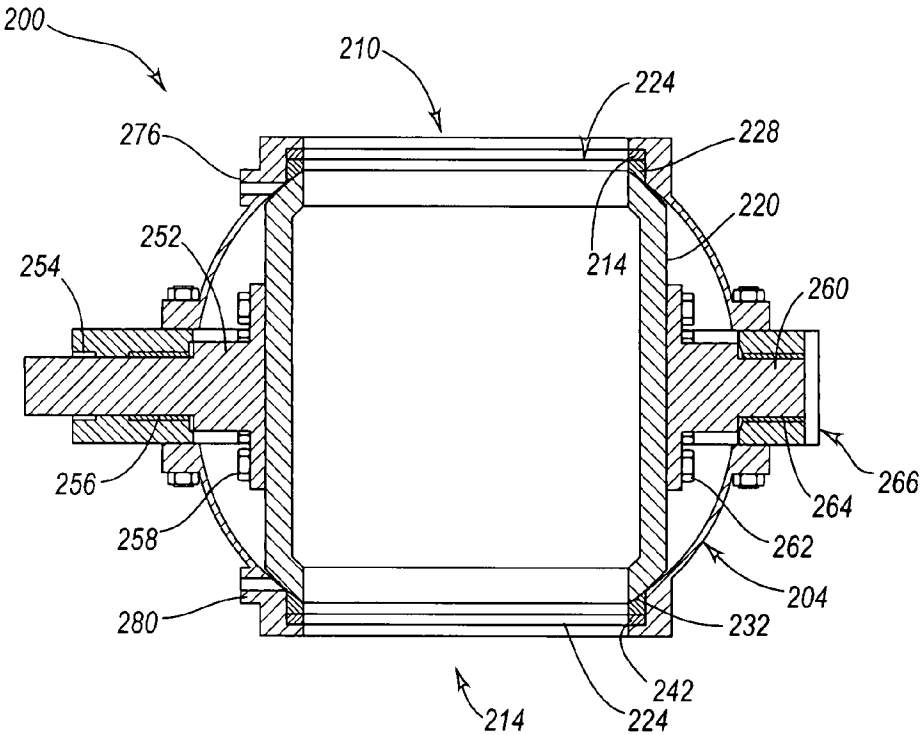

FIGS. 4-A and 4-B illustrate various views of a rotary ball-type de-header valve 200 according to one exemplary embodiment of the present invention. Ball-type de-header valve 200 functions in a similar manner as plug-type de-header valve 100 discussed above, only ball-type de-header valve 200 comprises a valve closure 220 having a round or semi-round shape that rotates between matching rounded means for supporting valve closure 220, preferably matching rounded seats, that provide uniform sealing. In the embodiment shown, ball-type de-header valve 200 comprises a main body 204 that is capable of being removably coupled to a coke drum (not shown). As shown, ball-type de-header valve 200, and particularly main body 204, comprises a first flanged port 208 and a second flanged port 212, and is attached to bonnet 268 via attachment means, such as bolt connection 272. First flanged port 208 comprises a flange having an opening 210 comprising a diameter that mates or fits and aligns with a complimentary flange and opening or port of similar diameter on a coke drum. Second flanged port 212 comprises a flange having an opening 214 comprising a diameter that mates or fits and aligns with a complimentary flange and opening or port of similar diameter on an attaching member. Ball-type de-header valve 200 is removably coupled to a coke drum via first flanged port 208 using any known connection means. Connection means may be a bolt connection, such as bolt connection 216 as shown, or any other suitable connection. First flanged port 208 functions as an inlet for ball-type de-header valve 200 and receives coke and other residual material therein from the coke drum. Second flanged port 212 functions as an outlet through which the manufactured coke and other material may pass to be further disposed within a catch basin of some sort. Steam purge port 276 and condensate port 280 provide additional advantages as described above.

Ball-type de-header valve 200 further comprises a valve closure 220 housed or contained within main body 204. Valve closure 220 comprises a round or substantially or semi-round shape having an orifice 222 extending therethrough. Valve closure 220 is caused to rotate within main body 204 and within a matching seat support system 224 that functions to hold valve closure 220 in place during operation of the valve, as well as to facilitate the de-heading of the coke drum. As valve closure 220 is rotated, orifice 222 is brought in and out of alignment with flanged port 208, with its associated opening 210, and flanged port 212, with its associated opening 214, thus opening and closing, respectively, ball-type de-header valve 200. Valve closure 220 is caused to rotate by outside actuating means (not shown), typically in the form of a powered motor, that couples to drive shaft 252 as commonly known in the art. Drive shaft 252 extends through packing 254, main body 204, and into its interior, where it subsequently attaches to valve closure 220 using attachment means, such as bolt connection 258. Opposite drive shaft 252 on the other side of valve closure 220 is stub shaft 260 that is also coupled to valve closure 220 via connection means, such as bolt connection 262 and contained by end cover 266. Upon actuation, drive shaft 252 turns upon bearings 256 lodged and supported within main body 204, while stub shaft 260 turns upon bearings 264 lodged and supported within main body 204 on an opposite side of valve closure 220. Bearings 256 and 264 function to ensure proper concentric motion of drive shaft 252 and valve closure 220 within main body 204, as well as to reduce rotational friction and help overcome encountered inertia. As drive shaft 252 and stub shaft 260 are fixed to valve closure 220, induced or driven rotation of these components functions to also drive the rotation of valve closure 220. The rotation of valve closure 220 in this manner effectively opens and closes ball-type de-header valve 200, or rather allows ball-type de-header valve 200 to regulate the throughput of an attached coke drum.

Ball-type de-header valve 200 further comprises means for supporting valve closure 220 during its rotational phases as it moves back and forth from an open position to a semi-opened position and closed position. In the exemplary embodiment shown, means for supporting valve closure 220 comprises a seat support system 224 comprising an upper seat assembly 228 disposed within flanged port 208 and a lower seat assembly 232 disposed within flanged port 212. Seat support system 224 functions to support valve closure 220 as it is caused to rotate within main body 204, as well as to provide and maintain a continuous contact seal against valve closure 220 throughout its rotations as it opens and closes or regulates the throughput of a coke drum. Seat support system 224 may comprise several seat configurations at its upper and lower seat assemblies, including, but not limited to, dual, independent floating or dynamic seats, dual, independent static seats, a combination of a static and a floating or dynamic seat, or no seats altogether, wherein the support for valve closure 220 comes directly from the main body 204 itself or some other support member or system. In the preferred embodiment shown, seat support system 224 comprises dual, independent seats as part of both its upper seat assembly 228 and lower seat assembly 232. Specifically, upper seat assembly 228 comprises a static seat, seat 236, and lower seat assembly 232 also comprises a static seat, seat 238. Of course, the present invention also contemplates that either upper or lower seat assemblies 228 and 232 of ball-type de-header valve 200 may comprise a floating or dynamic, live loaded seat opposite a static seat, wherein the live loaded dynamic or floating seat would function to adjust to changing pressures and other induced conditions. Moreover, it is contemplated that either upper or lower seat assemblies 228 and 232 of the present invention ball-type de-header valve 200 may each comprise a live loaded floating or dynamic seat. It will be obvious to one skilled in the art that any combination of floating, static, or similar type seats may be utilized by the present invention. As such, the embodiment shown in the Figures is not meant to be limiting in any way.

In the preferred embodiment, static seats 236 and 238 are securely fastened or coupled to de-header valve 200 and are disposed within seat retainers 240 and 242, respectively. Static seats 236 and 238 may or may not be adjustable depending upon design and intended use considerations. In the event one embodiment calls for a live loaded dynamic or floating seat, this seat will preferably be a moveable and adjustable seat that is energized from without the process stream via a live seat adjustment mechanism. The function of the dynamic, live loaded seat is to provide point to point fine tuning of the system, and particularly the valve closure as it is sealed between upper and lower seats 236 and 238. Various sealing members, such as O-rings, may be used to seal the seats and their adjacent seat retainers to de-header valve 200.

In another exemplary embodiment, means for supporting valve closure 220 comprises a support system provided by main body 204, without requiring some type of a seat support system. In this particular embodiment, main body 204 will comprise some type of surface adapted or made to contact valve closure 220 in a similar manner as the seat support system described above, wherein main body 204 will be capable of functioning in a similar manner to provide support of valve closure 220 and to create a continuous contact seal therebetween.

It is important to note that in each of the embodiments discussed above for ball-type de-header valve 200, it is preferable that a continuous contact seal be created between valve closure 220 and means for supporting valve closure 220, just as described and explained above.

Figure 5A:
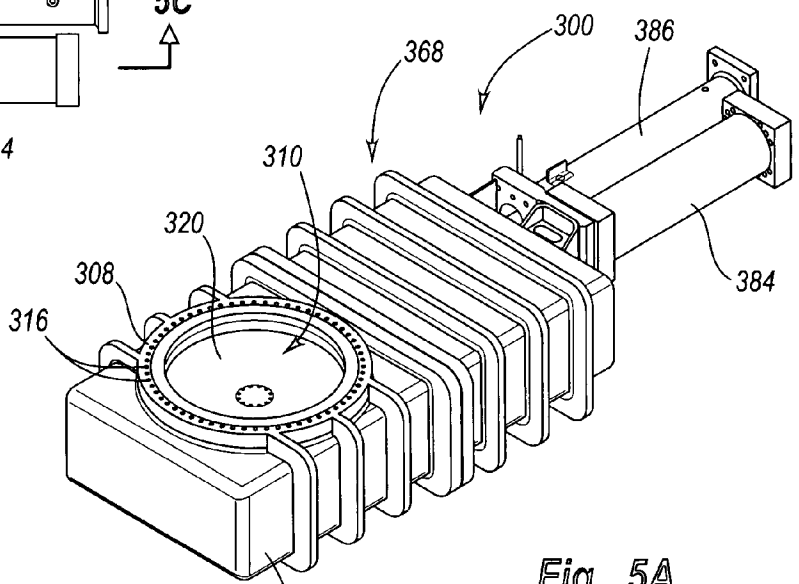
FIG. 5-A illustrates a perspective view of an adjusting wedge gate-type de-header valve according to one exemplary embodiment of the present invention.
Figure 5B:
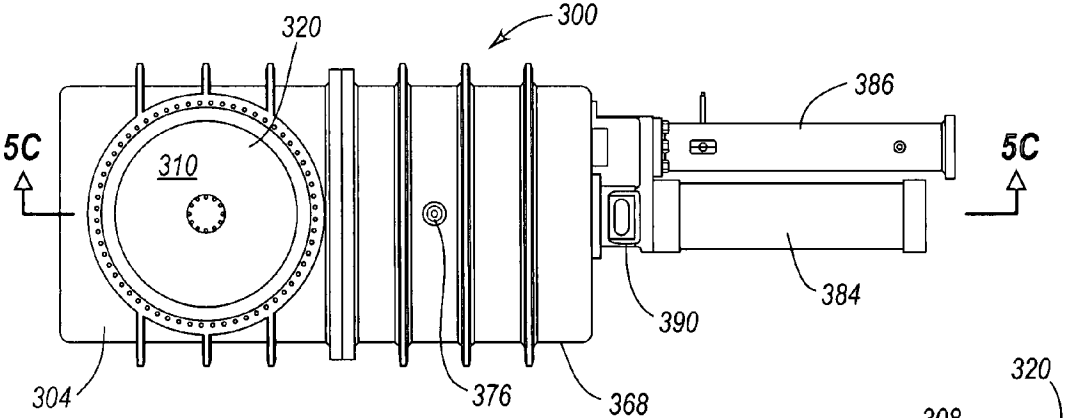
Figure 5C:
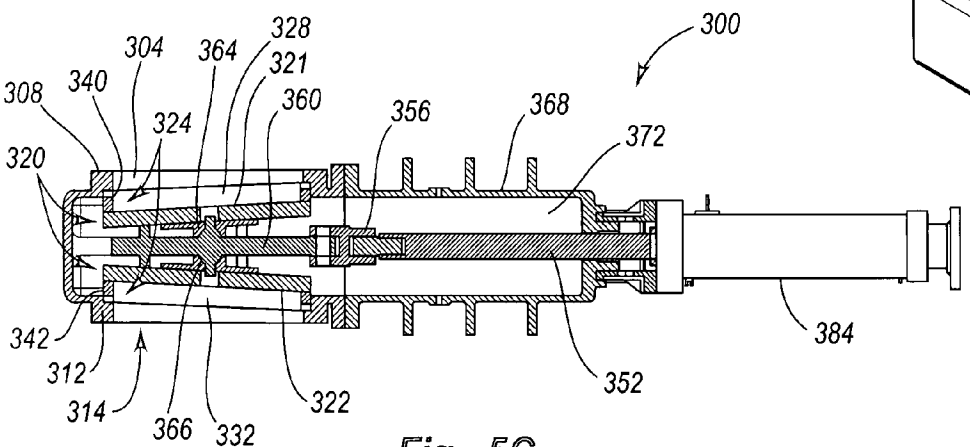

FIGS. 5-A-5-C illustrate various views of an adjusting wedge gate-type de-header valve 300 according to one exemplary embodiment of the present invention. In this embodiment, adjusting wedge gate-type de-header valve 300 comprises a main body 304 connected to a bonnet 368. Main body 304 comprises a first flanged portion 308 having an opening or port 310 that removably couples to a complimentary opening of a coke drum (not shown) via connection means, such as bolt connection 316. Main body 304 further comprises a second flanged portion 312 having an opening or port 314. First and second flanged portions 308 and 312 are aligned with one another and are positioned opposite one another about main body 304 in a complimentary manner.

Adjusting wedge gate-type de-header valve 300 further comprises a valve closure 320 in the form of an adjustable wedge having an upper gate 321 and a lower gate 322 adjustably coupled to adjustors 364 and 368, respectively. Adjustors 364 and 368 are further coupled to carriage 360 and function to provide the means for adjusting both upper and lower gates 321 and 322 as needed during oscillation of valve closure 320. Carriage 360 is further coupled to clevis 356, which is in turn coupled to driveshaft 352. Driveshaft 352 is operably connected to actuator means housed within cylinder 384 and functions to transition valve closure 320 between an open and closed position. Actuator means is preferably a hydraulically controlled power source capable of moving valve closure 320 through its linear, bi-directional cycle during a coking process, and specifically for the purpose of de-heading and re-heading the coke drum. In a closed position, valve closure 320 seals off the opening of the coke drum so that the drum may be filled with the petroleum byproduct used to manufacture coke. Once the drum is full, the valve closure is actuated. The contact seal created between the surface of valve closure 320 and means for supporting the valve closure is such that any accumulated coke on upper gate 321 is sheared off, thus effectively de-heading the coke drum. Continued actuation causes valve closure 330 to relocate to a fully open position. In its fully open position, valve closure 320 is retracted into chamber 372, thus providing a clear flow path for the materials contained within the coke drum.

As shown, adjusting wedge gate-type de-header valve 300 further comprises means for supporting valve closure 320 in the form of a seat support system 324. Seat support system 324 comprises an upper seat 328 supported by an upper seat retainer 340 for providing support to upper gate 321; and lower seat 332 supported by a lower seat retainer 342 for providing support to lower gate 322. In the embodiment shown, upper and lower seats 328 and 332 are both static seats set at a pre-determined slope. As stated, valve closure 320 oscillates between an open and closed position for de-heading and re-heading a coke drum. In an opened position, valve closure 320 is positioned within chamber 372. As valve closure 320 is actuated, and as it approaches a closed position, the contact of upper and lower gate assemblies 321 and 322 with seats 328 and 332, respectively, increases until valve closure 320 is in its fully closed position. At this time, each of adjustors 364 and 368 actuate to cause upper and lower gates 321 and 322 to properly engage upper and lower seats 328 and 332 and to seal against upper and lower seats 328 and 332 as intended. By actuating drive shaft 352, valve closure 320 is forced into the wedge-shaped orientation of seat support system 324. However, too much force may cause or induce an undue amount of force on the portion of upper and lower seats 328 and 332 distal drive shaft 352. As such, adjustors 364 and 368 function to balance out or evenly distribute the force exerted upon upper and lower seats 328 and 332 by upper and lower gates 321 and 322, thus creating a proper and even contact seal therebetween. In turn, as valve closure 320 is again actuated to transition from its closed position to an open or partially opened position, the contact seal created shears or breaks any accumulated coke, thus effectively de-heading the coke drum. This contact seal is continuously maintained throughout each oscillation of valve closure 320 as ensured by adjustors 364 and 368.

Seat support system 324 may comprise other configurations, such as dual dynamic or live loaded seats, a combination of a static and dynamic seat, or a single supporting seat that is either static or dynamic. In the case of a live loaded or dynamic seat, the seat and its resultant force may be adjusted accordingly to provide a proper contact seal, and to maintain this seal throughout the oscillations of valve closure 320. Still, means for supporting valve closure 320 may comprise no seats, but instead some other type of support system, such as segments of the main body 304 itself, modified to support upper and lower gates and to provide a proper contact seal between the two.

Adjusting wedge gate-type de-header valve 300 further comprises steam purge port 376, a lockout assembly 386, and cooling box 390 as additional features, each of which are explained in the incorporated applications identified above.

Figure 6A:
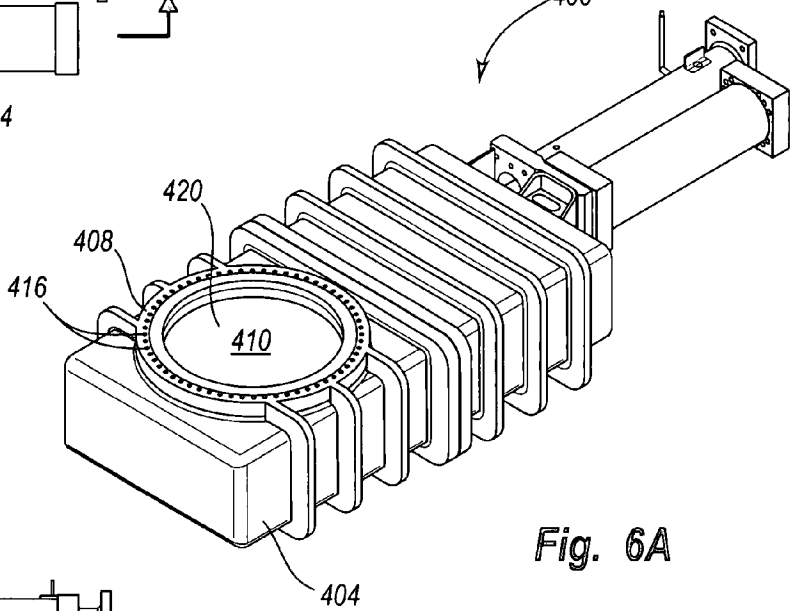
FIG. 6-A illustrates a perspective view of a flexible wedge gate-type de-header valve according to one exemplary embodiment of the present invention.
Figure 6B:
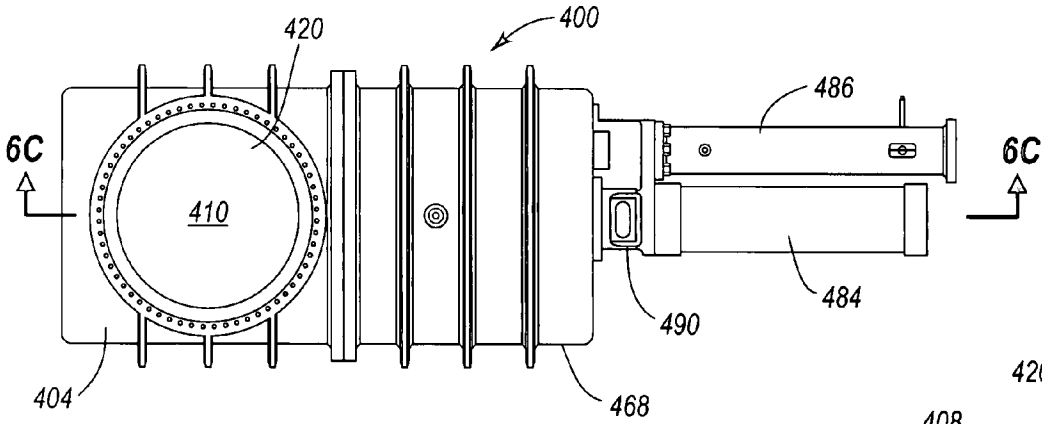
Figure 6C:
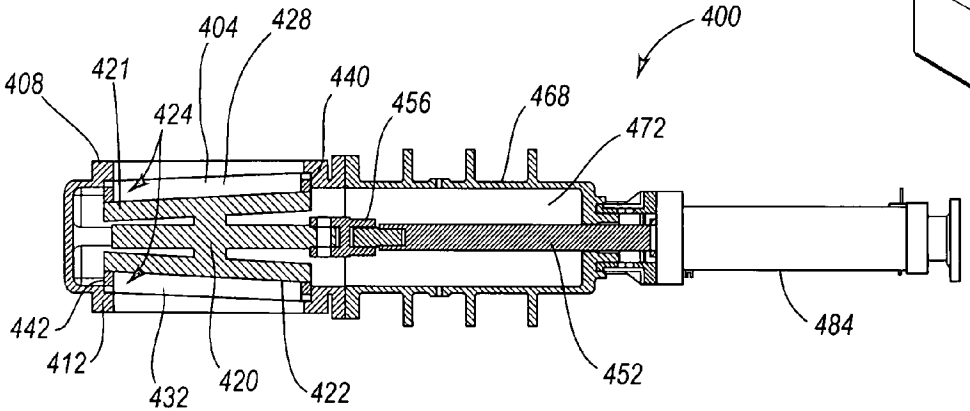

FIGS. 6-A-6-C illustrate various views of a flexible wedge gate-type de-header valve 400, according to one exemplary embodiment of the present invention. In the embodiment shown, flexible wedge gate-type de-header valve 400 comprises a main body 404 connected to a bonnet 468. Main body 404 comprises a first flanged portion 408 having an opening or port 410 that removably couples to a complimentary opening of a coke drum (not shown) via connection means, such as bolt connection 416. Main body 404 further comprises a second flanged portion 412 having an opening or port 414. First and second flanged portions 408 and 412 are aligned with one another and are positioned opposite one another about main body 404 in a complimentary manner.

Flexible wedge gate-type de-header valve 400 further comprises a valve closure 420 in the form of a flexing wedge gate comprising an upper gate 421 and a lower gate 422 that each flex upon contact with and insertion into upper and lower seats 428 and 432 as valve closure 420 transitions from an open or partially open position to a closed position. Valve closure 420 is further coupled to clevis 456, which is turn coupled to drive shaft 452. Drive shaft 452 is further coupled to actuating means that functions to power drive shaft 452 and cause valve closure 420 to oscillate between an open and closed position. Actuator means is preferably a hydraulically controlled power source capable of moving valve closure 420 through its linear, bi-directional cycle during a coking process, and specifically for the purpose of de-heading and re-heading the coke drum. In a closed position, valve closure 420 seals off the opening of the coke drum so that the drum may be filled with the petroleum byproduct used to manufacture coke. Once the drum is full, valve closure 420 is actuated. The contact seal created between the surface of valve closure 420 and means for supporting the valve closure (e.g., seat support system) is such that any accumulated coke on upper gate 421 is sheared off, thus effectively de-heading the coke drum. Continued actuation causes valve closure 430 to relocate to a fully open position. In its fully open position, valve closure 420 is retracted into chamber 472, thus providing a clear flow path for the materials contained within the coke drum.

As shown, flexible wedge gate-type de-header valve 400 further comprises means for supporting valve closure 420 in the form of a seat support system 424. Seat support system 424 comprises an upper seat 428 supported by an upper seat retainer 440 for providing support to upper gate 421; and lower seat 432 supported by a lower seat retainer 442 for providing support to lower gate 422. In the embodiment shown, upper and lower seats 428 and 432 are both static seats set at a pre-determined slope. As stated, valve closure 420 oscillates between an open and closed position for de-heading and re-heading a coke drum. In an opened position, valve closure 420 is positioned within chamber 472. As valve closure 420 is actuated, and as it approaches a closed position, the contact of upper and lower gate assemblies 421 and 422 with seats 428 and 432, respectively, increases until valve closure 420 is in its fully closed position. As it is closing and making more contact with upper and lower seats 428 and 432, upper and lower gates 421 and 422 each flex to conform to the slope each of seats 428 and 432 are positioned. Indeed, seats 428 and 432 may be set at the same slope, or they may comprise different slopes, or one may comprise a slope with the other comprising no relative slope. Nonetheless, each of upper and lower gates 421 and 422 properly engage upper and lower seats 428 and 432 and seal against these as intended. By actuating drive shaft 452, valve closure 420 is forced into the wedge-shaped orientation created by seat support system 324.

Seat support system 424 may comprise other configurations, such as dual dynamic or live loaded seats, a combination of a static and dynamic seat, or a single supporting seat that is either static or dynamic. In the case of a live loaded or dynamic seat, the seat and its resultant force may be adjusted accordingly to provide a proper contact seal, and to maintain this seal throughout the oscillations of valve closure 420. Still, means for supporting valve closure 420 may comprise no seats, but instead some other type of support system, such as segments of the main body 404 itself, modified to support upper and lower gates and to provide a proper contact seal between the two.

Flexible wedge gate-type de-header valve 400 further comprises steam purge port 476, a lockout assembly 486, and cooling box 490 as additional features, each of which are explained in the incorporated applications identified above.

Figure 7A:
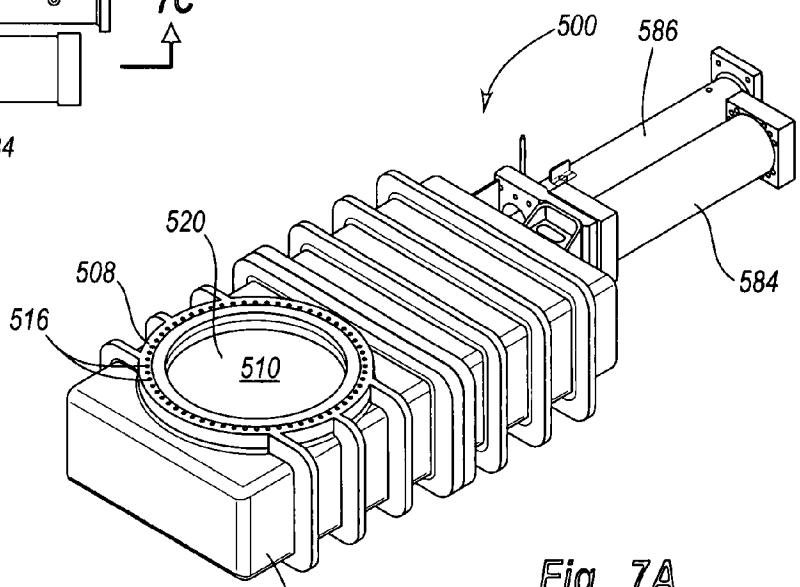
FIG. 7-A illustrates a perspective view of a parallel slide gate-type de-header valve according to one exemplary embodiment of the present invention.
Figure 7B:
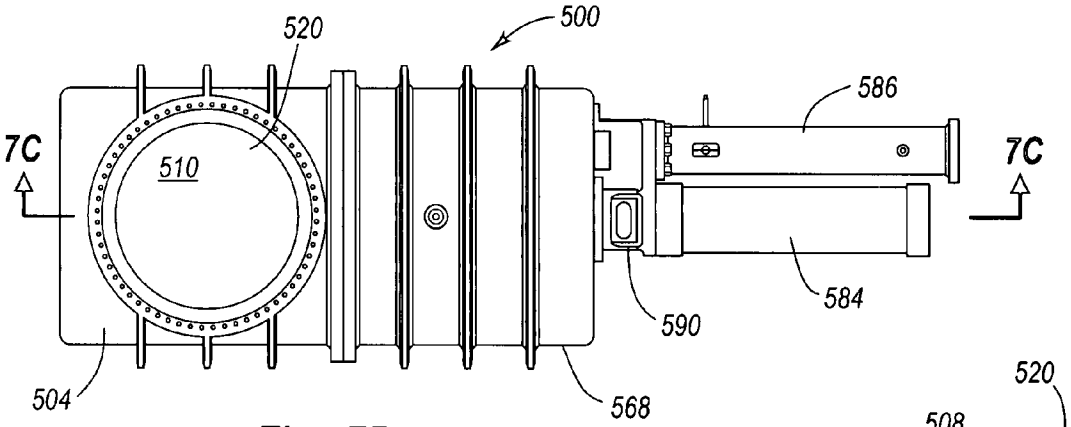
Figure 7C:
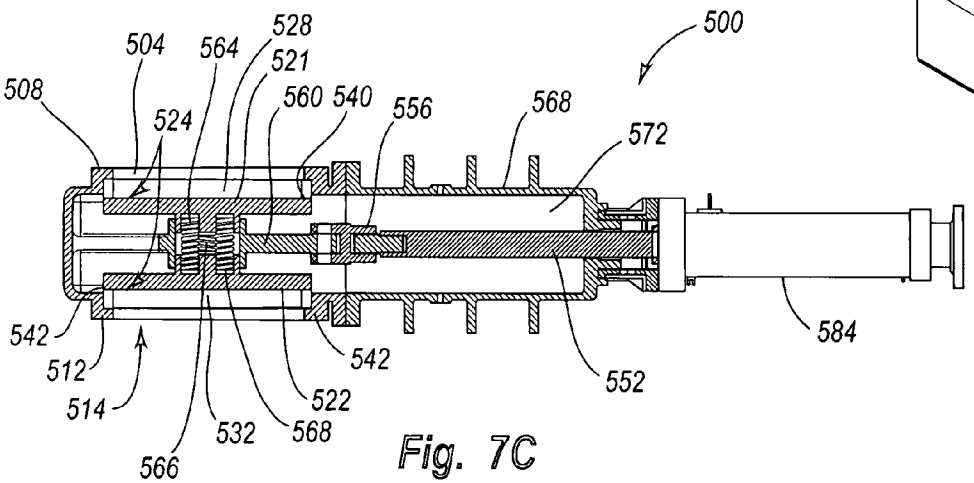

FIGS. 7-A-7-C illustrate various views of a parallel slide gate-type de-header valve 500, according to one exemplary embodiment of the present invention. This parallel slide gate-type de-header valve functions similar to the ones described above. In the embodiment shown, parallel slide gate-type de-header valve 500 comprises a main body 504 connected to a bonnet 568. Main body 504 comprises a first flanged portion 508 having an opening or port 510 that removably couples to a complimentary opening of a coke drum (not shown) via connection means, such as bolt connection 516. Main body 504 further comprises a second flanged portion 512 having an opening or port 514. First and second flanged portions 508 and 512 are aligned with one another and are positioned opposite one another about main body 504 in a complimentary manner.

Parallel slide gate-type de-header valve 500 further comprises a valve closure 520 having an upper gate 521 and a lower gate 522 situated between means for supporting the valve closure, in this case seat support system 524. Upper gate 521 and lower gate 522 are each supported in a biased nature against seat support system 524, thus making valve closure 520 a spring loaded valve closure. Biasing means, namely springs 564, 566, and 568, are provided to cause upper and lower gates 521 and 522 to push against upper and lower seats 528 and 532, respectively, and to create a contact seal therebetween. Internal pressure forces upper and lower gates 521 and 522 against their respective seats to create the contact seal. Biasing means may comprise various pre-determined stiffness characteristics depending upon the intended use for parallel slide gate-type de-header valve 500. Moreover, any number and/or configuration of biasing means may be used as will be apparent to one skilled in the art.

Valve closure 520 is further coupled to carriage 560, which is in turn coupled to clevis 556, which is turn coupled to drive shaft 552. Drive shaft 552 is further coupled to actuating means that functions to power drive shaft 552 and cause valve closure 520 to oscillate between an open and closed position. Actuator means is preferably a hydraulically controlled power source capable of moving valve closure 520 through its linear, bi-directional cycle during a coking process, and specifically for the purpose of de-heading and re-heading the coke drum. In a closed position, valve closure 520 seals off the opening of the coke drum so that the drum may be filled with the petroleum byproduct used to manufacture coke. Once the drum is full, valve closure 520 is actuated. The contact seal created between the surface of valve closure 520 and means for supporting the valve closure (e.g., seat support system) is such that any accumulated coke on upper gate 521 is sheared off, thus effectively de-heading the coke drum. Continued actuation causes valve closure 530 to relocate to a fully open position. In its fully open position, valve closure 520 is retracted into chamber 572, thus providing a clear flow path for the materials contained within the coke drum and for decoking the coke drum.

As in other de-header valves discussed herein, means for supporting valve closure 520 may be any means described above. In the embodiment shown, seat support system 524 functions as the supporting means. Seat support system 524 comprises upper and lower seats 528 and 532, each static and contained within seat retainers 540 and 542. Other embodiments include dual floating or dynamic seats, or a combination of one static and one dynamic seat, or a single seat of a static or dynamic nature, or a configuration requiring no seats.

Parallel slide gate-type de-header valve 500 further comprises steam purge port 576, a lockout assembly 586, and cooling box 590 as additional features, each of which are explained in the incorporated applications identified above.

Figure 8A:
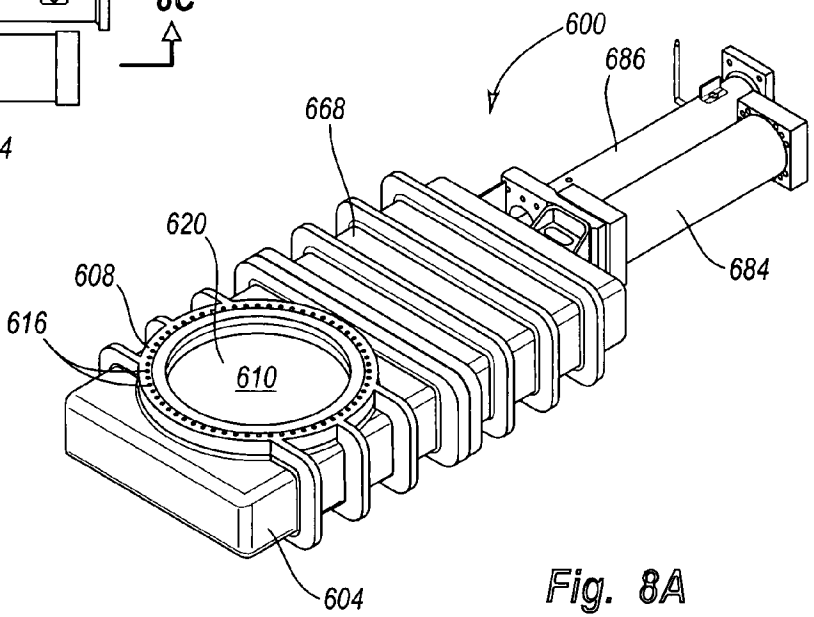
FIG. 8-A illustrates a perspective view of a solid wedge gate-type de-header valve according to one exemplary embodiment of the present invention.
Figure 8B:
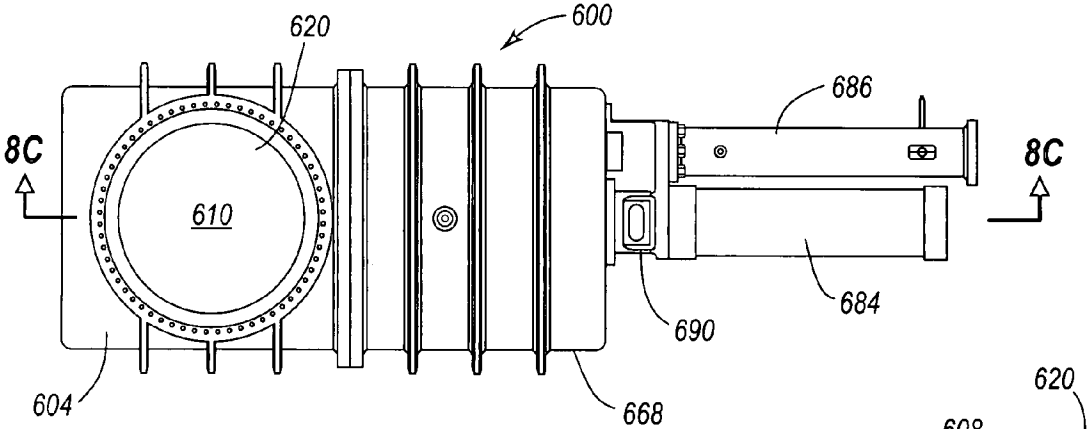
Figure 8C:
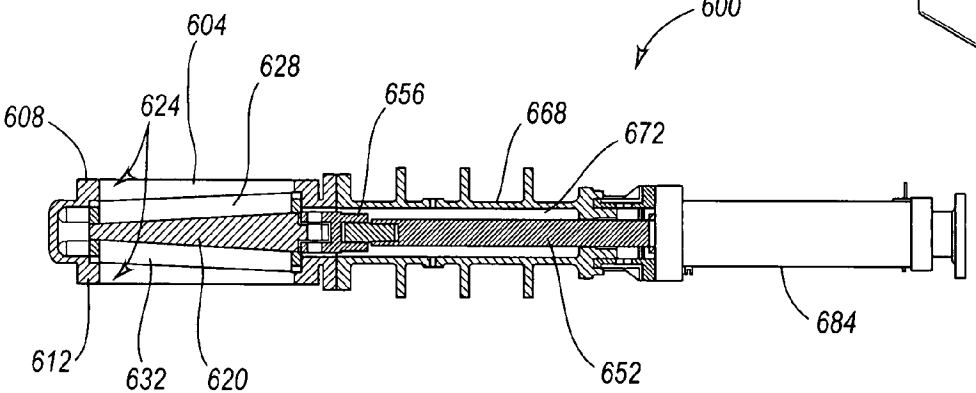

FIGS. 8-A-8-C illustrate various views of a solid wedge gate-type de-header valve 600, according to one exemplary embodiment of the present invention. This de-header valve is also similar in function to the gate-type valves described above. However, solid wedge gate-type de-header valve 600 comprises a single wedge shaped valve closure 620 supported by means for supporting the valve closure, in this case seat support system 624. Solid wedge gate-type de-header valve 600 also comprises a main body 604 connected to a bonnet 668. Main body 604 comprises a first flanged portion 608 having an opening or port 610 that removably couples to a complimentary opening of a coke drum (not shown) via connection means, such as bolt connection 616. Main body 604 further comprises a second flanged portion 612 having an opening or port 614. First and second flanged portions 608 and 612 are aligned with one another and are positioned opposite one another about main body 604 in a complimentary manner.

Valve closure 620, although shown comprising a dual slant wedge shape, may comprise other wedge shapes, such as a single slant wedge shape with a flat top or bottom. Each shape would dictate the orientation of means for supporting the valve closure. In the exemplary embodiment shown, valve closure 620 comprises a dual slant wedge shape. Upper and lower seats 628 and 632 function to support valve closure 620, and are set at a slope similar to the ones existing on valve closure 620. Upper and lower seats are preferably live loaded floating or dynamic seats having a pre-determined bias so as to be able to automatically adjust and optimize the contact seal created between the surfaces of valve closure 620 and each of upper and lower seats 628 and 632, respectively. The contact between upper and lower seats 628 and 632 provides a contact seal, preferably a metal to metal contact seal, during the coke manufacturing process.

Valve closure 620 is further coupled to clevis 656, which is turn coupled to drive shaft 652. Drive shaft 652 is further coupled to actuating means that functions to power drive shaft 652 and cause valve closure 620 to oscillate between an open and closed position. Actuator means is preferably a hydraulically controlled power source capable of moving valve closure 620 through its linear, bi-directional cycle during a coking process, and specifically for the purpose of de-heading and re-heading the coke drum. In a closed position, valve closure 620 seals off the opening of the coke drum so that the drum may be filled with the petroleum byproduct used to manufacture coke. Once the drum is full, valve closure 620 is actuated. The contact seal created between the surface of valve closure 620 and means for supporting the valve closure (e.g., seat support system) is such that any accumulated coke on upper gate 621 is sheared off, thus effectively de-heading the coke drum. Continued actuation causes valve closure 630 to relocate to a fully open position. In its fully open position, valve closure 620 is retracted into chamber 672, thus providing a clear flow path for the materials contained within the coke drum.

Solid wedge gate-type de-header valve 600 further comprises steam purge port 676, a lockout assembly 686, and cooling box 690 as additional features, each of which are explained in the incorporated applications identified above.

Figure 9A:
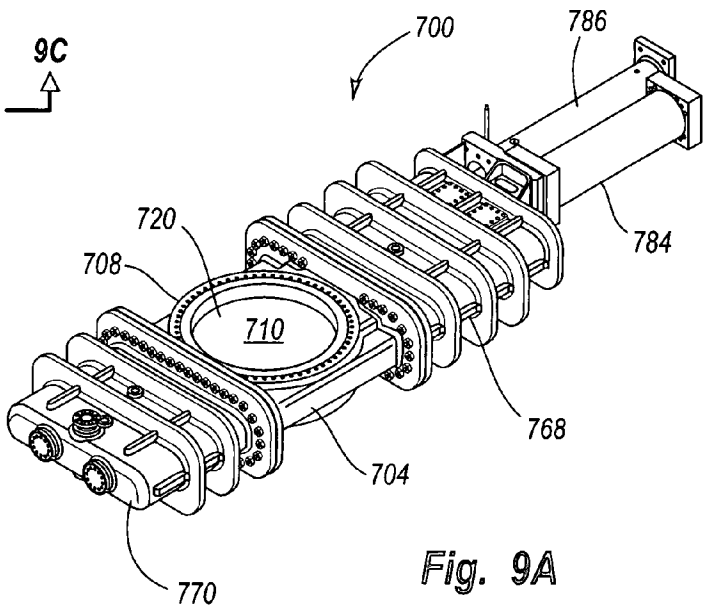
FIG. 9-A illustrates a perspective view of a sliding blind gate-type de-header valve according to one exemplary embodiment of the present invention.
Figure 9B:
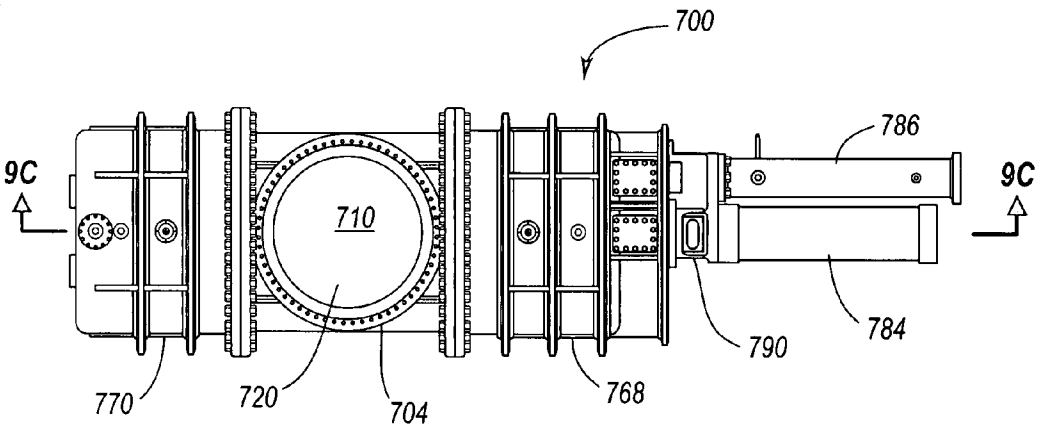
Figure 9C:
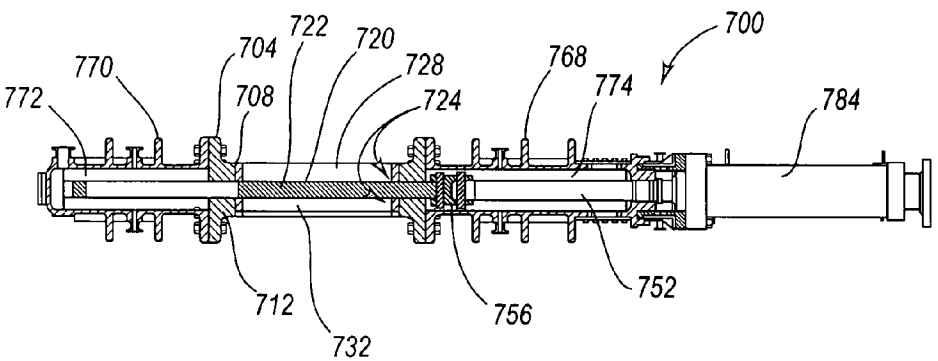

FIGS. 9-A-9-C illustrate various views of a sliding blind gate-type de-header valve 700, according to one exemplary embodiment of the present invention. Sliding blind gate-type de-header valve 700 comprises a main body 704 removably coupled to upper and lower bonnets 768 and 770, each comprising upper and lower chambers 772 and 774, respectively. Main body 704 comprises a first flange portion 708 having an opening or port 710 therein, and a second flange portion 712 having an opening or port 714 therein. Main body 704 removably couples to a complimentary flange portion and associated opening or port of a coke drum, such that each opening is concentric and/or aligned with one another.

Sliding blind gate-type de-header valve 700 further comprises a valve closure in the form of a sliding blind or gate 720 having an aperture therein that is capable of aligning with openings 710 and 714 in an open position. Valve closure 720 slides back and forth in a linear, bi-directional manner between means for supporting a valve closure, shown in this exemplary embodiment as seat support system 724. Seat support system 724 may comprise any type of seating arrangement, including dual, independent seats, wherein the seats are both static, both floating or dynamic, or a combination of these. Seat support system 724 may alternatively comprise a single seat in support of valve closure 720, wherein the seat may comprise a static or floating or dynamic seat. In another exemplary embodiment, means for supporting a valve closure may dispense with a seating system in favor of a support system built into main body 704, such that one or more portions or components of main body 704 are selected and prepared to support valve closure 720. In any event, means for supporting a valve closure preferably comprises a metal contact surface that contacts and seals with a metal surface on valve closure 720, wherein this contact seal is maintained during the coke manufacturing process.

Valve closure 720 is coupled to clevis 756, which is turn coupled to drive shaft 752. Drive shaft 752 is further coupled to actuating means that functions to power drive shaft 752 and cause valve closure 720 to oscillate between an open and closed position. Actuator means is preferably a hydraulically controlled power source contained within cylinder 784 and that is capable of moving valve closure 720 through its linear, bi-directional cycle during a coking process, and specifically for the purpose of de-heading and re-heading the coke drum. In a closed position, valve closure 720 seals off the opening of the coke drum so that the drum may be filled with the petroleum byproduct used to manufacture coke. Portions of gate 722 extend into upper chamber 772 in the closed position to allow the solid part of gate 722 to cover and close off the opening in the de-header valve and the coke drum. Once the drum is full, valve closure 720 is actuated. The contact seal created between the surface of valve closure 720 and means for supporting the valve closure (e.g., seat support system) is such that any accumulated coke on gate 722 is sheared off, thus effectively de-heading the coke drum. Continued actuation causes valve closure 730 to relocate to a fully open position. In its fully open position, valve closure 720 is retracted into chamber 772, thus providing a clear flow path for the materials contained within the coke drum.

Sliding blind gate-type de-header valve 700 further comprises steam purge port 776, a lockout assembly 786, and cooling box 790 as additional features, each of which are explained in the incorporated applications identified above.

Figure 10:
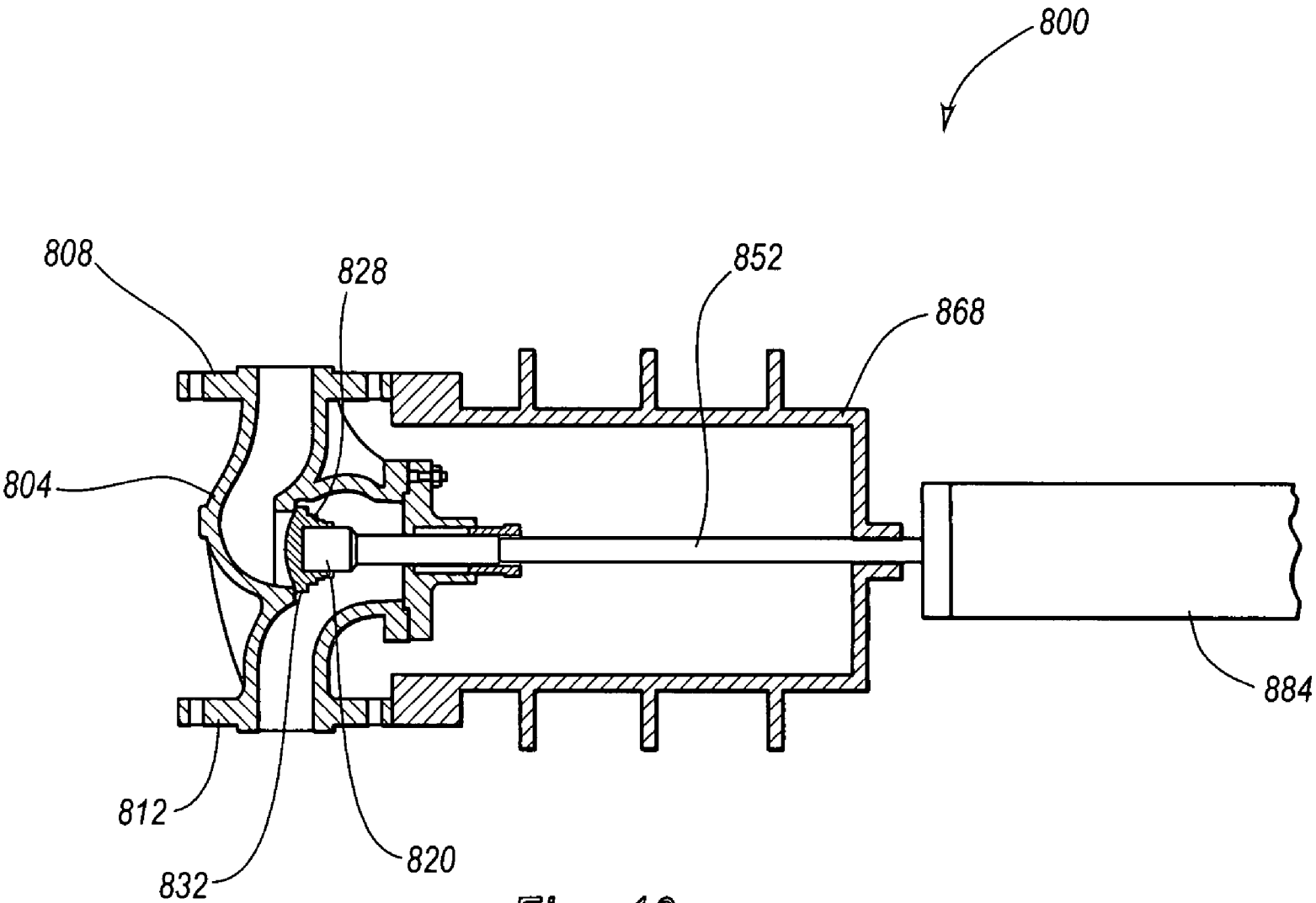
FIG. 10 illustrates a globe-type de-header valve according to one exemplary embodiment of the present invention.

FIG. 10 illustrates an exemplary globe-type de-header valve 800, according to an exemplary embodiment of the present invention. The globe-type de-header valve 800 is a linear motion valve with rounded main body 804 that removably couples to a coke drum (not shown). Main body further comprises a first flanged portion 808 having an opening 810 therein; and a second flanged portion 812, also having an opening 814 therein. Openings 810 and 814 align with a complimentary opening or port on a coke drum.

Globe-type de-header valve further comprises a valve closure in the form of a disk 820, which functions to, among other things, regulate flow through globe-type de-header valve 800. Disk 820 is coupled to drive shaft 852, which is further coupled to actuating means that functions to power drive shaft 852 and cause disk 820 to oscillate between an open and closed position. Actuator means is preferably a hydraulically controlled power source capable of moving disk 820 through its linear, bi-directional cycle during a coking process, and specifically for the purpose of de-heading and re-heading the coke drum. In a closed position, disk 820 seals off the opening of the coke drum so that the drum may be filled with the petroleum byproduct used to manufacture coke. Once the drum is full, disk 820 is actuated. The contact seal created between the surface of disk 820 and means for supporting the valve closure (e.g., seat support system) is such that any accumulated coke on the surface of disk 820 is sheared off, thus effectively de-heading the coke drum. Continued actuation causes disk 820 to relocate to a fully open position. In its fully open position, disk 820 is retracted into chamber 872, thus providing a clear flow path for the materials contained within the coke drum.

As shown, globe-type de-header valve 800 further comprises means for supporting the disk in the form of a seat support system 824. Seat support system 824 comprises an upper seat 828 supported by an upper seat retainer 840 for providing support to an upper surface 821 of disk 820; and lower seat 832 supported by a lower seat retainer 842 for providing support to a lower surface 822 of disk 820. In the embodiment shown, upper and lower seats 828 and 832 are both static seats. As stated, valve closure 820 oscillates between an open and closed position for de-heading and re-heading a coke drum.

Figure 11:
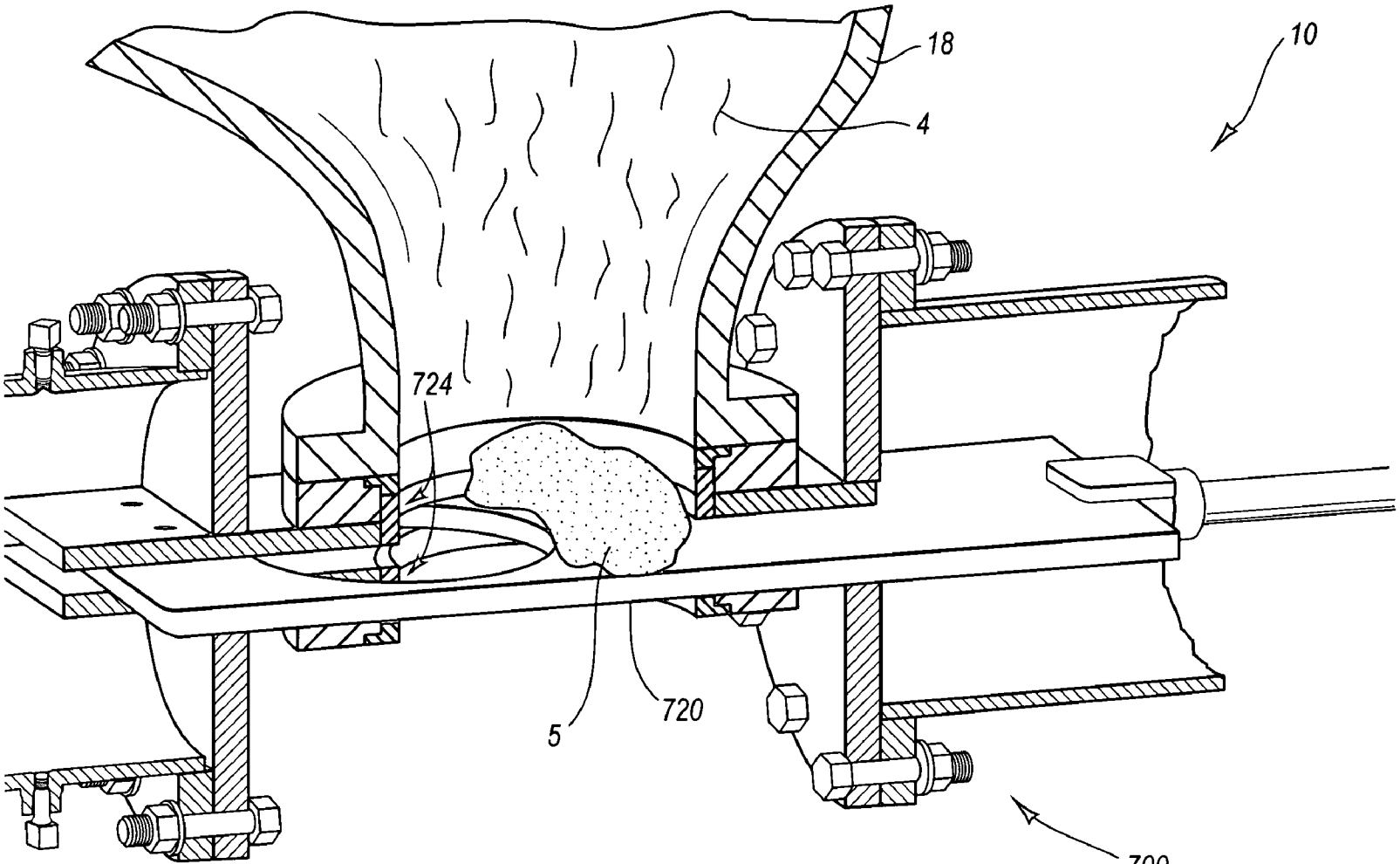
FIG. 11 illustrates a de-header valve in operation as attached to a coke drum.
Figures 12A, 12B, 12C:
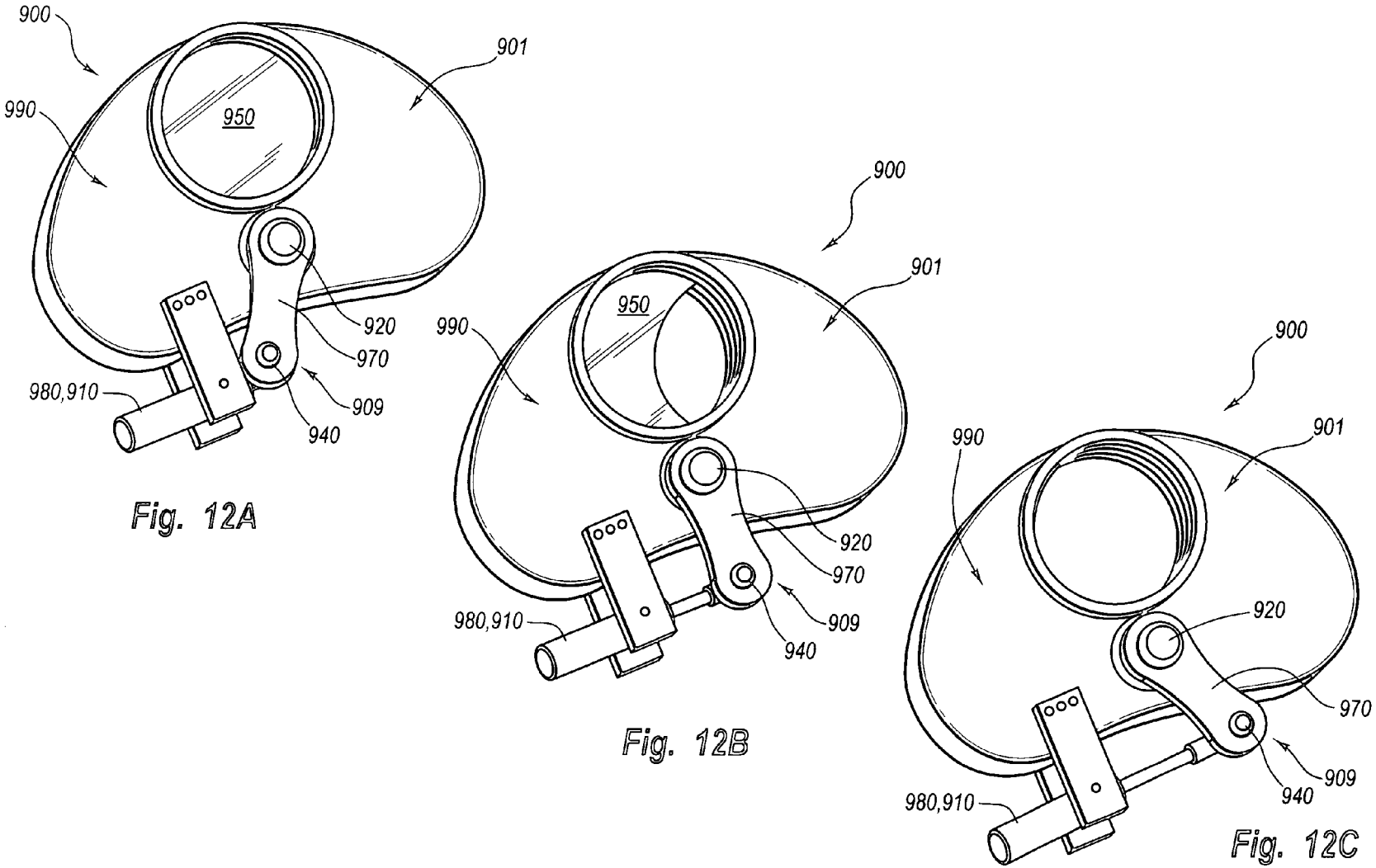
FIG. 12-A illustrates a top view of an embodiment of a goggle valve, claimed in the invention, in a closed position.
Figure 12D:
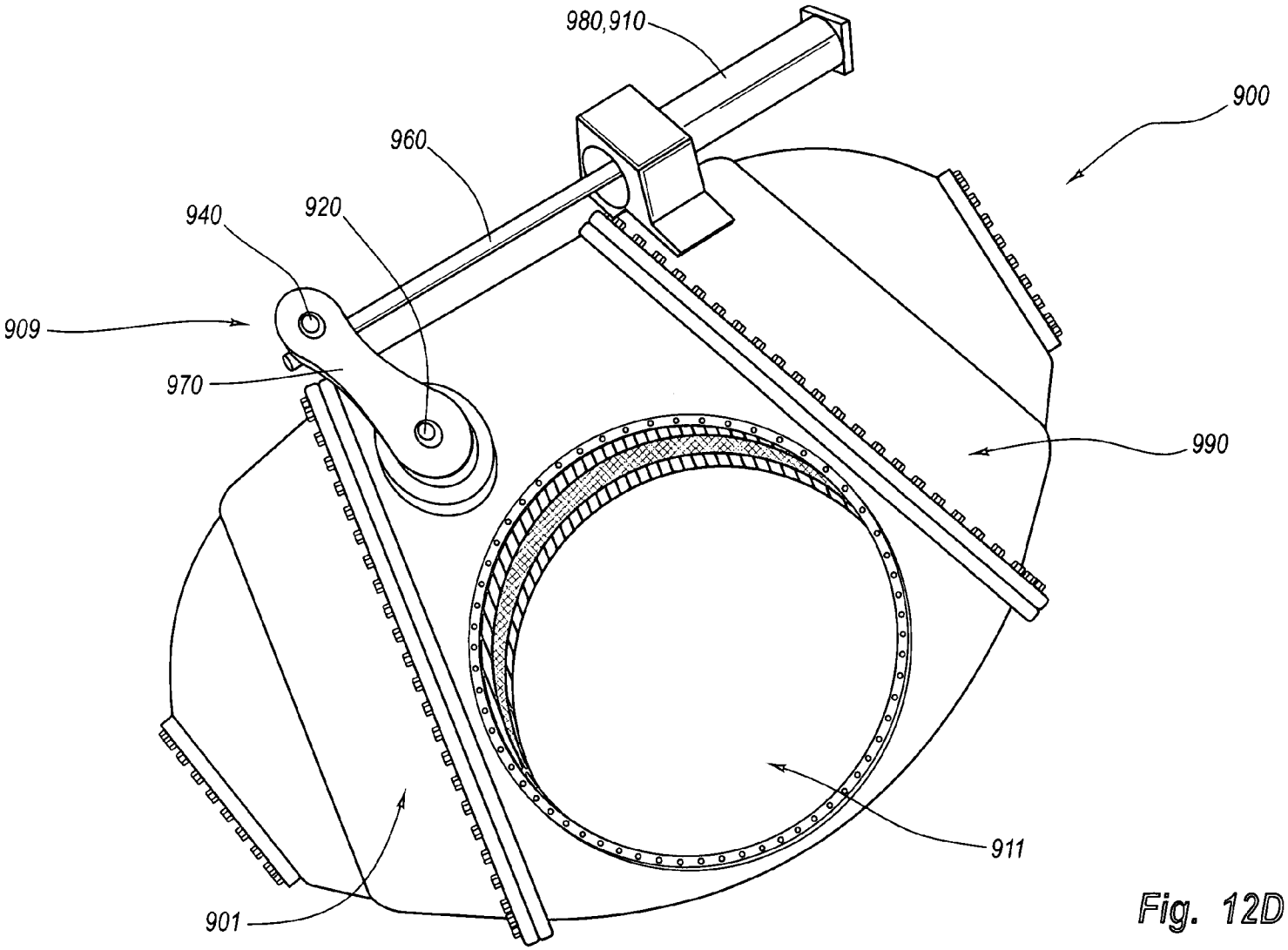
Figure 13:
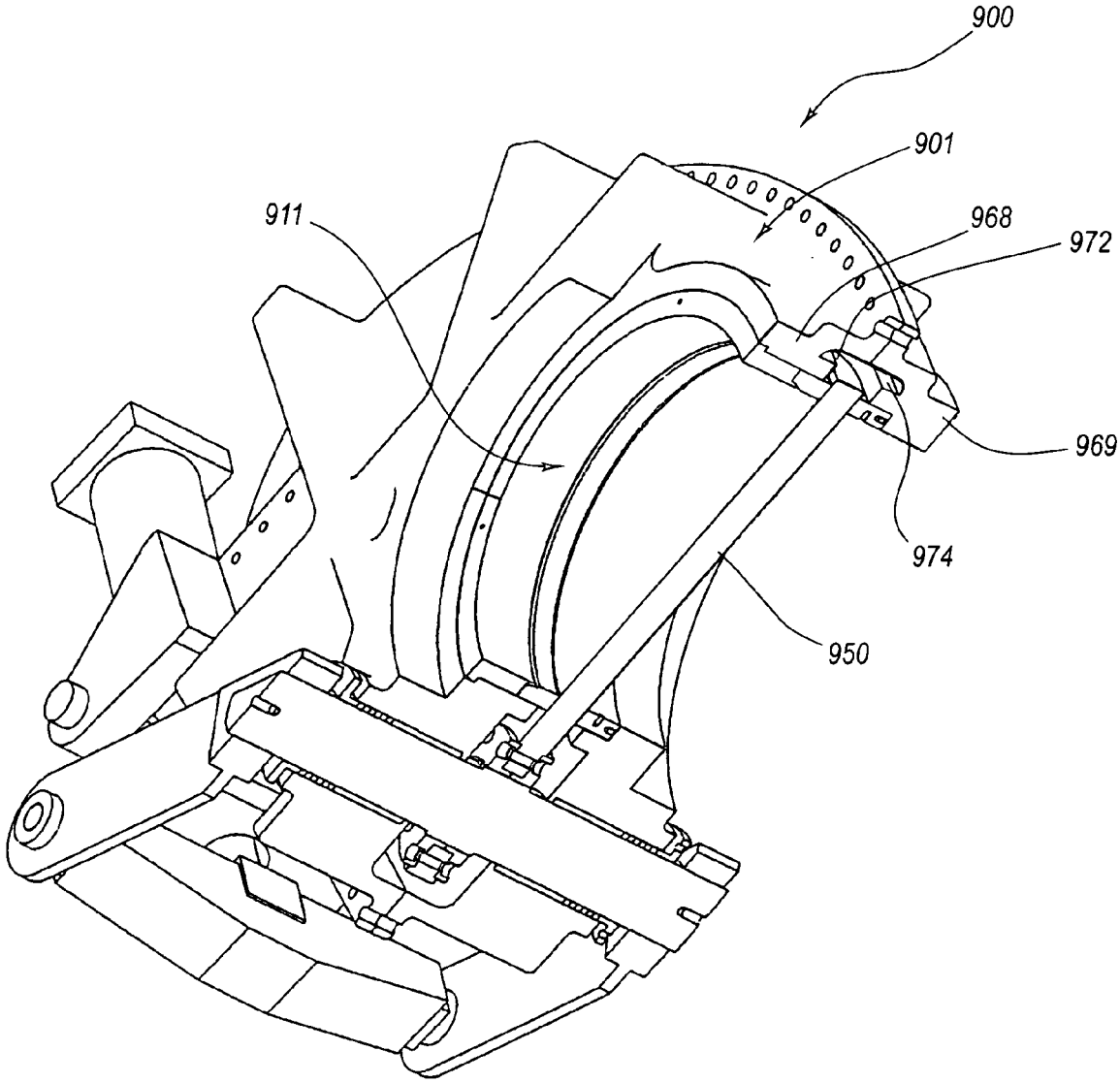
FIG. 13 illustrates a cut away view of an embodiment of the goggle valve claimed in the present invention.

FIG. 11 illustrates an exemplary operating arrangement in which one of the above-described de-header valves is in use in a delayed coking process. Specifically, FIG. 11 illustrates a coke drum de-heading system 10 showing sliding blind gate-type valve 700 in operation as removably coupled to coke drum 18. FIG. 11 depicts sliding blind gate-type valve 700 with valve closure 720 in a partially open position, thus in the process of de-heading coke drum 18. As can be seen, an accumulated coke head 5 exists at the surface of valve closure 720, wherein it has been sheared by the contact seal existing between valve closure 720 and seat support system 724. By shearing coke head 5, coke drum 18 is essentially de-headed and prepared for the decoking process in which the coke 4 within coke drum 18 is purged down through the openings in de-header valve 700 and into a container. Although a sliding blind gate-type de-header valve is depicted in FIG. 11, it is emphasized that any of the various types of de-header valves discussed above and illustrated in the Figures herein may be utilized within the coke manufacturing process and to perform the de-heading function of coke drum.

It will be obvious to one skilled in the art that any combination of floating, static, or similar type seats may be utilized by the various de-header valves of the present invention. As such, the embodiment shown in each of the Figures herein is not meant to be limiting in any way.

In one embodiment of the invention it is preferable that a continuous contact seal be created between valve closure 720 and means for supporting valve closure 724, meaning that during the coke manufacturing process, as well as the back and forth rotation of valve closure 720 from an open position, to a semi-opened position, and finally to a closed position, with respect to the opening or port of a coke drum, the created contact seal is never broken or breached, but its integrity is maintained at all times. This continuous contact seal is preferably a metal to metal contact seal that performs several functions and has several advantages. First, the contact seal creates, or at least contributes to, valve isolation, wherein an isolated environment is provided, such that no material is allowed to escape outside the sealed area and into the main body or other parts of the de-header valve, the area outside the de-header valve (e.g., the unheading deck), or other areas. Various steam purge systems, condensate management systems, and coke containment systems (not shown) also function to regulate pressure within the de-header valve, to contain the material within designated areas, and to maintain valve isolation. Second, the continuous contact seal helps to keep various components of the de-header valve clean and free of the product material as these materials are not allowed beyond the sealed area. Third, as a result of the load exerted upon valve closure 720 and resulting tight tolerances existing between valve closure 720 and upper and lower seats and the rotation of valve closure between upper and lower seats 724 causes a grinding and polishing effect to occur.

In a preferred embodiment, upper and lower seats 724, as well as valve closure 720 are made of metal, thus providing a metal to metal contact or metal to metal seal, or otherwise referred to as metal to metal seating of valve closure 720. This metal to metal seating is a unique aspect of the present invention in relation to coke drum de-heading. The metal to metal seating increases the durability of the system as there are no non-metal parts, such as vinyl or rubber, used to seal the seats to valve closure 720. Metal to metal seating allows the system to achieve a higher consistency of sealing, while at the same time providing extended wear and durability. In addition, the metal to metal sealing allows the system, and specifically the sealing within the system, to be fine-tuned as needed.

Fourth, as the valve closure 720 is actuated and rotated from a closed position to an open position, the contact seal existing between the surface of valve closure 720 and the surface of means for supporting a valve closure functions to break up or shear the manufactured coke that has accumulated on or near the surface of valve closure 720, thus effectively de-heading the coke drum and facilitating the decoking process. Other functions and advantages may be realized by one skilled in the art.

FIGS. 12-16 illustrate embodiments of a goggle gate valve 900. One embodiment of a goggle gate-type de-header valve 900 comprises a main body 901 removably coupled to upper and lower bonnets 968 and 969, each comprising upper and lower chambers 972 and 974, respectively. The main body 901 is comprised of an opening or port 911 therein. Main body 901 removably couples to a complimentary flange portion and associated opening or port of a coke drum, such that each opening is concentric and/or aligned with one another.

One embodiment of a sliding blind goggle gate-type de-header valve 900 further comprises a valve closure in the form of a sliding blind or gate 950. The sliding blind/gate 950 rotates back and forth between means for supporting a sliding blind/gate shown in this exemplary embodiment as seat support system 904. Seat support system 904 may comprise any type of seating arrangement, including dual, independent seats, wherein the seats are both static, both floating or dynamic, or a combination of these. Seat support system 904 may alternatively comprise a single seat in support of valve closure 950, wherein the seat may comprise a static or floating or dynamic seat. In another exemplary embodiment, means for supporting a valve closure may dispense with a seating system in favor of a support system built into main body 901, such that one or more portions or components of main body 901 are selected and prepared to support gate/blind 950. In any event, means for supporting a valve closure preferably comprises a metal contact surface that contacts and seals with a metal surface on gate 950, wherein this contact seal is maintained during the coke manufacturing process.

In an embodiment of the present invention, illustrated in FIGS. 12A-D, a gate 950 is coupled to a point 920, which is turn coupled to drive shaft 909. In a preferred embodiment of the drive shaft 909 the drive shaft 909 is comprised of two arms, a second arm 970 which is fixedly or hingedly attached to the valve closure 950 at a point 920, and a first arm 960 which connects to said second arm 970 at a fixed or hinged point 940. Thus, in a preferred embodiment of the present invention the drive shaft 909 is comprised of a first arm 960, a second arm 970, a first attachment point 920, which is connected to the valve closure/blind 950, and a second attachment point 940, which connects said first 960 and second 970 arms. Drive shaft 909 is further coupled to actuating means 980 that functions to actuate the drive shaft 909 and cause valve closure/blind 950 to oscillate between an open and closed position. The combination of the drive shaft 909 and the actuating means 980, in a preferred embodiment of the invention, is a hydraulic activation device 910. FIGS. 12A-D depict embodiments of the invention comprising a goggle gate/valve, wherein the gate is attached to a drive shaft 909, which is actuated by a hydraulic arm or piston 910.

FIGS. 12A-D illustrate one embodiment of the invention, wherein the actuator means 980 is preferably a hydraulically controlled power source contained within cylinder 910, which is capable of moving valve closure 950 between opened and closed positions during a decoking process, and specifically for the purpose of de-heading and re-heading the coke drum. In other embodiments of the invention the actuator means 980 may be an electric motor or a manually operated lever or other drive device.

In a closed position (see FIG. 12-A), valve closure 950 seals off the opening of the coke drum so that the drum may be filled with the petroleum byproduct used to manufacture coke. Portions of gate 950 extend into upper chamber 972 in the closed position to allow the gate 950 to cover and close off the opening in the de-header valve and the coke drum. Once the drum is full, the valve closure 950 may be actuated. The contact seal created between the surface of valve closure 950 and means for supporting the valve closure (e.g., seat support system) is such that any accumulated coke on gate 950 is sheared off, thus effectively de-heading the coke drum. Continued actuation causes valve closure 950 to relocate to a fully open position (see FIG. 12-C). In its fully open position, valve closure 950 is retracted into chamber 990, thus providing a clear flow path for the materials contained within the coke drum.

In some embodiments of the invention the sliding blind goggle gate-type de-header valve 900 further comprises steam purge port, a lockout assembly, and cooling box as additional features.

The preferred embodiment of the sliding blind goggle gate type de-header valve 900 is a simplified design which is rugged and dependably built, easy to operate and economical to maintain. When in a closed position (see FIG. 9-A) a definite separation on each side of the goggle plate 950, to prevent leakage of gaseous, liquid or solid materials from one side of the goggle plate/gate to the other is maintained. The present invention contemplates the production of various sized apertures 911 to accommodate various needs and specific variances found from one coke drum to another. The present invention contemplates a valve system capable of maintaining a tight seal under hostile operating conditions including high pressure and high temperature. The present invention contemplates a valve which can easily be operated by one man either remotely or by manually actuating a lever which actuates the hydraulic actuation device.

In a preferred embodiment the actuation device that drives the goggle valve/gate 950 between the open and close position is a hydraulic piston 910. However, it is contemplated by the present invention that other means of actuating or moving the gate between open and close positions may be used. For example, in one embodiment of the present invention a motor (not illustrated) is mounted to the goggle plate/gate 950. The motor and the gate 950 may be interlocked through switches so that when the open push button is depressed the clamping drive motor unclamps the valve and the goggle plate drive motor moves the goggle plate/gate 950 to an open position (see FIG. 12-C). The clamping drive motor could then reclamp the valve. In this embodiment of the present invention when the closed push button is depressed the valve unclamps, the goggle plate/gate 950 moves to the closed position (see FIG. 12-A) and the valve is again reclamped.

The present application also contemplates the use of a sliding blind goggle gate type deheader valve 900, wherein the valve closure is in the form of a sliding blind or gate 950 having an aperture therein that is capable of aligning with the opening 911 when the sliding blind gate is in an open position. Valve closure 950 rotates back and forth between means for supporting a valve closure, shown in this embodiment as a seat support system 904.

As previously indicated the valve closure 950 is coupled to an actuation means. In preferred embodiments of this invention the actuation means is comprised of a hydraulic actuation device 910, a drive motor, or a manually operated actuation means. When the preferred actuation means is engaged the valve closure 950 moves from a closed to an open position.

Figure 14C:
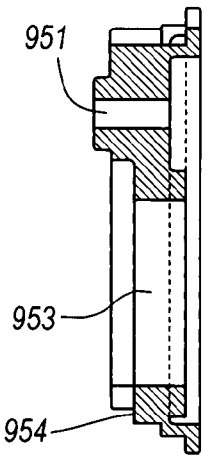
FIG. 14 illustrates an embodiment of a goggle blind.
Figure 14B:
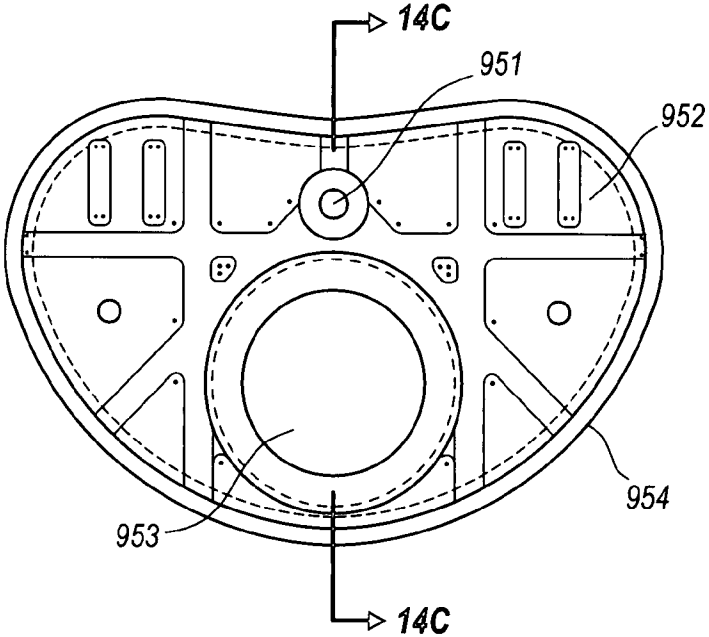
Figure 14A:
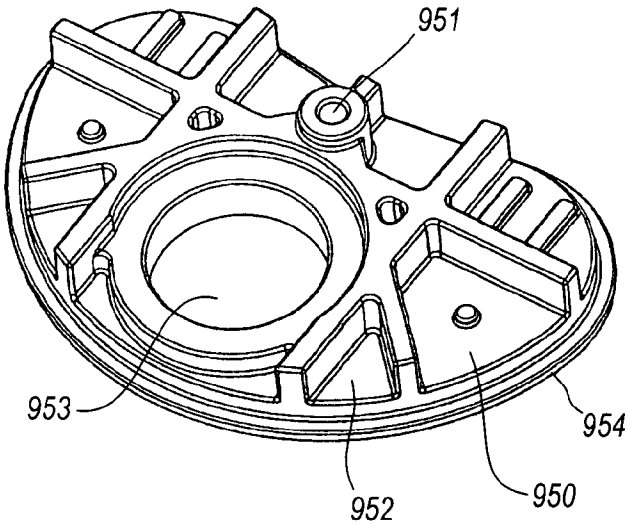
Figure 15B:
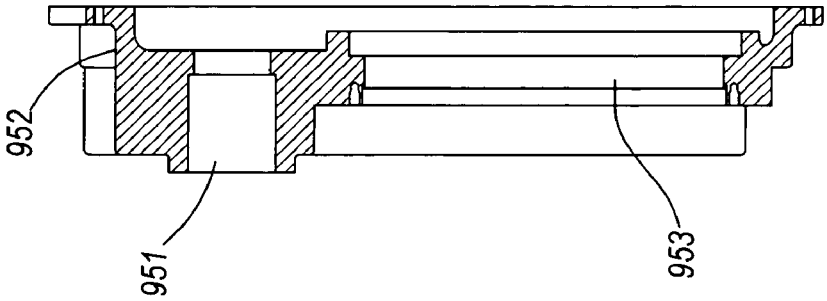
FIG. 15 illustrates an embodiment of a goggle blind.
Figure 15A:
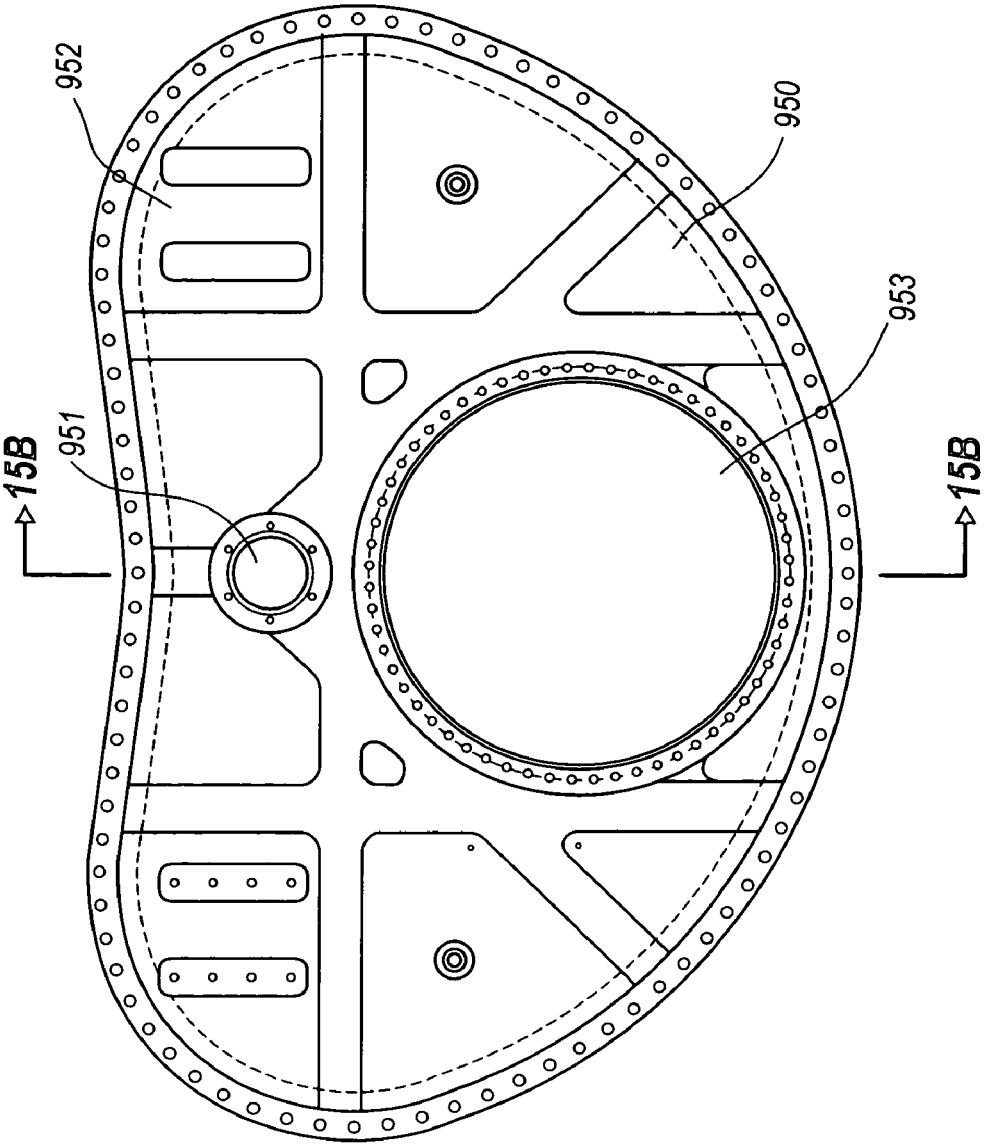
Figure 16B:
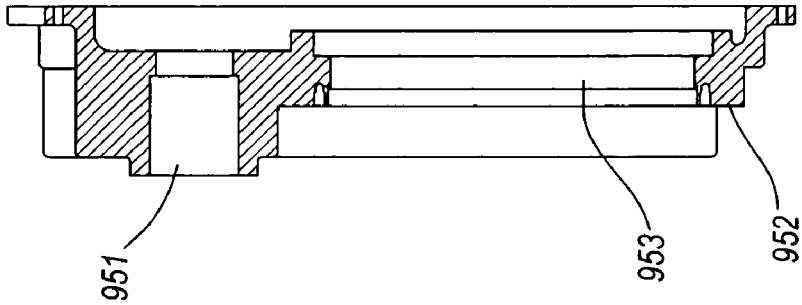
FIG. 16 illustrates an embodiment of a goggle blind.
Figure 16A:
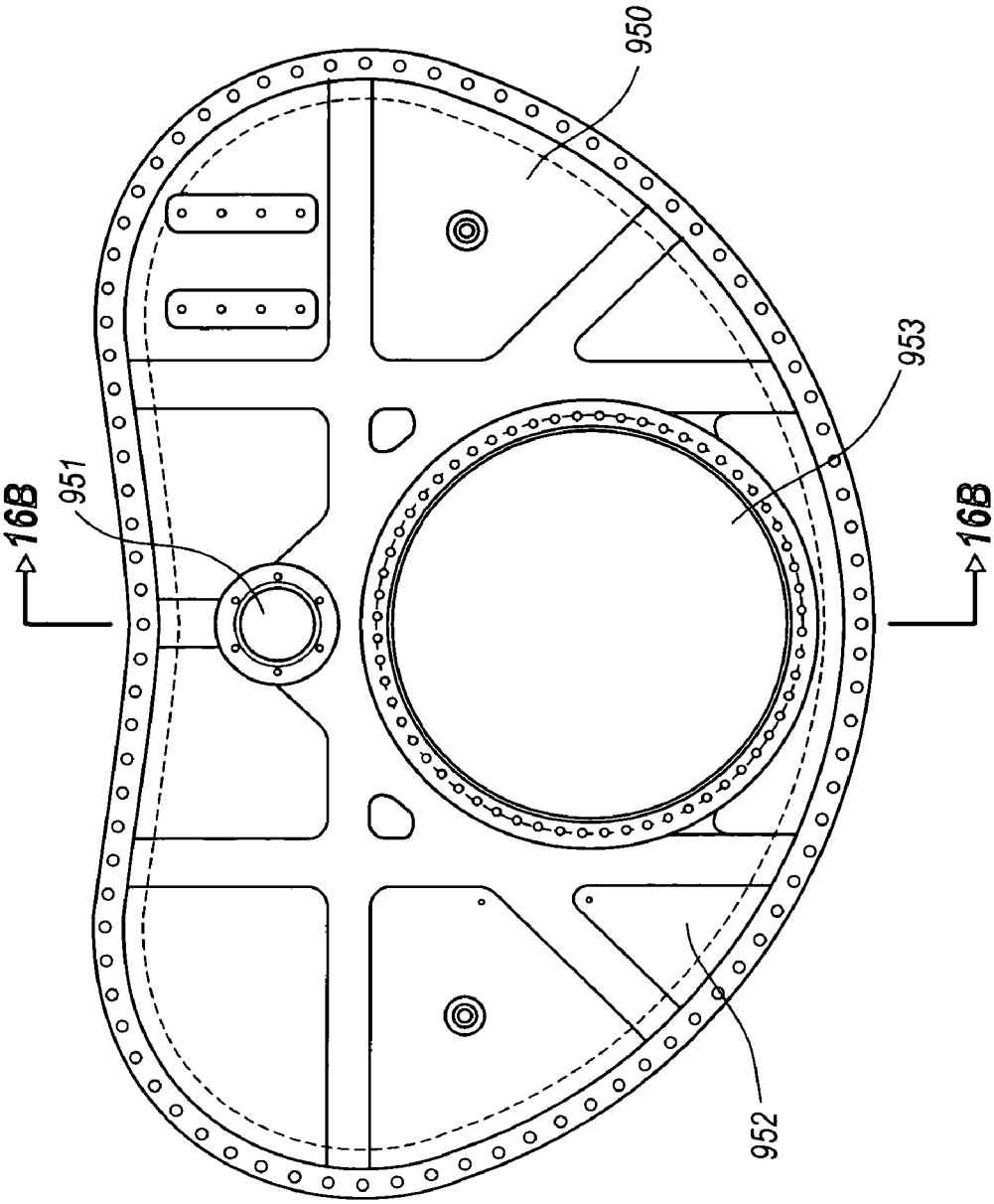
Figure 17C:
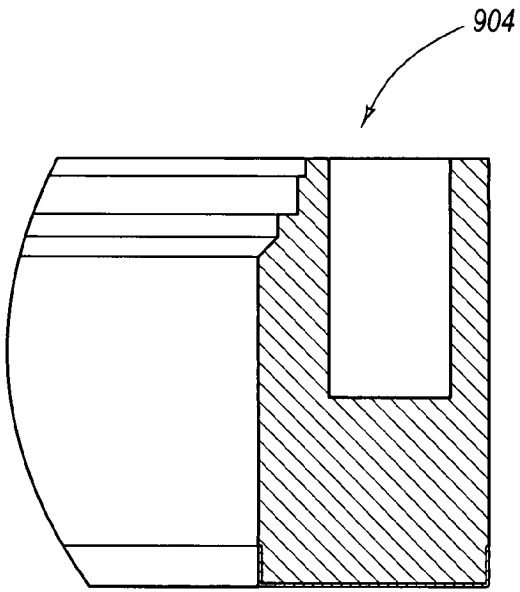
FIG. 17 illustrates an embodiment of a dynamic seat.
Figure 17A:
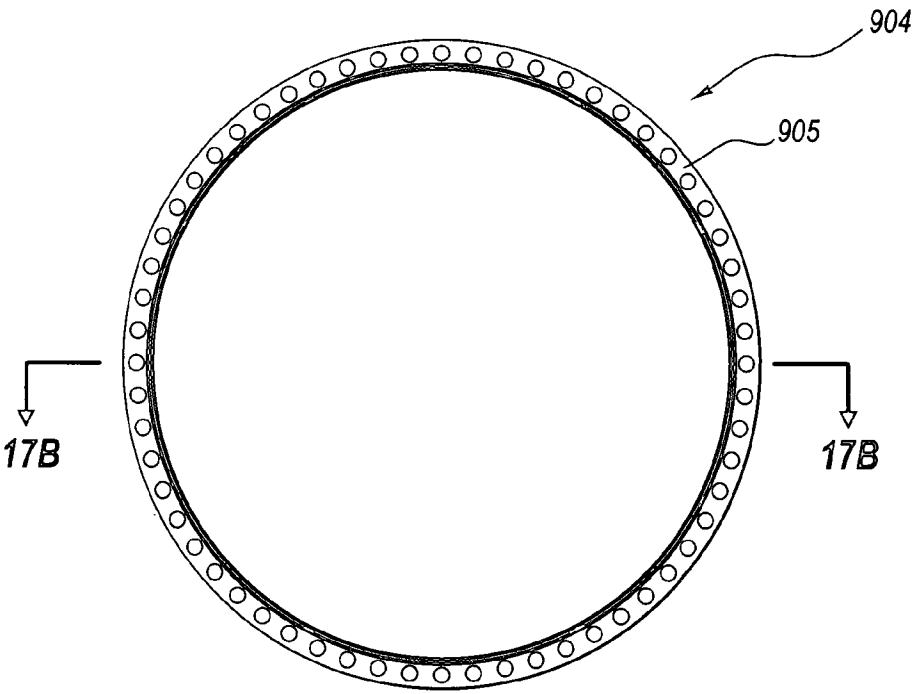
Figure 17B:
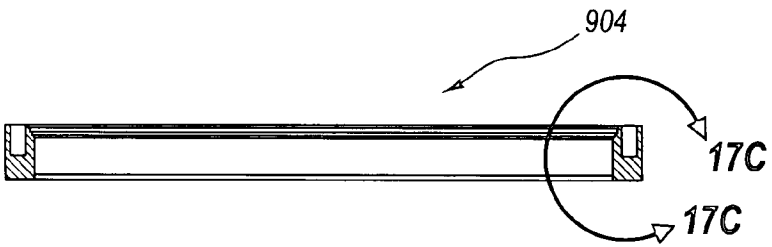
Figure 19A:
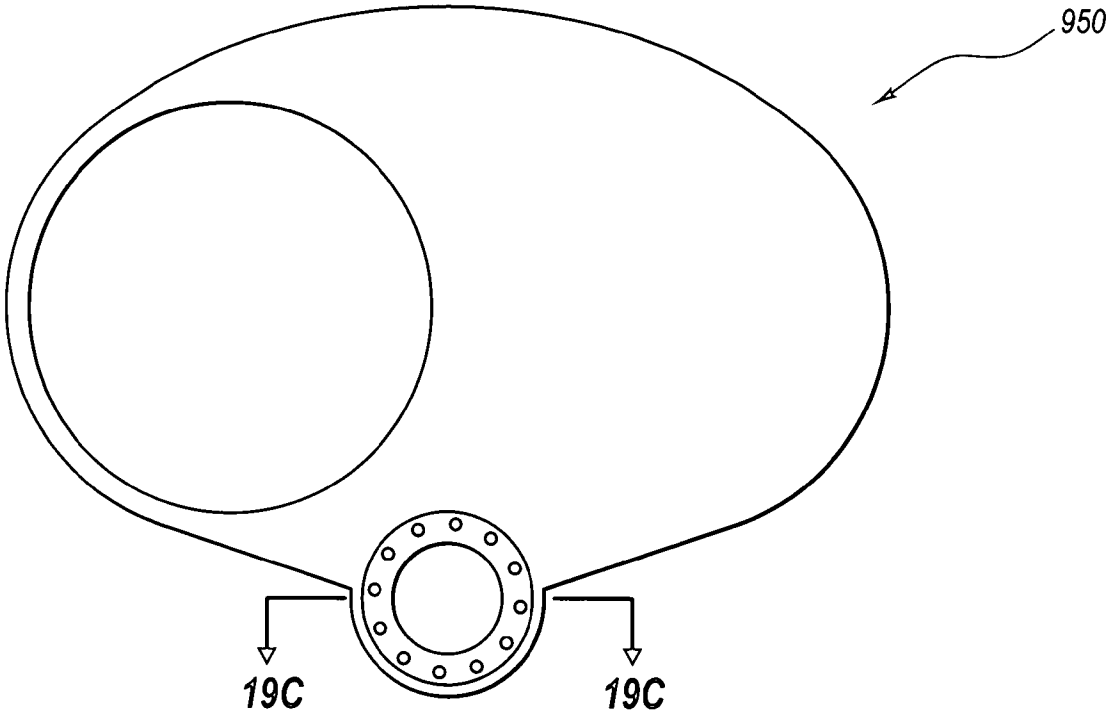
FIG. 19 illustrates an embodiment of gate machining.
Figure 19C:
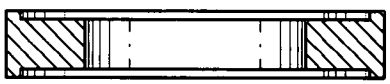
Figure 19B:
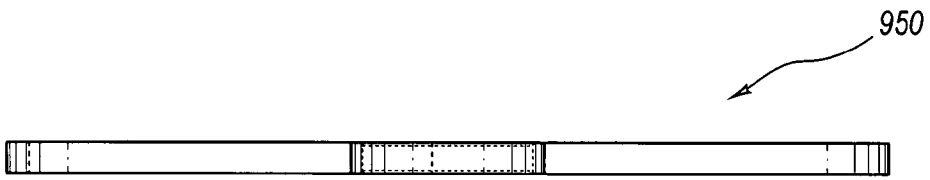
Figure 20C:
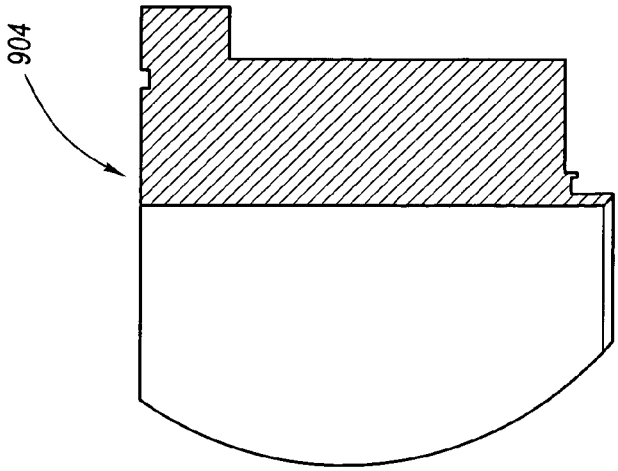
FIG. 20 illustrates an embodiment of a seat retainer.
Figure 20A:
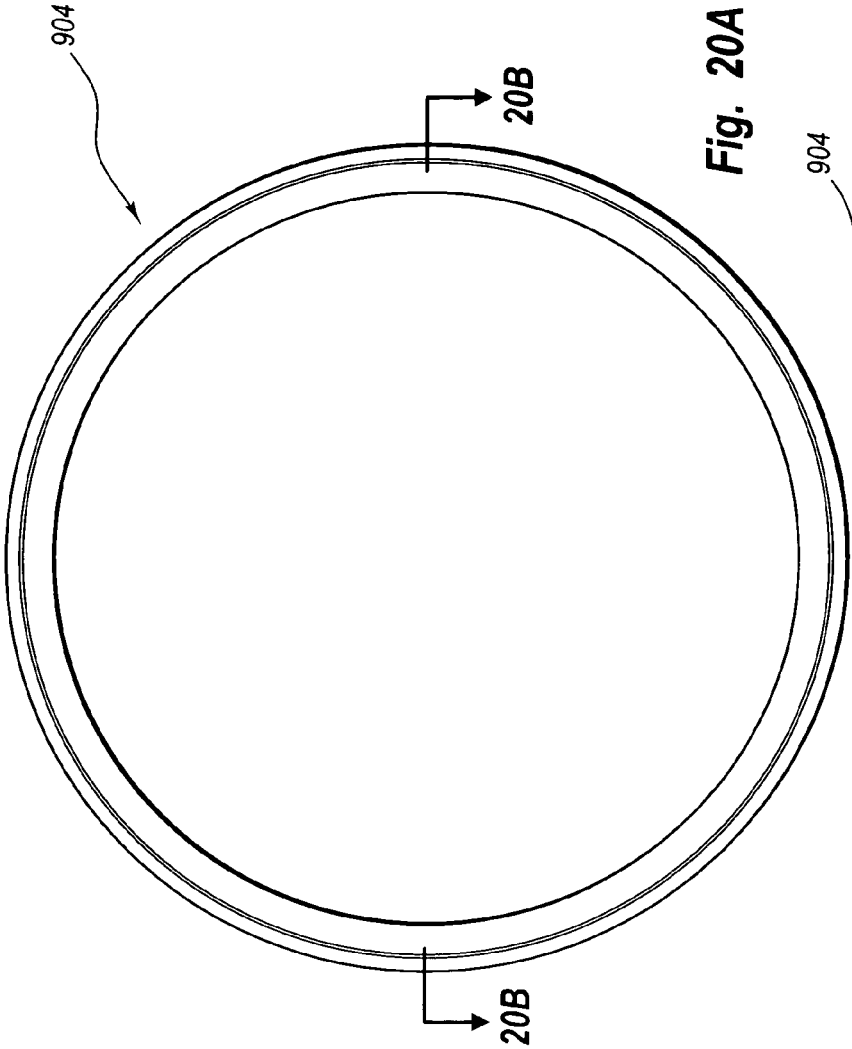
Figure 20B:
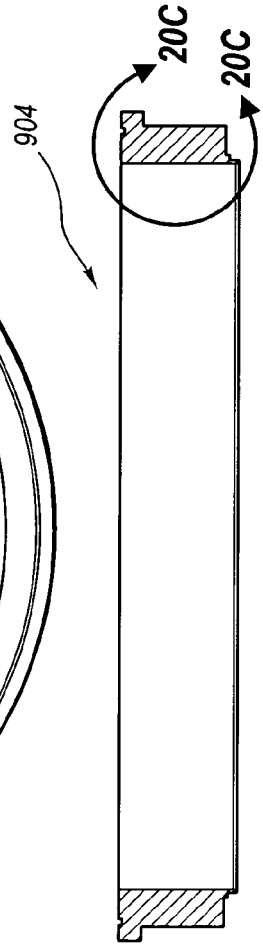

FIGS. 14-17 illustrate embodiments of the goggle blind/gate valve 900. In one embodiment of the invention, the blind 950 is comprised of a pivot point 951, a flat surface 952, an orifice and a means for making contact with a seat 954 or the main body of the valve 901. The pivot point 951 allows the plate 950 to be hingedly attached to the main body of the valve 901. It is contemplated by the present invention that the pivot point 951 could be placed at any position on the blind 950. For example, instead of being centrally located, as depicted in FIGS. 14-16, the pivot 951 could be positioned on one end or the other of the blind 950. Additionally, the pivot 951 point could be an attachment point that protrudes from the blind 950.

The flat surface 952 of the depicted embodiments of the goggle blind 950 is capable of covering the aperture 911 in the body of the valve, which is aligned with the opening of a coke drum 22. Thus, the flat surface 952 is designed to block material from entering or exiting the coke drum 22 when the blind 950 is in a closed position.

In a preferred embodiment of the invention, the orifice 953 in the flat surface 952 of the blind 950 is dimensioned to align with an opening of a coke drum 22. In a preferred embodiment of the invention when the orifice 953 is aligned with the opening of the coke drum 22, material, fluids and gases are free to fall from the coke drum 22 through the valve 900. Thus, when the orifice 953 is aligned with the opening of the coke drum 22 the valve 900 is open. It is contemplated by the invention that the orifice 953 could be located in alternative positions on the flat surface 952 of the blind 950. For example, instead of being centrally located as depicted in the figures, the orifice 953 could be located anywhere on the periphery of the blind 950.

The invention contemplates utilizing a blind 950 that does not have an orifice 953. In this embodiment of the invention, the goggle valve 900 would be in an open position, allowing debris to fall from the coke drum, when the plate/blind 950 was not obstructing the aperture 911 of the valve, which was aligned with the opening in a coke drum 22. In this embodiment of the invention the valve 900 would be closed when the flat surface 952 of the plate 950 obstructed the orifice 911 of the valve 900, which is aligned with the opening of a coke drum 22. Thus, in this embodiment of the invention the goggle plate/gate/blind 950 is a solid flat surface 952 that does not have an orifice 953 to align with the aperture 911 of the main body 901 of the valve 900, but instead allows the valve 900 to open by being moved to a position such that the flat surface 952 of the blind 950 does not obstruct the aperture 911. In one embodiment of a blind 950 utilized in the valve 900, the flat surface 952 of the blind 950 is actuated to block the opening of the coke drum 22.

The gate/blind 950 is further comprised of a means for making contact with the seat system 954 or alternatively with the main body of the valve. As previously discussed, the contact seal provides various benefits. In a preferred embodiment of the present invention, the contact seal is formed by a metal-to-metal contact between a seat system 904 and a means for making contact with the seat system 954.

FIGS. 18-21 depicts some embodiments of seat systems 904 contemplated by the invention. The invention contemplates the use of static 906 and/or dynamic seat systems 905. The seat system 904 of the present invention is comprised of a means of forming a contact seal 907 with the gate/blind 950. In one embodiment of the invention the seat system 904 is fixedly attached to the main body 901 of the valve 900. In another embodiment of the seat system 904 is an integral portion of the main body 901 of the valve 900. In another embodiment the seat system 904 is comprised of the main body 901 of the valve 900.

Seat support system 904 may comprise a type of seating arrangement, including duel, independent seats, wherein the seat are both static, both floating or dynamic, or a combination of these. Because the working environment, in which the valves of this invention operate, is subject to dramatic changes in heat, heat deformation of parts of the system, including heat deformation of the plate/blind 950, occurs regularly. Consequently, in a preferred embodiment of the invention the seat support system 904 is comprised of a floating or dynamic seat 905 (see FIG. 18). The floating or dynamic seat allows a tight seal to be formed between the seat support system 904 and the blind 950 notwithstanding heat deformation of any parts in the valve closure system 900, which may have occurred during the coking and decoking processes. Thus, the present invention contemplates a valve system capable of maintaining a tight seal under hostile operating conditions including high pressure and high temperature.

The present invention also features a method for de-heading a coke drum following the manufacture of coke therein. One embodiment of the method comprises the steps of: (a) obtaining at least one coke drum designed for the manufacture of coke, wherein the coke drum comprises at least one purge port; (b) equipping the coke drum with a de-header valve, the de-header valve being removably coupled to the coke drum and itself comprising (1) a main body having an orifice dimensioned to align with said port of said coke drum when said de-header valve is coupled thereto; (2) a valve closure operably supported by said main body, said valve closure capable of being actuated to oscillate between an open and closed position with respect to said orifice and said port; (3) means for supporting said valve closure; (c) closing the valve closure, thus providing a contact seal between the valve closure and the means for supporting a valve closure; (d) feeding petroleum byproduct into the coke drum via a coke manufacturing process; and (e) de-heading the coke drum by actuating the valve closure and causing it to move about the means for supporting a valve closure into an open position, the means for supporting a valve closure shearing the coke in the coke drum as the blind is displaced and thus effectively de-heading the coke drum. The de-header valve may comprise any of the different valve-types discussed above. In addition, means for supporting a valve closure may comprise any means discussed above and others obvious to one skilled in the art. This method may further be utilized on either a bottom or top de-heading system.

3. Continuous Containment System

Figures 21, 22:
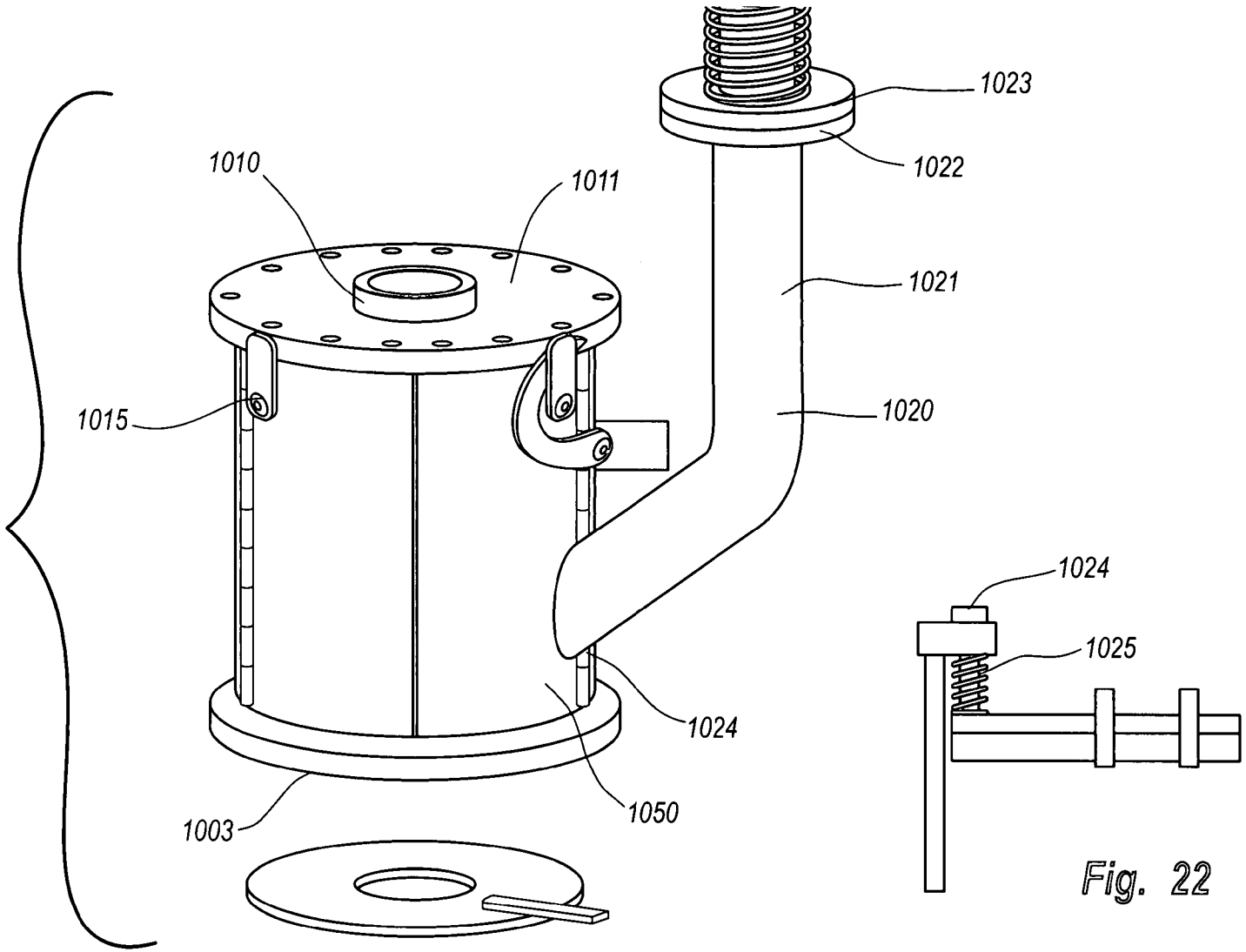
FIG. 21 illustrates an embodiment of a goggle blind seat.
FIG. 22 depicts an embodiment of the containment system, the drill stem guide and venting system.

FIG. 22 depicts a continuous containment system for the decoking process. FIG. 22 depicts a cylindrical containment system 1001 that allows for the drill stem 1005 to be continuously contained in a fully raised, lowered or any position in between fully raised and lowered positions. The continuous containment system may assume various shapes or forms. It is contemplated by the present invention that the containment system in addition to the presented cylindrical shape could be in the shape of a cone, a sphere, a box or any other suitable shape that would allow for continuous containment of the drill and drill stem during the entire process of decoking a drum.

The containment system 1001 depicted in FIG. 22 attaches by a bottom flange 1003 or other attachment device to the top flange of a coke drum deheader. In one embodiment of the present invention, the bottom flange 1003 attaches to the top flange of a drum deheader with a series of bolts. Other modes of securing the bottom flange 1003 of the containment system to the top of the drum deheader or the drum itself will be appreciated by those skilled in the art. Various automated sealing and clamping means have been disclosed in the art for securing drum deheaders to coke drums. Like systems for attaching the bottom flange of the containment system to the top flange of the coke drum deheader are contemplated by the present invention.

The cylindrical shaped containment system of FIG. 22 possesses many features of a preferred embodiment of the continuous containment system. A preferred embodiment of the drill stem guide 1010 is depicted in the continuous containment system depicted in FIG. 22. In FIG. 22 the depicted drill stem guide allows the drill to move up and down through the drill stem guide through an aperture 1012 on the top of the drill stem guide. This aperture is designed to have low space tolerance between the drill stem 1005 and the drill stem guide 1010. Because the drill stem guide 1010 has a low tolerance for room between the drill stem 1005 and the drill stem guide 1010 excess gas or pressure produced during the decoking process can not be vented through the spaces between the drill stem and the drill stem guide. Consequently, the continuous containment system of the present invention is not compromised by excess venting of gases through the aperture 1012 on the top of the drill stem guide, which allows the drill stem to be raised or lowered during the decoking process.

Further, the present embodiment of the drill stem guide comprises a flat or otherwise shaped surface 1011, which covers the top of the containment system 1001. However, in the drill stem guide 1010 depicted in FIG. 22 the flat enclosure 1011 is not attached to the top surface of the containment system but is attached to rolling guides 1015 on the interior of the containment system. Thus, the surface that constitutes the top of the drill stem guide 1010 is allowed to move up and down the drill stem shaft 1005 inside the containment system 1 such that the drill stem guide top plate 1011 is allowed to move vertically up and down inside the chamber created by the containment system.

FIG. 22 further depicts a system for remotely venting the containment system 1020. In FIG. 22 the remote venting system 1020 is attached to the side of the continuous containment system 1001 and allows excess gas to be vented from the containment system 1001 through the venting system 1020 to a predetermined area where venting of excess gases is safe, and will not harm operators in the area. In one embodiment of a venting system 1020 the venting system is attached to the side of the containment system 1001 with a series of tubing or pipe 1021 in which excess gases are couriered to an elevation substantially above the deck upon which the operators work. Consequently, the excess gases produced or released during decoking are released by the venting system at a location remote from the presence of operators, thus providing a safe working environment.

In another embodiment of the present invention the venting system instead venting gases above the operators directs the excess gases and pressure produced or released during decoking below the operators deck and below the barrel being docoked.

FIG. 22 further depicts a system for allowing excess gases and pressure to be vented from the venting system. The vent plate 1023 is attached to the terminal end 1022 of the vent tubing 1021 and could be attached by several means. In one embodiment of the present invention the terminal end of the vent tubing could remain open such that excess gases would be allowed to escape from the venting system freely. Thus, in this embodiment of the present invention no vent plate or attaching device would be necessary.

In another embodiment of the venting system depicted in FIG. 22 the vent plate 1023 would be attached to the terminal end of the vent tubing 1022 by long bolts 1024 and springs 1025. The long bolts 1024 permanently affix the vent plate 1023 to the terminal end of the vent tubing 1022 and allow for springs 1026 to be placed on the bolt 1025 on top of the vent plate 1023 such that the springs exert a downward force on the vent plate 1023 forcing the vent plate 1023 into contact with the terminal end of the vent tubing 1022 as a default setting. However, when excess gas is produced in the containment system 1001 and released through the venting system 1020 the excess gas forces the vent plate 1023 to move up vertically along the bolts 1025 against the pressure of the springs 1026 to release the excess gas. Thus, the spring system could be designed to release pressurized gases at any predetermined pressure. For example, if the containment system was designed to contain high pressure gas without venting, the spring system would be stiff and not allow the vent plate to move vertically along the bolts except at times when the pressure in the containment system exceeded a predetermined pressure. Conversely, the spring system could be designed to release very low pressure gas burps from the containment system.

FIG. 22 further depicts the bottom plate 1002 of the continuous containment system. The bottom plate of the continuous containment system would allow the continuous containment system to be affixed to the top of the deheading apparatus such that no pressurized gases would be released from the containment system. In one embodiment of the bottom plate system gaskets could be used to produce a tight seal such that gases would be allowed to exit between the bottom plate and the decoking barrel.

Figure 23:
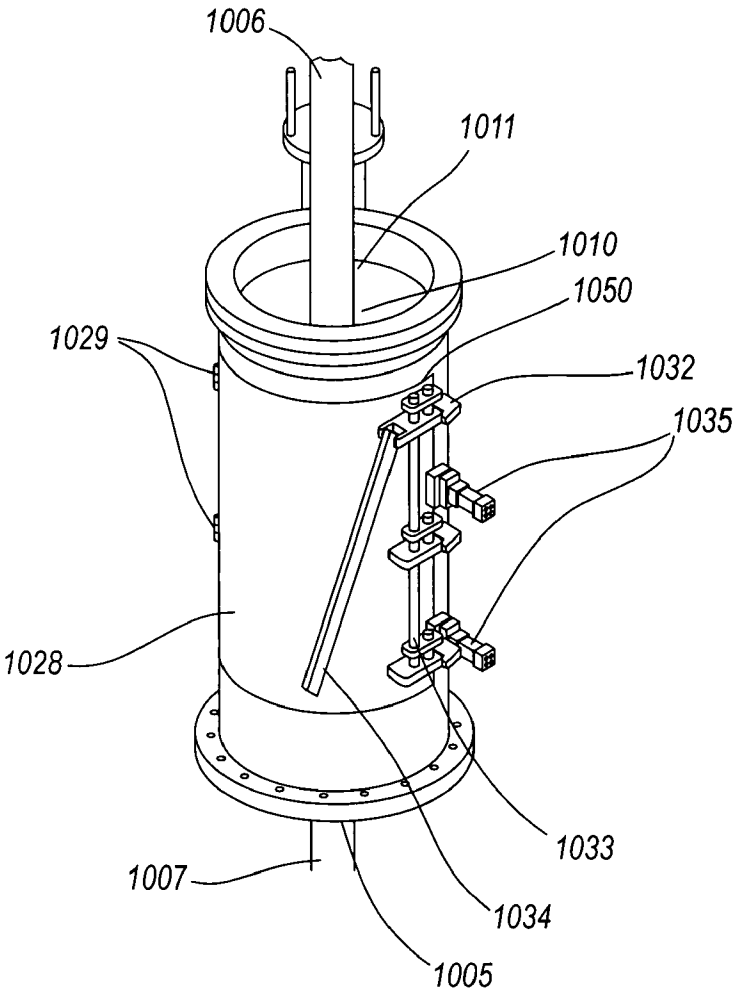
FIG. 23 depicts an embodiment of the containment system, access panel and locking system for the access panel in an unlocked position.

FIG. 23 depicts a preferred embodiment of the present invention. In this figure the system comprises a continuous containment system 1001, a drill stem 1005, a venting system 1020, an access panel 1028, a rolling guide 1015, a hinged system for the access panel 1029, and a locking means for the access panel 1032. The venting system 1020 depicted in FIG. 23 has a first end 1024 attached to the continuous containment system 1001 and second end which is the terminal end of the venting tube 1022 which is remotely located from the continuous containment system. The drill stem has a first end fix which is attached to driver motors or other apparatus for providing mechanical forces on the drill stem. The drill stem has a second end which comprises a drill bit 1007. The drill stem in FIG. 23 runs vertically through the continuous containment system.

In the embodiment of the continuous containment system depicted in FIG. 23 the continuous containment system has a cylindrical shape which is substantially larger in diameter than the drill stem itself. The drill stem enters the containment system through a drill stem guide 1010 which has an aperture 1012 in the top plate 1011. FIG. 23 depicts an embodiment of the drill stem guide 1010 with an aperture 1012 which allows the drill stem to move up and down through the continuous containment system 1001. The drill stem aperture 1012 depicted possesses narrow tolerances to decrease the amount of pressurized gas that can be released from the containment system between the drill stem 1005 and the aperture of the drill stem guide 1012.

FIG. 23 further depicts an embodiment of an access panel 1028. In one embodiment of the present invention an access panel 1028 is present to allow for maintenance or other access to the drill stem 1005 or drill bit 1007 in lowered or raised positions. The access panel of the present embodiment of the present invention comprises a hinged systems 1029 which allows the access panel, when unlocked, to swing open. Further the depicted embodiment of the hinge system 1029 allows the access panel to remain attached to the continuous containment system while the access panel is open or closed.

Alternatively, in another embodiment to the present invention, the hinged system 1029 would allow the access panel

1028 to be completely removed from the continuous containment system 1001 when the access panel 1028 is in an open position.

The access panel 1028 may comprise a locking system 1032. There are various locking systems 1032 which could be utilized to secure the access panel 1028 in a locked position to the continuous containment system 1001. Important features of the access panel 1028 include the ability to secure the access panel during the decoking process such that excess gases are unable to be released from the periphery of the access panel between the access panel and the continuous containment system. Thus, the locking system may comprise a gasket system.

One embodiment of the locking system 1032 further comprises a single and vertical bar 1033 which is actuated by a lever 1034. The single vertical bar 1033 of FIG. 23 locks into three locking apertures 1035 which are fixed to the outer surface of the continuous containment system 1. Thus, when, in the present embodiment of this invention, the lever 1034 is actuated the single locking bar 1033 is connected to the locking apertures 1035.

The number of locking apertures 1035 may be varied. It is contemplated by this invention that as little as one locking aperture 1035 may be utilized. It is further contemplated by the present invention that a series of locking apertures 35 may be utilized. Locking apertures may be present on any peripheral edge of the access panel. Thus, in FIG. 2 the top peripheral edge of the access panel could also have locking apertures attached. In the preferred embodiment of the present invention depicted in FIG. 23 the locking aperture and the locking means for the access panel provide the benefits of simplicity and strength. FIG. 23 further depicts a lever 1034 and locking means 1032 for the access panel in a less than completely locked position. Thus, the lever has been raised such that the lever is no longer in a fully locked position.

Figure 24:
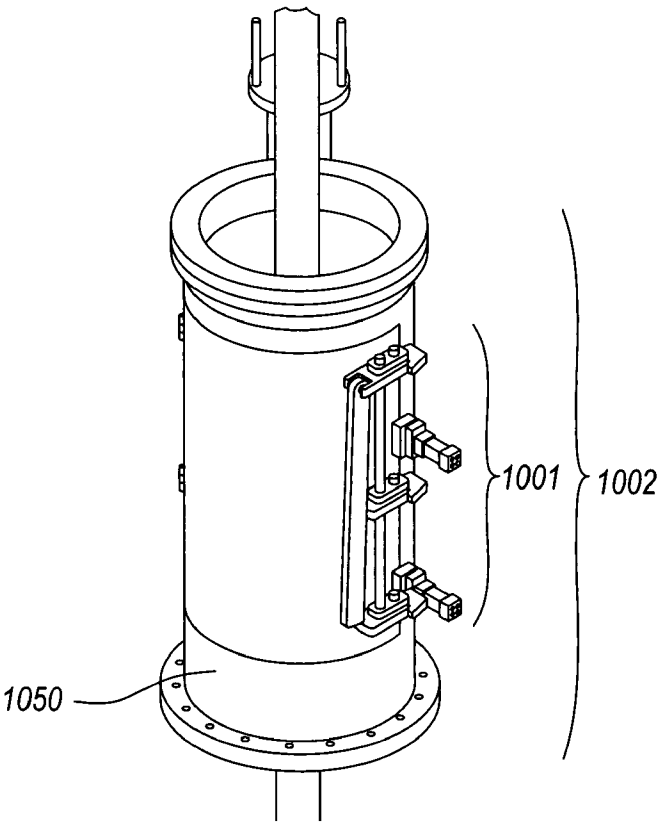
FIG. 24 depicts an embodiment of the containment system, access panel and locking system for the access panel in a locked position.

FIG. 24 depicts the containment system 1001. In particular FIG. 24 depicts one embodiment of the locking means or the access panel in a fully locked position. In this position the locking means secures the access panel 1028 to the containment system in such a way that no excess gas is allowed to move outside of the containment system through the juncture of surfaces comprised of the access panel and the containment system.

Figure 25:
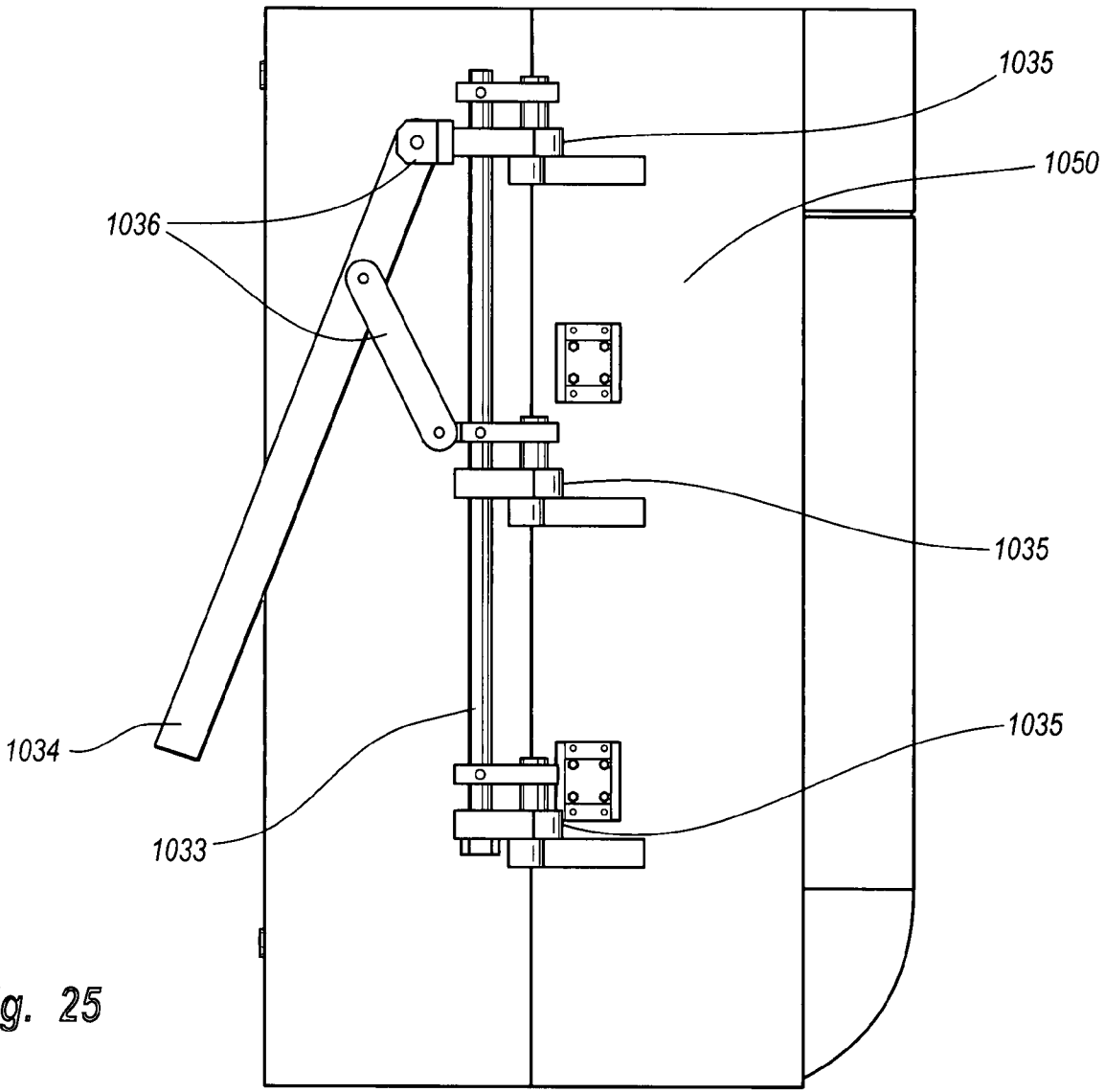
FIG. 25 depicts a close up of an embodiment of a locking system for the access panel in an unlocked position.

FIG. 25 clearly depicts specific details of the locking means for the access panel. FIG. 4 is one embodiment of various locking means contemplated by the present invention. In a preferred embodiment of the present invention, depicted in FIG. 25, a lever 1034 is affixed by hinged means 1036 to a single vertical bar 1033. The single bar 1033 interfaces with locking apertures 1035, which are affixed to the exterior of the containment system 1001 have holes bored through them such that the single vertical bar 1033 penetrates the locking apertures when the lever 1034 is actuated. Thus when the access panel is closed and the lever is actuated the single vertical bar 1033 connects with the locking aperture.

It is contemplated by the present invention that the single vertical bar 1033 could be substituted with multiple vertical bars, which interface individually with multiple locking apertures such that each vertical bar could be actuated independent of one another and locked into position with their respective locking apertures attached to the exterior of the containment system. It is further contemplated by the present invention that various means for actuating the locking apparatus could be designed including electrical systems connected to solenoids, which would allow actuation of the locking apparatus from remote locations. Thus, the locking apparatus could be locked and unlocked from a distance providing safety for operators during access of the panel. Consequently, if excess gas pressure were contained in the continuous containment system 1 and an operator desired to unlock the access panel 1028 from a safe distance, a remote actuating system could be utilized to allow safe unlocking of the access panel 1028.

Figure 26:
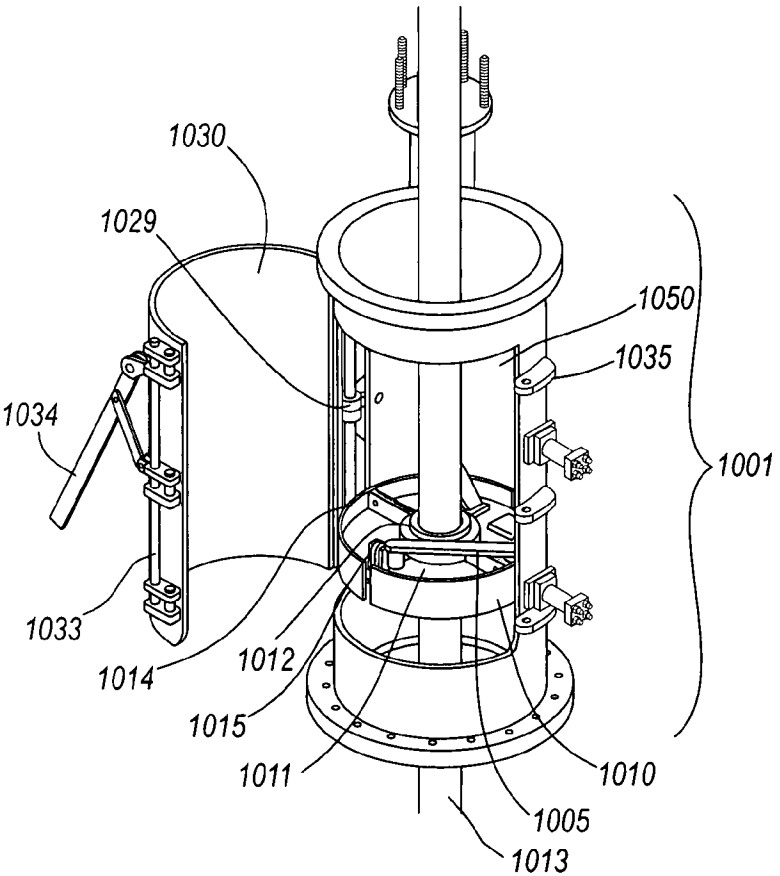
FIG. 26 depicts an embodiment of the containment system with the access panel opened to view the drill stem guide in a lowered position.

FIG. 26 depicts a preferred embodiment of the present invention. FIG. 26 comprises various elements of the present invention. FIG. 26 is particularly important because it depicts the drill stem guide 1010 in a lowered position. FIG. 26 shows that the drill stem guide 1010 allows the drill stem 1005 to be lowered to a position which allows the decoking process to occur. There are various features of the present embodiment of the drill stem guide 1010, which contribute to the usefulness of the present invention. First, the drill stem guide 1010 maintains the position of the drill stem 1005. Thus, the drill stem 1005 is not allowed to move substantial distances in directions perpendicular to the length of the drill stem shaft 1005. Second, the drill stem guide 1010 provides a surface that prevents excess gas from escaping from the top of the containment system 1001. Consequently, continuous containment provided by the top of the drill stem guide during the entire drill stroke, whether the drill is fully raised, lowered or somewhere in between fully raised and lowered.

FIG. 26 depicts the drill stem guide 1010. The drill stem guide in FIG. 26 is in a completely lower position. In one embodiment of the present invention, the drill stem guide possesses various features that allow it to usefully be integrated into the continuous containment systems 1001. One feature of the depicted drill stem guide is the drill stem aperture 1012. The drill stem aperture of the depicted embodiment of the present invention has a low tolerance for space between the drill stem aperture and the drill stem 1005. Because the drill stem aperture 1012 has a low tolerance for space between the drill stem 1005 and the drill stem aperture 1012, no excess gas released from the de-poking process can be released through the space between the drill stem aperture 1012 and the drill stem 1005. Consequently, a safe environment is provided for operators on the operating deck, whether the drill stem is in a lower, raised, or is in-between being fully raised and lowered.

Another feature of the drill stem guide depicted in FIG. 26 is the top plate of the drill stem guide 1011. The top plate of the drill stem guide prevents excess gas or pressure from escaping from the top of the containment system 1001. In a preferred embodiment of the present invention, depicted in FIG. 26, the top plate is attached to the interior of the containment system by rolling guides 1015. The rolling guides as presently depicted attach the drill stem guide 1010 to the interior of the containment system by a rail system 1018 which allows the rolling guide 1017 to move vertically up and down the interior of the containment system 1001. The rolling guides 1017 are attached to the top plate 1011 of the drill stem guide 1010. Because the drill stem guide 1010 is attached to the rolling guides 1017 which are attached to a rail system 18 on the interior of the containment system 1001, the drill stem guide 1010 can move vertically up and down inside the shaft of the containment system 1001. This feature is of critical importance to this embodiment of the present invention because it allows the containment system 1001 to provide containment without being compromised during the entire drill stroke. This embodiment provides continuous containment of the decoking process whether the drill stem is in a lowered or raised position. Thus, there is no time during the decoking process where operators are exposed to surges of excess pressure or gases, which result from the decoking process.

FIG. 26 further depicts the drill stem guide in a complete circle around the drill stem providing tight tolerances between the drill stem and the drill stem aperture. FIG. 26 depicts an attachment lever 1013 which connects half of the drill stem guide comprised of the top plate and rolling guides to the interior of the containment system. The attachment lever 1013 allows the first half 1040 of the drill stem guide 1010 to assume either a closed or open position. FIG. 26 depicts the first half of the drill stem guide 1040 in a closed position.

Figure 45A:
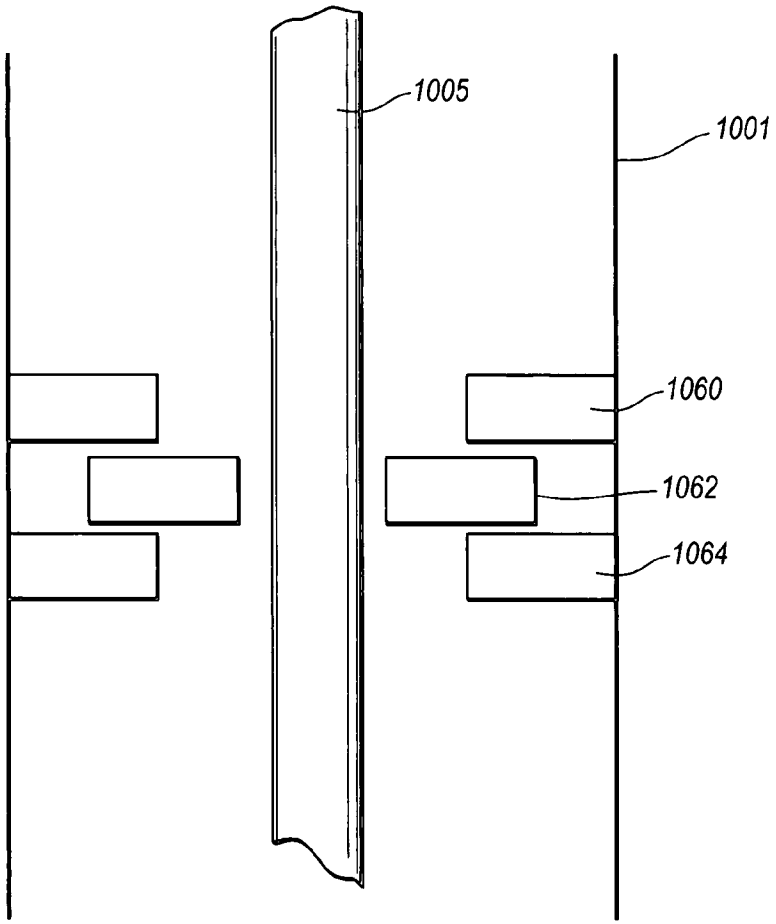
FIGS. 45A and 45B depict embodiments of the containment system comprising a three plate drill stem guide.
Figure 45B:
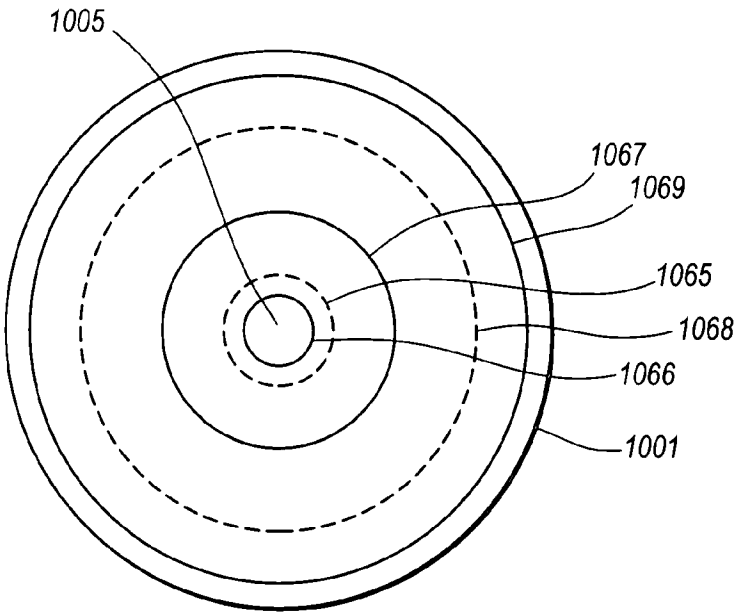

FIGS. 45A and 45B depict alternative embodiments of the drill stem guide 1010. FIG. 45A depicts a cross section view of a drill stem guide 1010 that is comprised of three separate plates 1060, 1062, 1064. In an embodiment of the depicted drill stem guide 1010 the top plate 1060 and the bottom plate 1064 are connected to the pressure vessel. The plates may be connected by various means including welding. The middle plate 1062 is not connected to the pressure vessel. The circumference of the inner diameter of the middle plate 1065, the drill stem aperture, is larger that the circumference of the drill stem 1066. The inner circumference of the top and bottom plates 1067 is substantially larger than the circumference of the drill stem 1066 but is substantially smaller than the circumference of the outer edge of the middle plate 1068. Accordingly, the middle plate 1062 is held in a vertical position between the top and bottom plates 1060, 1064. The embodiment depicted in FIGS. 45A and 45B may additionally comprise a drill stem sleeve which would fit between the middle plate 1062 and the drill stem 1005.

FIG. 45B depicts a top view of the three plate embodiment of the drill stem guide. The following description of FIG. 45B traces the concentric rings from outside to inside. The outer most ring represents the pressure vessel 1001. The next ring represents the outer diameter of the top and bottom rings 1069. The next ring depicts the outer circumference of the middle ring 1068. The next ring represents the inner circumference of the top and bottom plates 1067. The next ring depicts the inner circumference of the middle plate 1065 and the inner most ring depicts the outside edge of the drill stem 1066.

FIG. 26 further depicts a locking means 1014. The locking means depicted in FIG. 26 is actuated to maintain the drill stem guide in a lowered position. When decoking a barrel the drill stem 1005 is in a lower position, the locking means 1014 can be actuated to prevent the drill stem guide 1010 from extreme vertical movements produced when excess gas is released into the containment system. Without a locking means 1014, when excess gas is produced by the decoking process, pressure created inside the containment system below the drill stem 1010 guide would tend to force the drill stem guide up the drill stem 1005, causing the drill stem guide to come forcibly in contact with mechanical apparatus affixed to the drill stem. Additionally, the locking means 1014 prevents the drill stem guide 1010 from being elevated by excess gas above the top of the containment system 1001. If the drill stem guide were allowed to lie vertically above the top of the containment system, excess gas would be allowed to vent from the opening at the top of the containment system. Because preventing excess gas from leaking into an area proximate the operator deck is desirable, allowing the drill stem guide to rise above the top of the containment system could produce deleterious results. Consequently, the locking means 1014 secures the drill stem guide 1010 in a lowered position to preserve the integrity of the containment system. A second locking means 1016 is also utilized to prevent the drill stem guide 1010 from moving vertically up the drill stem when the drill stem is in a raised position.

FIG. 26 further depicts the access panel in a completely open position. In one embodiment of the present invention, the access panel comprises a large surface area 1030 wherein the periphery of the large surface area comes in contact with the exterior of the containment system 1001 when the access panel is in a closed position. When as depicted in FIG. 26 the access panel is unlocked and open, the interior of the containment system 1001 is exposed for servicing the various components of the drill system and containment system.

The access panel, depicted in FIG. 26, is further comprised of a hinge system 1029 which allows the access panel to remain attached to the exterior of the containment system even when the access panel is in a fully open position. In an alternative embodiment of the present invention, the hinge system would allow for the access panel to be completely removed from the containment system when the access panel is in a fully open position.

The access panel depicted in FIG. 26 further is comprised of a locking means 1032. The locking means depicted in FIG. 5 is comprised of a single vertical bar 1033, a lever 1034, and locking apertures 1035. The locking means for the access panel is actuated by moving the lever. The lever when actuated vertically displaces the single vertical bar in a vertical axis. When an operator desires to lock the access panel the lever is lowered and the vertical bar interacts with the locking apertures to securely connect the access panel to the exterior of the containment system. In one embodiment of the present invention, the periphery of the access panel which contacts the exterior of the containment system utilizes gaskets. One skilled in the art would recognize that various gasket systems would be appropriate to prevent excess gas and pressure from leaking between the access panel and the exterior of the containment system.

The present invention contemplates an access panel that would allow the entire side of the containment system, including the top lip of the containment system, to be opened up so that the entire drill stem could be removed from the access panel. This embodiment is further depicted in FIG. 27.

Figure 27:
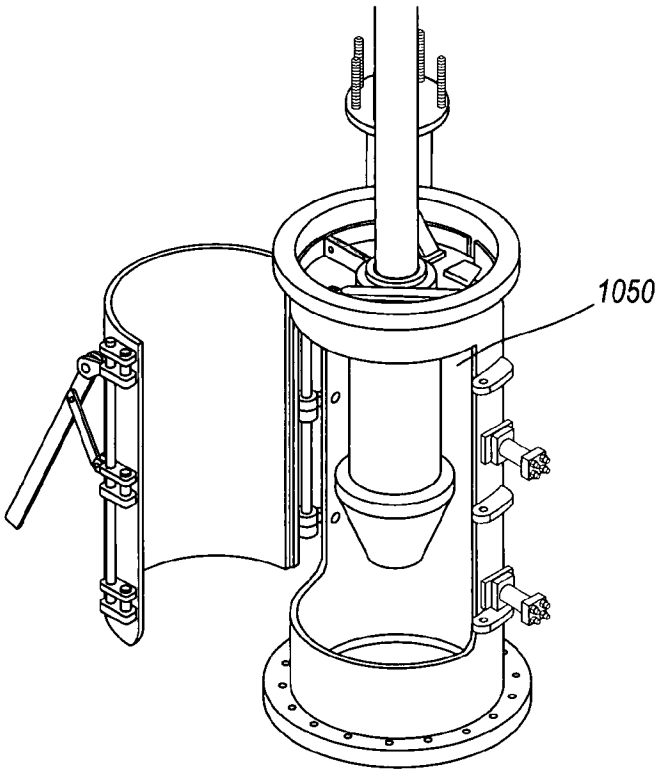
FIG. 27 depicts an embodiment of the containment system with the access panel opened to view the drill stem guide in a raised position.

FIG. 27 depicts the drill stem inside the containment system in a fully raised position. FIG. 27 depicts the preferred embodiment of the present invention in which the drill stem guide 1010 is attached by a rolling means 1015 to the interior of the containment system 1001. This rolling means 1015 allows the drill stem guide 1010 to move vertically inside the containment system 1001 so that the drill stem 1005 can be raised to a fully raised position to allow maintenance, inspections, or to allow for other maintenance or inspections of the drill stem or containment system components.

In the depicted embodiment of the present invention, the drill stem is in the fully raised position. In the fully raised position the drill stem guide 1010 is held in position by a second locking means 1016 depicted in FIG. 28. Said second locking means 1016 allows the drill stem guide to come to a fully raised position but inhibits or prevents the drill stem guide from moving vertically along the drill stem 1005 vertically to a position above the containment system. Because the second locking means prevents the drill stem guide 1010 from raising above the top of the containment system 1001, the containment system provides containment without being compromised during the full drill stroke. The drill can be fully raised or fully lowered and the containment system provides continuous containment preventing excess pressure produced during the decoking process from creating hazard work environments for operators who are present.

FIG. 27 further depicts an alternative hinge apparatus for the access panel. The alternative hinged apparatus would allow the portion of an entire side of the containment system to be opened so that the drill stem could swing out of the containment system when the access panel is in an open position. This modified access panel could be attached to the exterior of the containment system by a hinged means and utilize a locking means to secure the access panel when the access panel is in a closed position.

Figure 28:
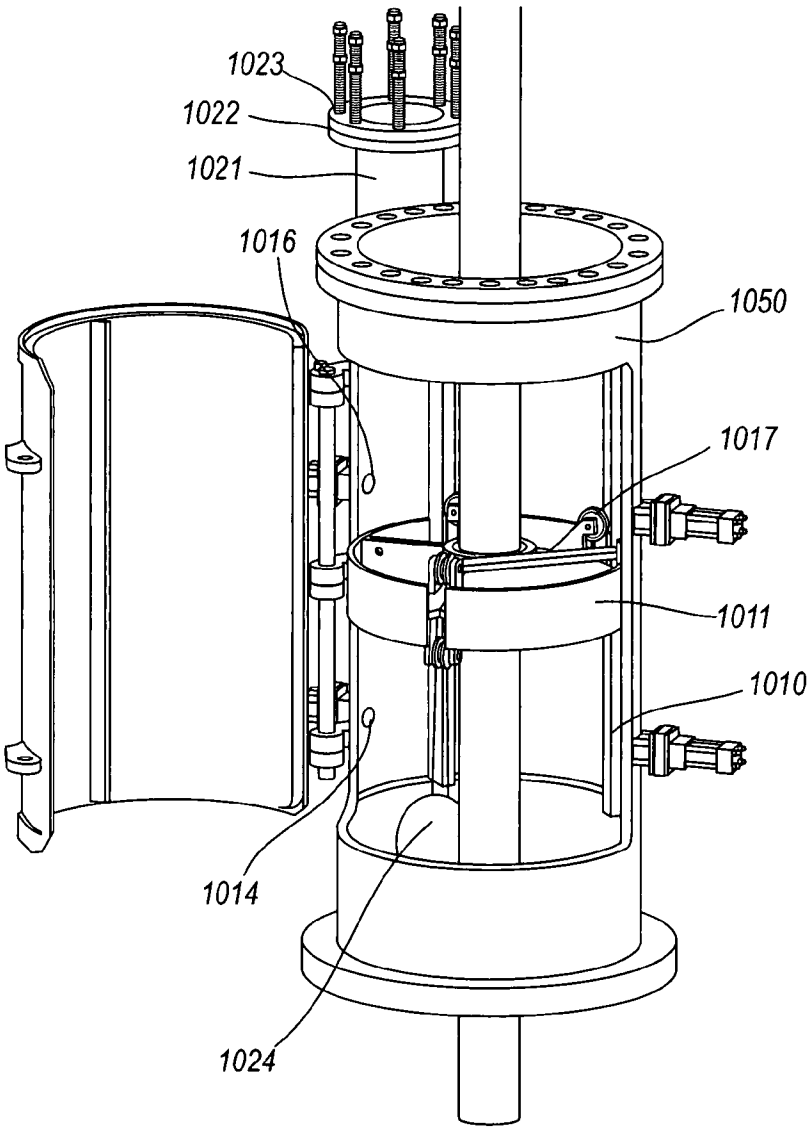
FIG. 28 depicts an embodiment of the containment system with the access panel opened to view the details of the interior of the containment system that enable the drill stem guide to move vertically inside the containment system and which enable the drill stem guide to be secured in place in both the lowered and raised positions.

FIG. 28 clearly depicts various components of the drill stem guide. Specifically, FIG. 28 depicts elements that allow the drill stem guide to maintain or to provide containment without being compromised throughout the entire drill stroke. Continuous containment of excess gas produced during the decoking process is created by the various components comprising the drill stem guide 1010 depicted in FIG. 28. FIG. 28 depicts the first locking means 1014 and the second locking means 1016. The first locking means as depicted in FIG. 28 is retracted to allow the drill stem guide to be raised vertically in the containment system to allow the drill stem shaft to be raised vertically to a raised position. The second locking means is actuated preventing the drill stem guide from rising above the top edge of the containment system. This allows the drill stem to come to a fully raised position and yet provides containment uncompromised containment during the entire drill stroke. No excess gas produced during the decoking process can be released from the top of the containment system because the top plate of the drill stem guide prevents the gas from doing so.

FIG. 28 further depicts a preferred embodiment of the rolling guide system used to allow the drill stem guide to move vertically up and down inside the containment system. A preferred embodiment of the rolling guide as depicted in FIG. 28 are comprised of several elements. The drill stem guide 1010 rolling guides 1015 of FIG. 28 is comprised of rollers 1017 and rails 1018. The rollers 1017 of the rolling guide 1015 may be affixed to the drill stem guide 1010 and the rails 1018 of the rolling guide 1015 may be affixed to the interior of the containment system 1001.

The present invention contemplates alternative means for allowing the drill stem guide to move vertically up and down the interior of the containment system. One skilled in the art would appreciate variations available for allowing the drill stem guide to move vertically in the containment system. For example, the rails 18 of the rolling guides 1015 could be affixed to the drill stem guide 1010 and the rollers 1017 or a series of bearings could be affixed to the interior of the containment system.

FIG. 28 further depicts the drill stem guide 1010, which is further comprised of a top plate 1011. The top plate depicted in FIG. 28 is composed of a first 1040 and second half 1041. FIG. 28 depicts the first half of the drill stem guide and the second half of the drill stem guide in a connected position inside the containment system.

FIG. 28 further depicts the venting system 1020. Particularly the FIG. 7 depicts the vent tubing 1021, the terminal end of the vent tube 1022 and the vent plate 1023, wherein the and the first end of the vent tubing 1024 is affixed to the containment system. The venting system depicted in FIG. 1028 allows excess gas produced during the decoking process to enter the vent tubing through the first end of the vent tubing 1024, the excess gas is allowed to move through the vent tubing to the terminal end of the vent tubing. The terminal end of the vent tubing can be located at any position that allows for the safe venting of excess gas. For example, the distal end, the terminal end of the vent tubing to be located at an elevation substantially above the operator's deck such that any excess gas vented through the vent tubing would not cause the possibility of injuring or harming operators present on the deck. Alternatively, the terminal end of the vent tubing could direct excess gas downward below the barrel being the coat. Various embodiments or locations for dissipating excess gas are contemplated by the present invention.

FIG. 28 depicts a preferred embodiment for a vent plate system 1023. The vent plate depicted in FIG. 28 is affixed to the terminal end of the vent tube 1022 by series of bolts 1025. The bolts 1025 are conjugated with a spring system 1026. The spring system which is held in place by nuts 1027 on the end of said bolts 1025 holds the vent plate 1023 in contact with the terminal end of the vent tubing 1022. The springs 1026 provide a downward pressure which holds the vent plate 1023 in contact with the terminal end of the vent tubing 1022. When excess gas is used during the decoking process the excess gas produces pressure inside the containment system 1001. The containment system 1001 allows the excess pressure and gas to move down the vent tubing 1021 to the terminal end of the vent tubing 1022. If the excess pressure on the vent plate 1023 exceeds the pressure created by the spring system 1026, the excess gas raises the vent plate 1023 allowing excess gas and pressure to be released from the terminal end of the vent tubing 1022. Thus, the spring system could be designed to bleed excess pressure and gas from the containment system at any desired pressure.

Alternatively, the present invention contemplates a containment system that does not utilize a venting system. Thus, in FIG. 28 where the first end of the vent tubing is attached to the containment system there would be no tubing. Instead of venting excess pressure the containment system would contain excess pressure for the duration of the decoking process.

In another embodiment of a venting system a release valve could be affixed to the containment system where the first end of the vent tubing is depicted in FIG. 28 the release valve could be connected by vent tubing to a terminal end of vent tubing such that excess gas would be released through the release valve to a location that would not harm operators on the deck. The release valve contemplated by the embodiment of this invention could be operated manually or remotely by electronic means. For example, a simple solenoid could be used to actuate the release valve to allow excess pressure to be vented from the containment system by an operator from a remote position.

Figure 29:
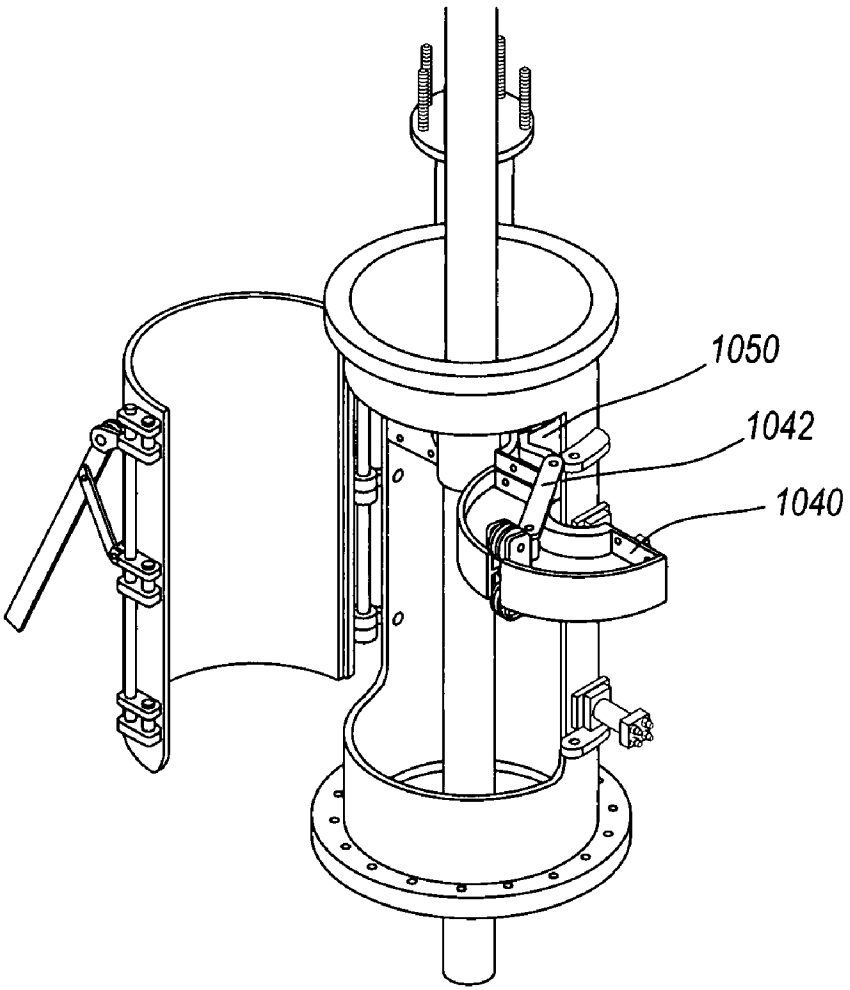
FIG. 29 depicts an embodiment of the containment system with the access panel opened to view an embodiment of the hinged two-piece drill stem guide, which allows the drill stem to swing out of the containment system for maintenance
Figure 30:
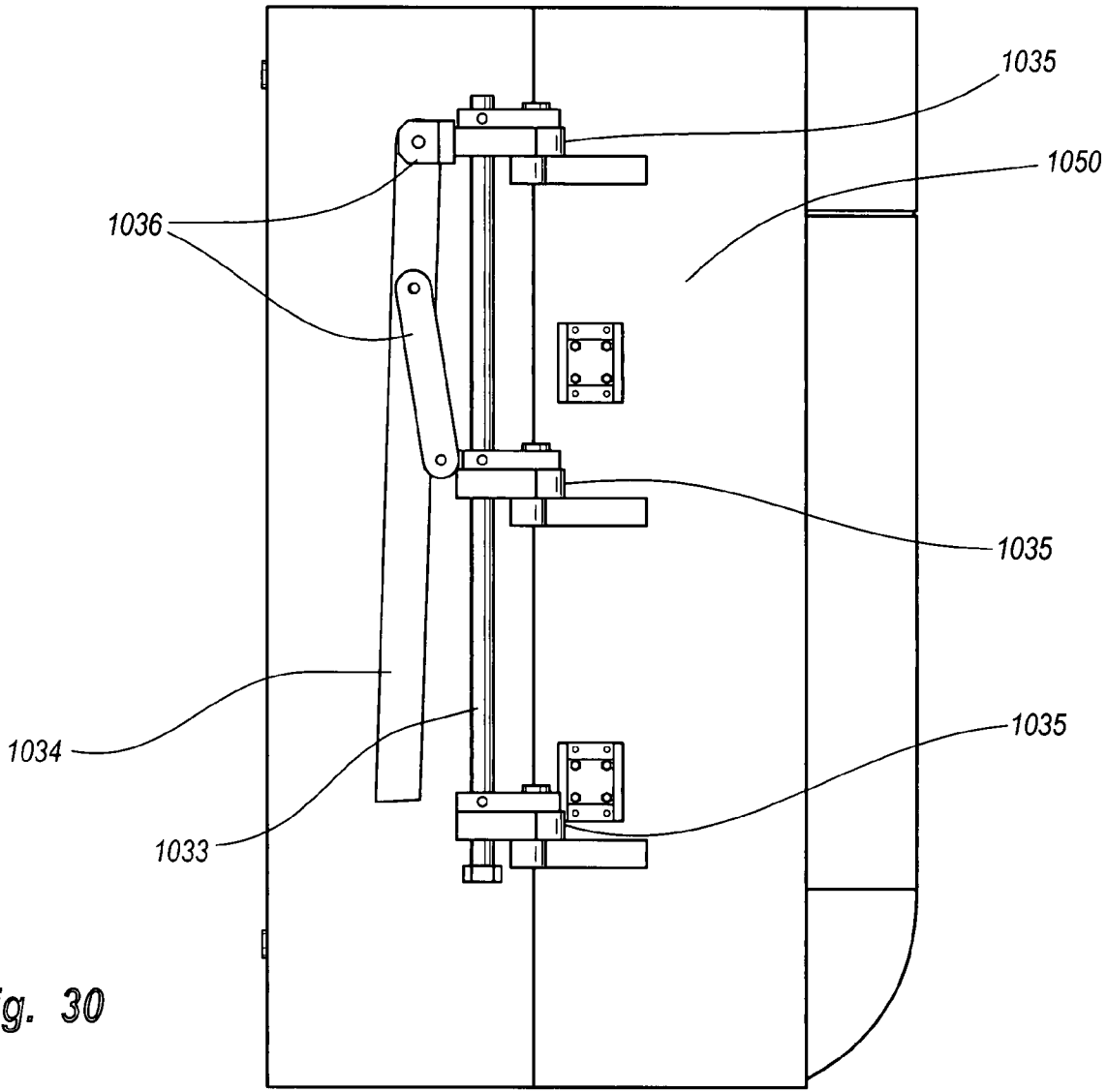
FIG. 30 depicts an embodiment of the containment system with the access panel and locking system.
Figure 31:
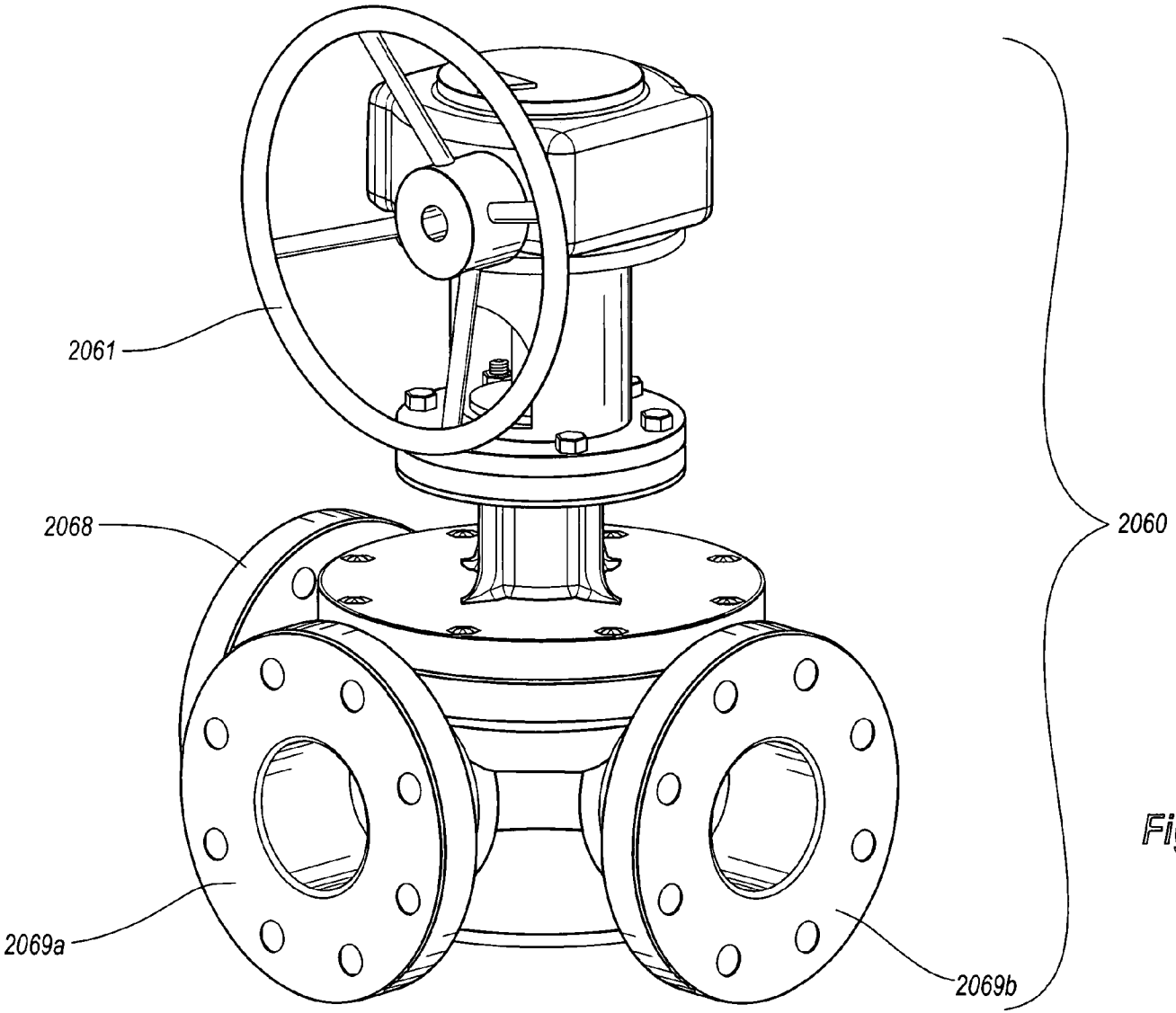
FIG. 31 depicts an embodiment of a 3-way ball joint, which is an embodiment of a switch valve.
Figure 32:
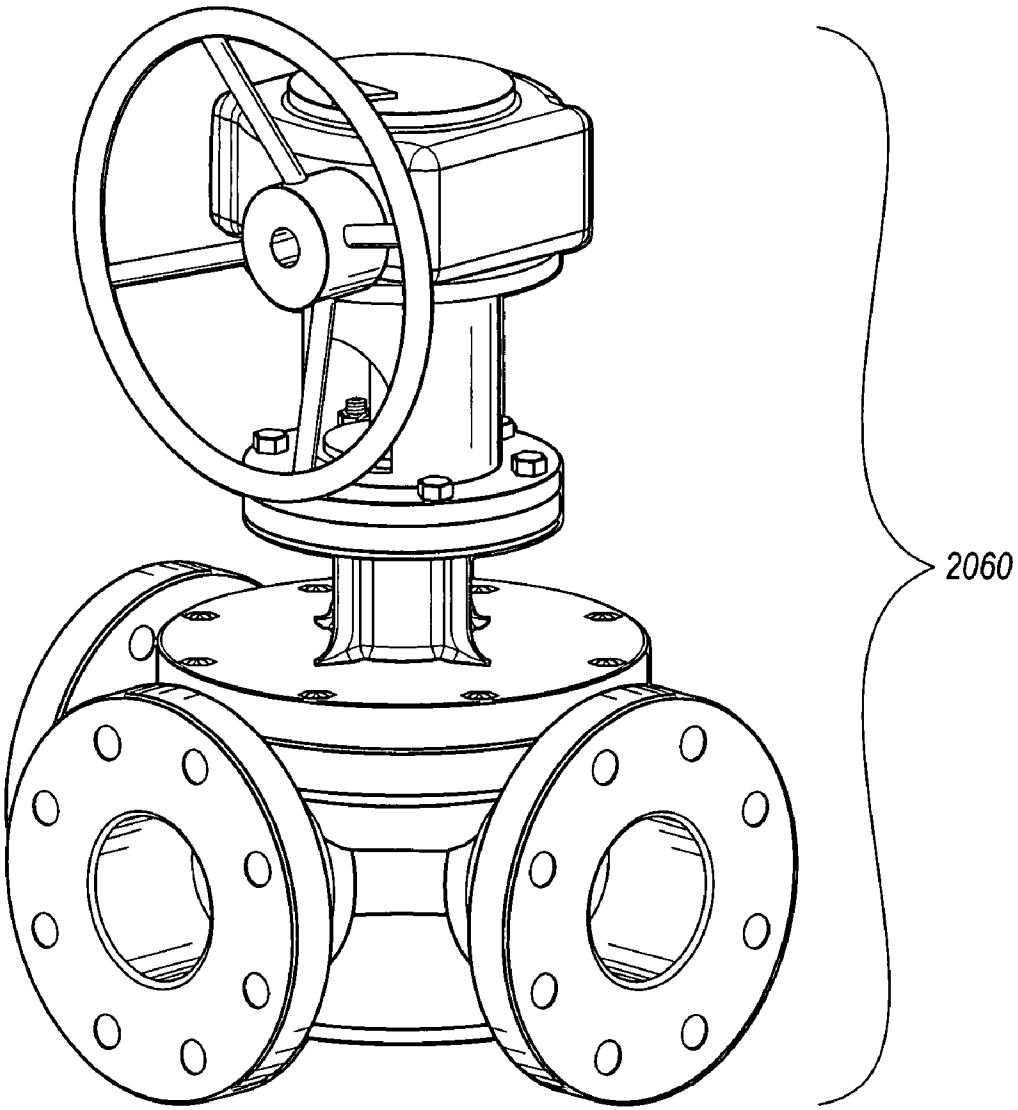
FIG. 32 depicts an embodiment of a switch valve which is a 3-way valve joint.
Figure 33:
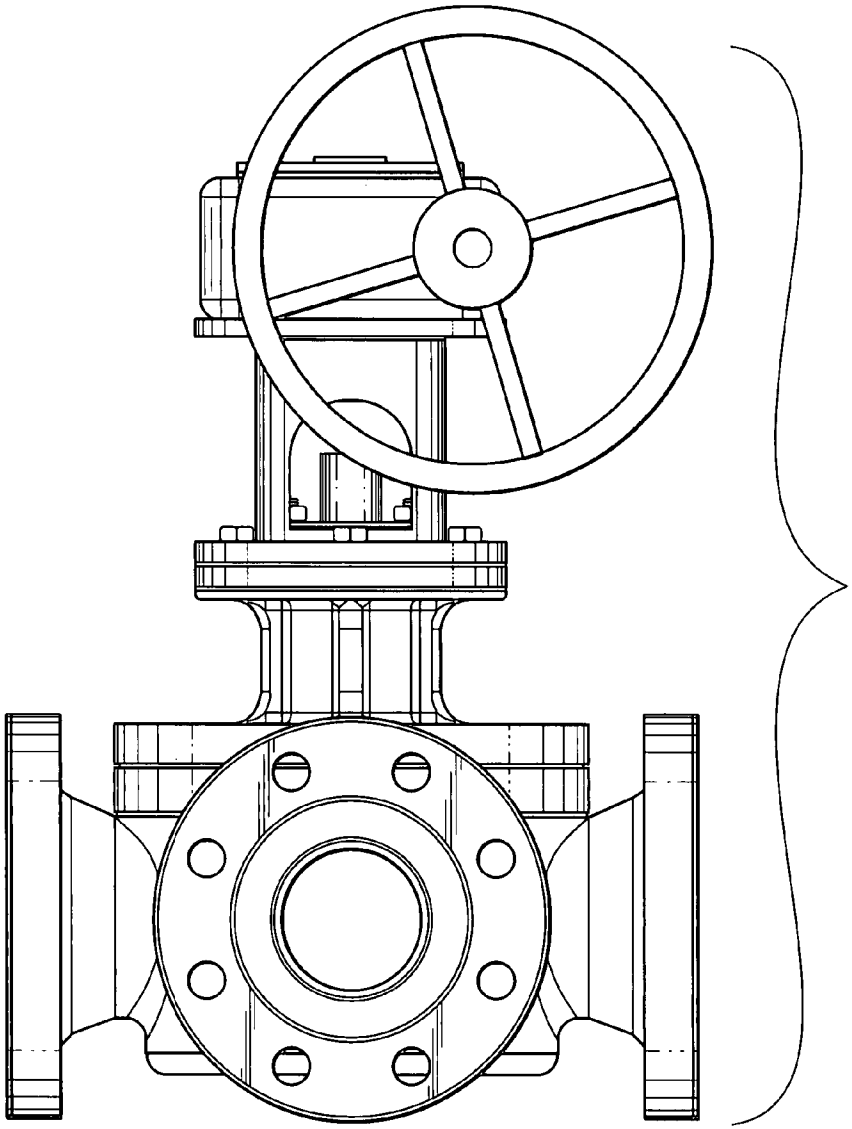
FIG. 33 depicts an embodiment of a switch valve which is a 3-way valve joint.
Figure 34:
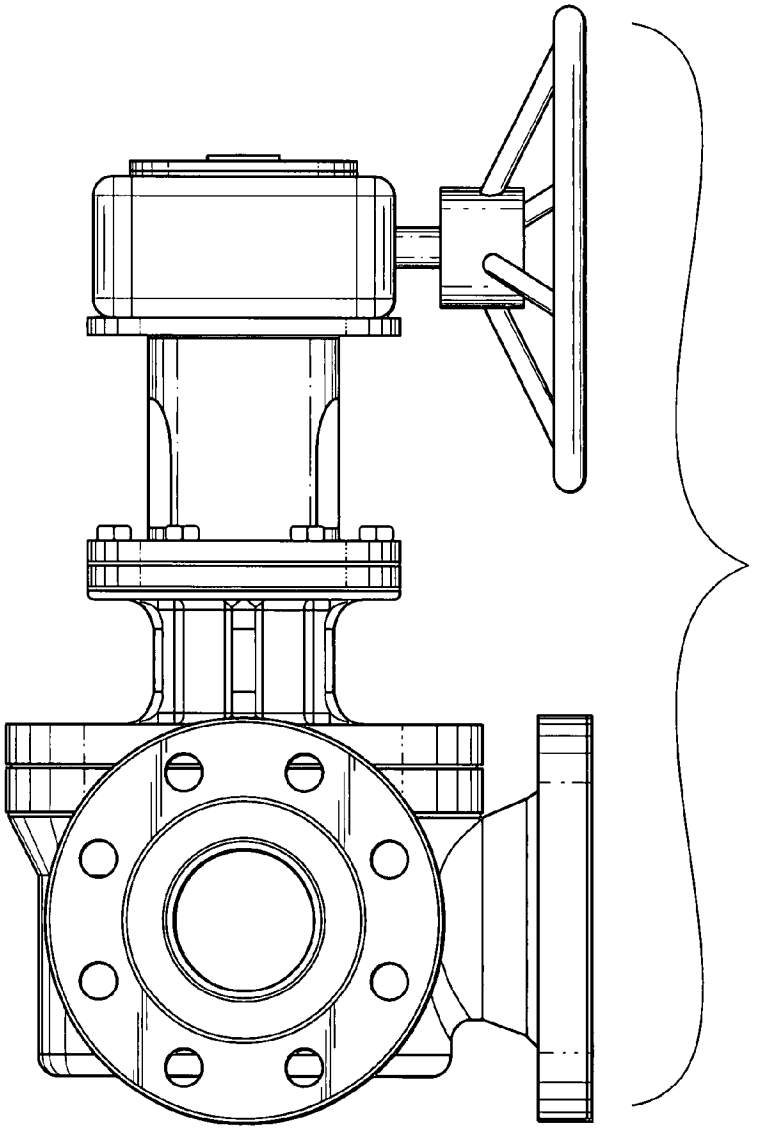
FIG. 34 depicts and embodiment of a switch valve which is a 3-way valve joint.
Figure 35:
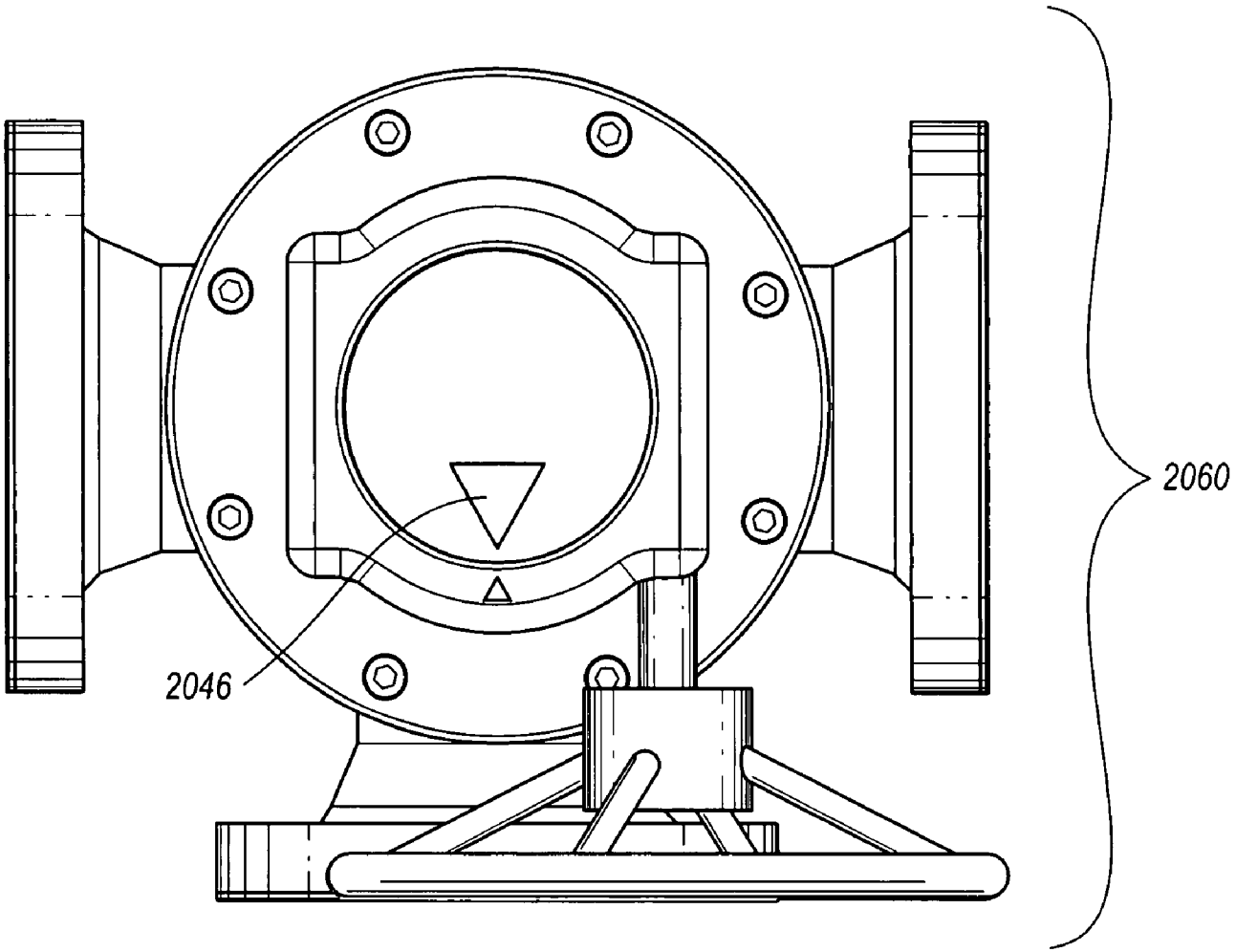
FIG. 35 depicts an embodiment of a 3-way ball valve viewed from the top surface.
Figure 36:
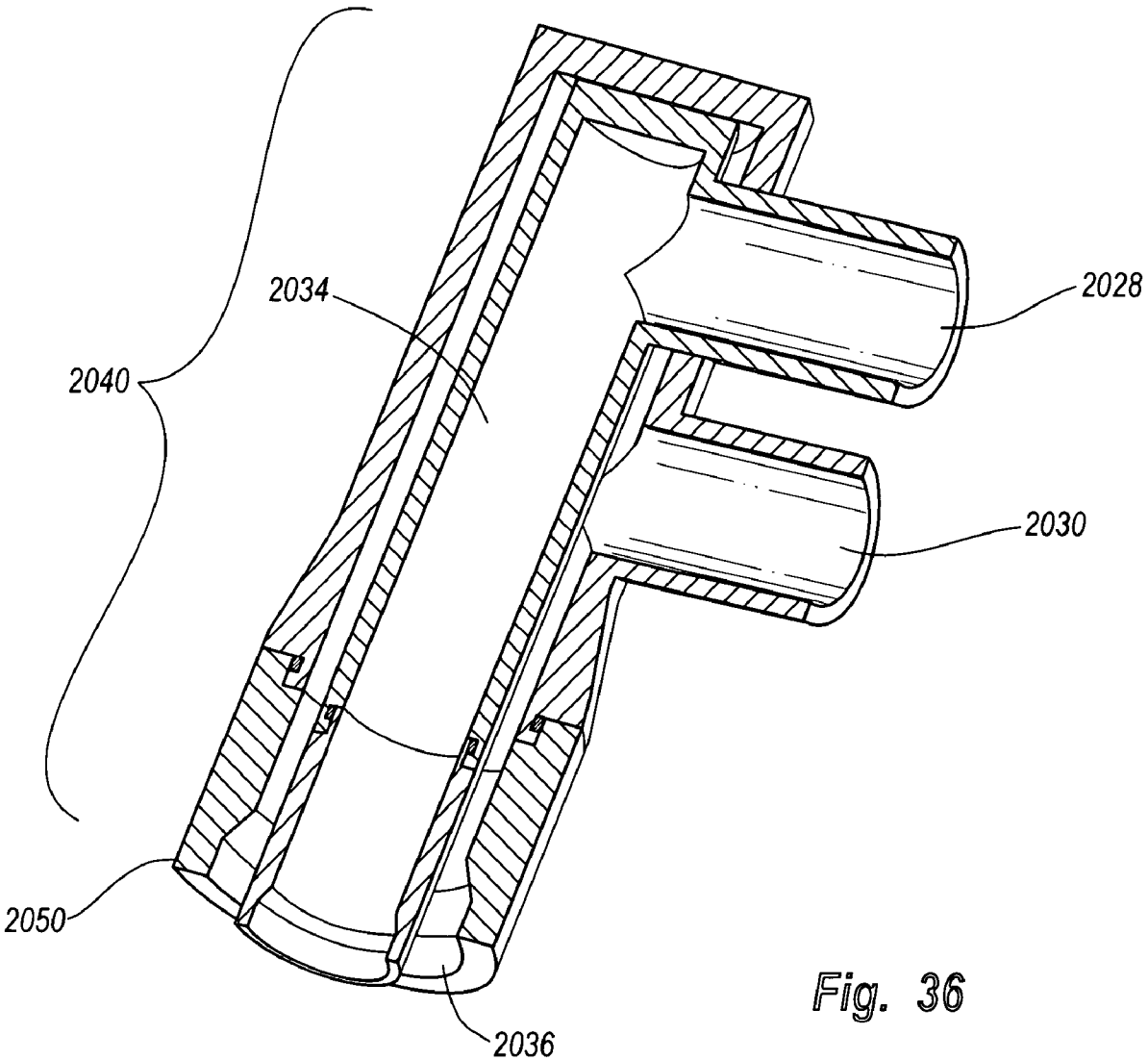
FIG. 36 depicts an embodiment of the union of the high pressure pipes containing fluids used for boring with the high pressure pipe containing fluids used for cutting.
Figure 37:
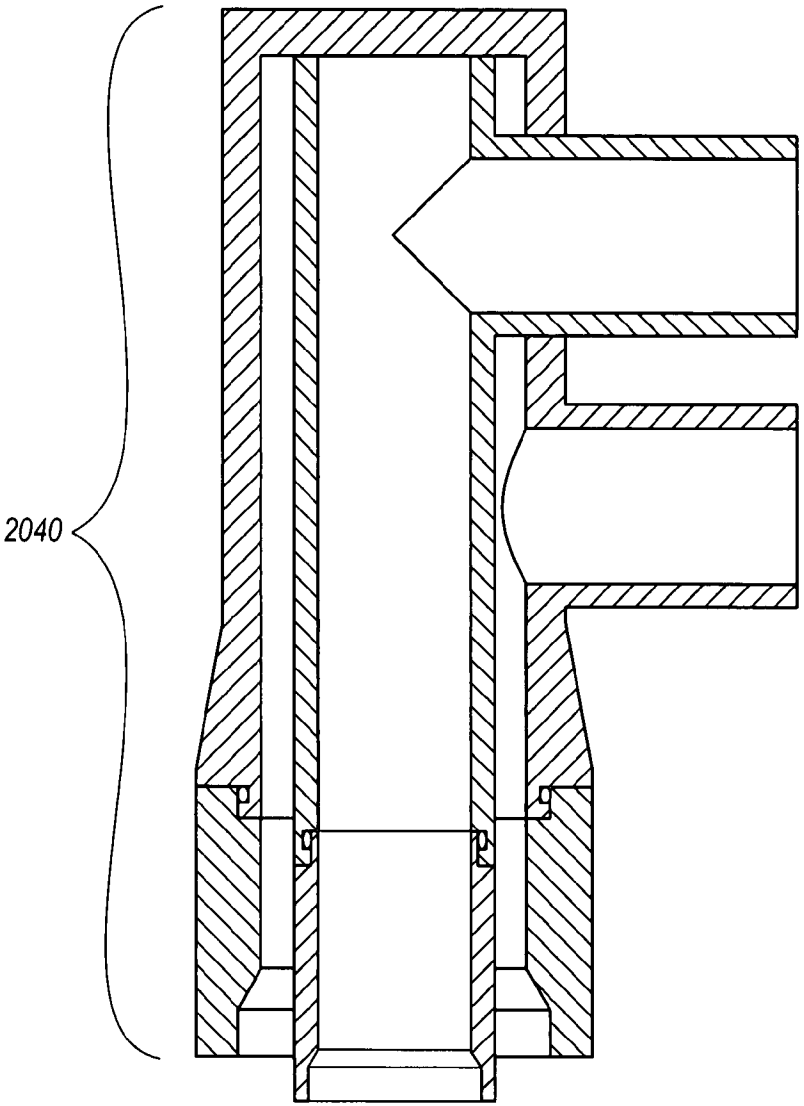
FIG. 37 depicts an embodiment of the union of the high pressure pipe containing fluids used for blurring with the high pressure pipe containing fluids used for cutting.

FIG. 29 depicts an embodiment of a containment system 1001. Specifically, FIG. 29 depicts one embodiment of the present invention wherein the drill stem guide 1010 is comprised of a top plate 1011 which is made of two separate objects. Thus there is a first half of the drill stem guide 1040 and a second half of the drill stem guide 1041. Because the drill stem guide is made of a first half 1040 and a second half 1041 the first half of the drill stem guide 1040, which is affixed to the interior of the containment system by a hinged apparatus 1042, can be swung into an open position allowing the drill stem 1005 to be accessed for maintenance or observation for other reasons. Further, when this embodiment is combined with the access panel embodiment depicted in FIG. 6 wherein the entire side of the containment system can be opened by hinged means, the entire drill stem can be removed from the containment system without being raised above the containment system.

It is contemplated by the present invention that all of the processes related to the to operation of the present invention can be performed from a remote control panel by an operator who does not need to be in close proximity to the decoking process. Thus, one embodiment of the present invention allows for substantially or totally remote operation of the containment system.

Figure 40:
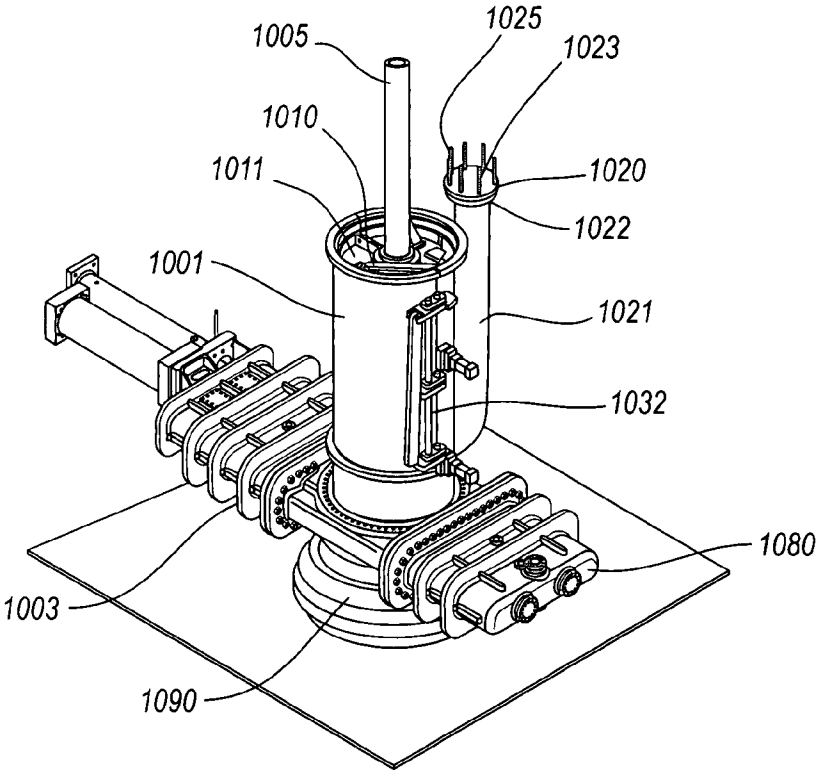
FIG. 40 depicts an embodiment of the containment system with a closed access panel wherein the containment system is attached to a gate valve which is attached to the top of a coke drum.

FIGS. 40-44 depict embodiments of the containment system 1001 contemplated by the present invention. FIG. 40 depicts an embodiment wherein the containment system 1001 is functionally coupled to a deheader valve 1080, wherein the deheader valve 1080 is functionally connected to the top flange of a coke drum 1090. FIG. 40 depicts a drill stem 1005 held in place by a drill stem guide 1010.

Figure 41:
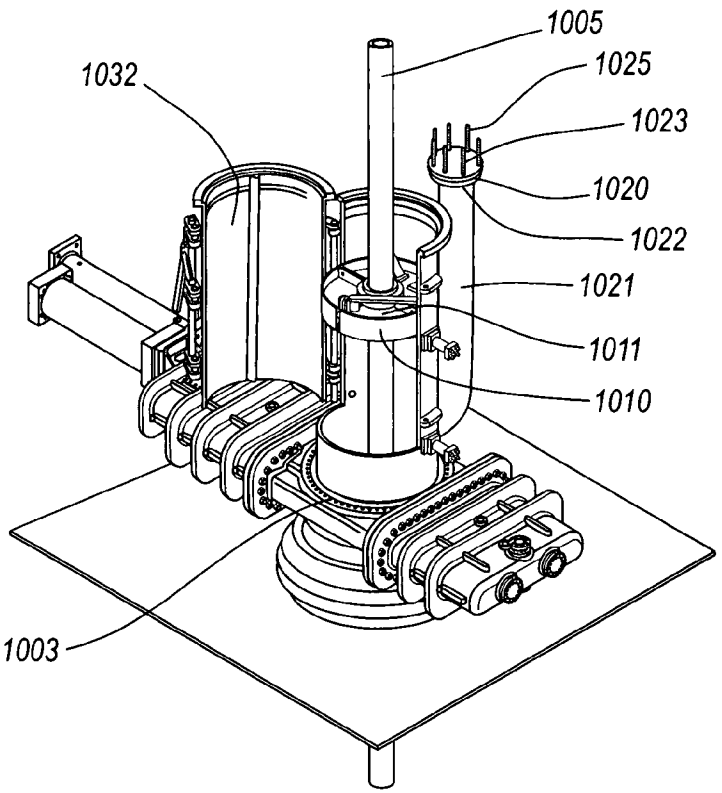
FIG. 41 depicts an embodiment of the containment system with an opened access panel wherein the containment system is attached to a gate valve which is attached to the top of a coke drum.

FIG. 41 depicts an embodiment of the containment system 1001 coupled to a deheader valve 1080 which is coupled to the top of a coke drum 1090. In the depicted embodiment the access panel 1032 is open exposing the drill stem 1005 and drill stem guide 1010. The drill stem 1005 is depicted in at least a partially lowered position.

Figure 42:
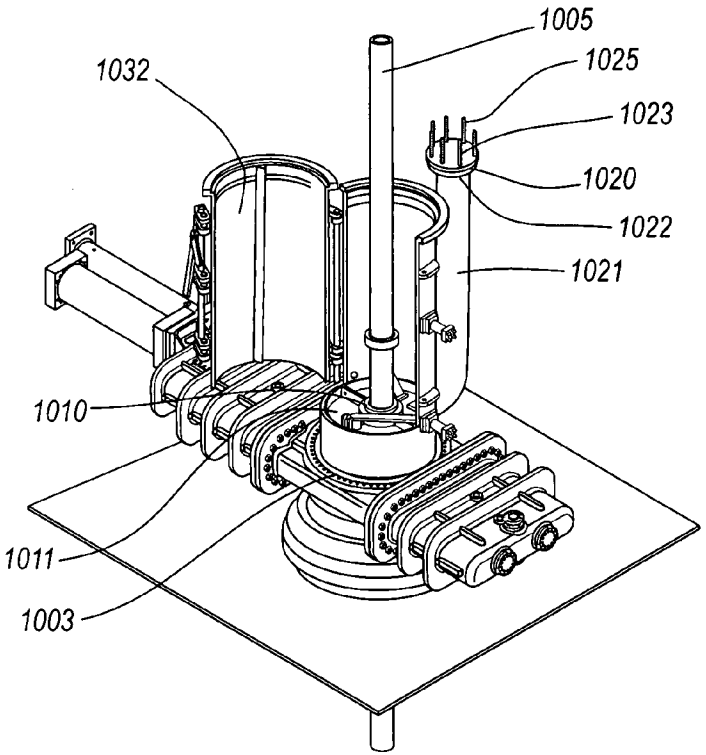
FIG. 42 depicts an embodiment of the containment system with the access panel opened to view the drill stem in a lowered position, wherein the containment system is attached to a gate valve which is attached to the top of a coke drum.

FIG. 42 depicts an embodiment of the containment system 1001 coupled to a deheader valve 1080, which is coupled to the top of a coke drum 1090. In the depicted embodiment the access panel 1032 is open exposing the drill stem 1005 and drill stem guide 1010. The drill stem guide 1010 is depicted in a lowered position.

Figure 43:
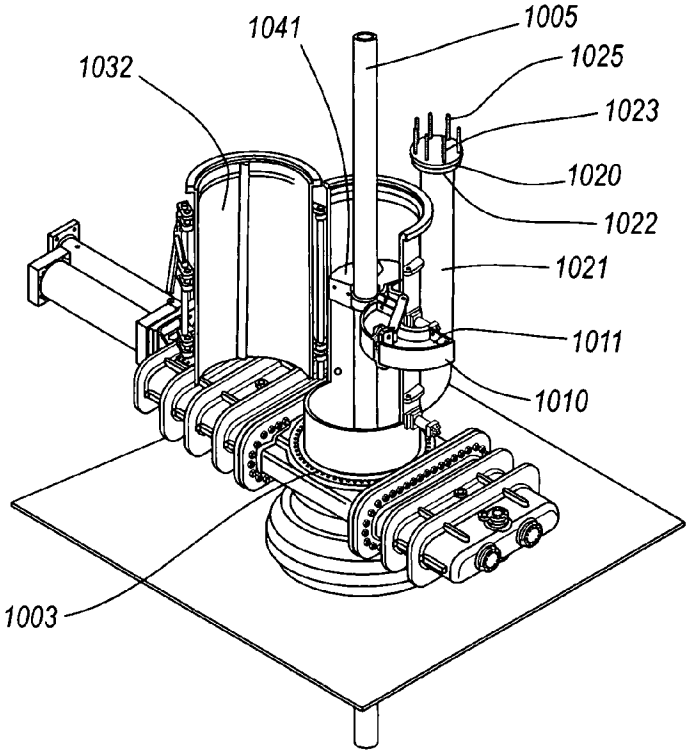
FIG. 43 depicts an embodiment of the containment system with the access panel opened to view an embodiment of the hinged two-piece drill stem guide, which allows the drill stem to swing out of the containment system for maintenance, wherein the containment system is attached to a gate valve which is attached to the top of a coke drum.

FIG. 43 depicts an embodiment of a containment system 1001. Specifically, FIG. 43 depicts one embodiment of the present invention wherein the drill stem guide 1010 is comprised of a top plate 1011 which is made of two separate objects. Thus there is a first half of the drill stem guide 1040 and a second half of the drill stem guide 1041. Because the drill stem guide is made of a first half 1040 and a second half 1041 the first half of the drill stem guide 1040, which is affixed to the interior of the containment system by a hinged apparatus 1042, can be swung into an open position allowing the drill stem 1005 to be accessed for maintenance or observation for other reasons. Further, when this embodiment is combined with the access panel as depicted in FIG. 43 wherein the entire side of the containment system can be opened by hinged means, the entire drill stem can be removed from the containment system without being raised above the containment system.

Figure 44:
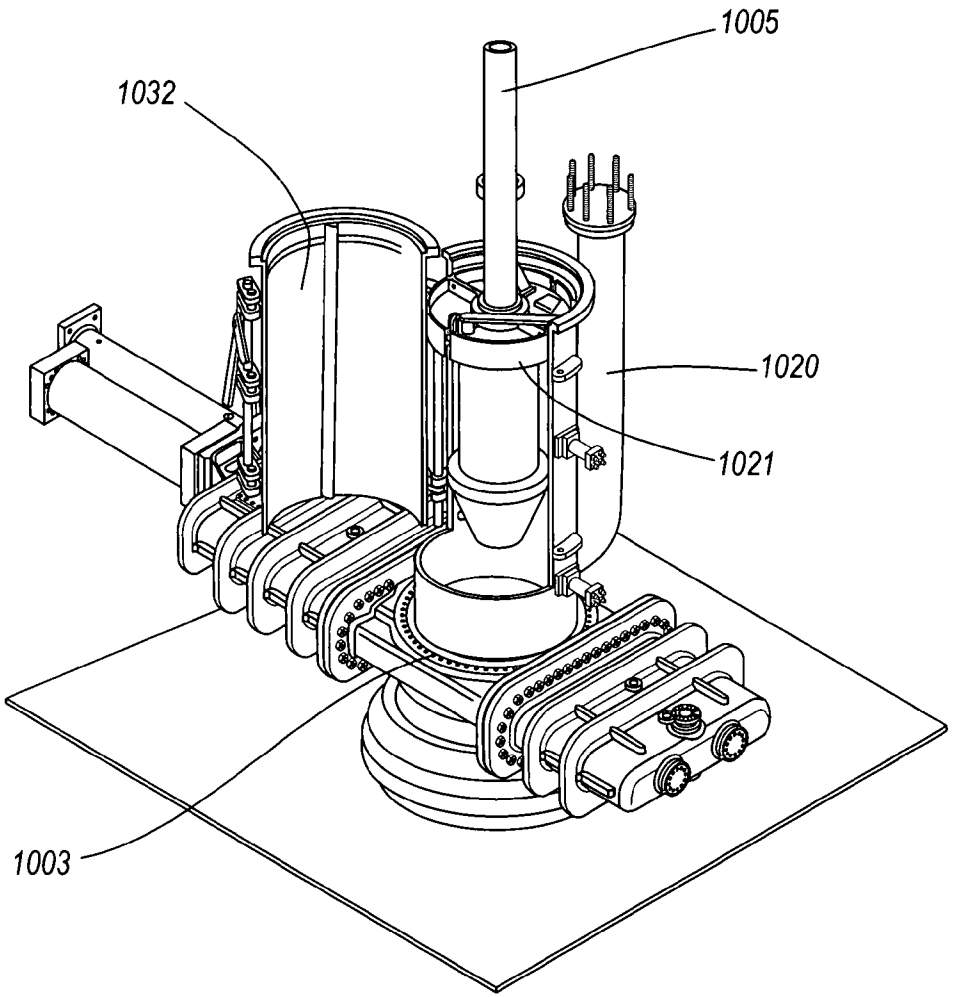
FIG. 44 depicts an embodiment of the containment system with the access panel opened to view the drill stem in a raised position, wherein the containment system is attached to a gate valve which is attached to the top of a coke drum.

FIG. 44 depicts the drill stem 1005 inside the containment system 1001 in a fully raised position. The drill stem guide 1010 and containment system 1001 allows the drill stem guide 1010 to move vertically inside the containment system 1001 so that the drill stem 1005 can be raised to a fully raised position to allow maintenance, inspections, or to allow for other maintenance or inspections of the drill stem 1001 or containment system components, when this functionality is combined with the depicted access panel 1032, the drill stem 1005 and drill tip may be removed form the containment system 1001 without being raised above the containment system 1001.

4. Remote Switching System

Some embodiments of the present invention provide a system for cutting coke that is controlled from a remote location through an external switching mechanism. The present invention provides a system for coke-cutting wherein the drill stem 2052 does not need to be removed to change from boring to cutting mode, but rather, modes can be changed remotely. The present invention provides a system for coke-cutting wherein the rotatable integrated boring and cutting drill stem 2052 does not clog because switching is controlled by a remote switch 2042, precluding both modes from operating simultaneously. The present invention provides a system for coke-cutting wherein a physical symbol 2046 is connected to said switch valve so that the operational status, i.e., boring and cutting modes, is manifested externally to an operator. The present invention provides a system for coke-cutting can be used with current coke-cutting techniques.

FIG. 1 depicts a petroleum manufacturing and refinery process 10 having several elements and systems present (identified, but not discussed). In addition to these elements, petroleum manufacturing and refinery process 10 includes first and second delayed coke drums 12 and 14, respectively. There are typically two coke drums in simultaneous operation so as to permit the ongoing manufacture and refinery of petroleum as well as its coke byproduct. While first coke drum 12 is online and being filled via a feed inlet 16, second coke drum 14 is going through a decoking process to purge the manufactured coke contained therein.

Figure 39:
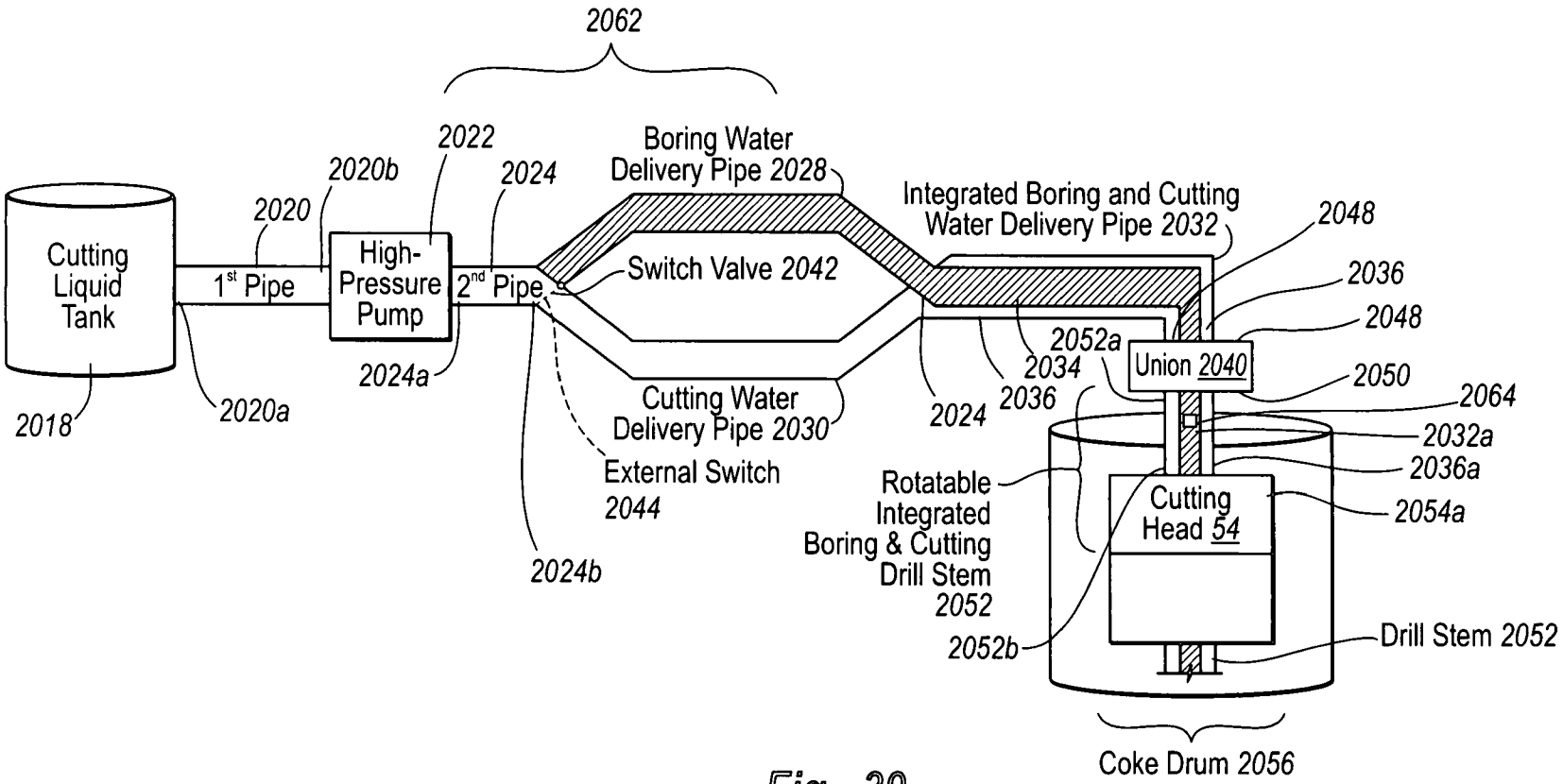
FIG. 39 depicts an embodiment of the coke cutting system.

FIG. 39 depicts a preferred embodiment of the present invention. In this figure, the system comprises a cutting liquid tank 2018 filled with water, or other liquid. A first pipe 2020 is attached to this tank 2018 and water flows from it into a high-pressure pump 2022. The first pipe has a first end 2020*a* that is attached to the cutting liquid tank 2018 and a second end 2020*b* that is attached to the high-pressure pump 2022. In the high-pressure pump 2022, the water is pressurized. After leaving the high-pressure pump 2022, the pressurized water then flows into a second pipe 2024 with a first end 2024*a* and a second end 2024*b*. Said second pipe 2024, at said second end 2024*b*, divides into two pipes. One of the two pipes created from this division is a boring water delivery pipe 2028 and the other is a cutting water delivery pipe 2030. In one embodiment of the present invention the two pipes created from the division of the high pressure water pipe 2024 into a boring water delivery pipe 2028 and a cutting water delivery pipe 2030 is accomplished by utilizing a three-way ball valve 2060.

The three-way ball valve 2060 is operated mechanically by an operator at a location remote from the decoking process. The three-way ball valve is actuated by an actuation switch 2061. The three-way ball valve 2062 of the present invention is comprised of three exterior flanges. A first flange 2068 attaches to the second water pipe 2024. High pressure water that leaves the high pressure pump 2022 moves through the second water pipe and enters the three-way ball valve 2060 through a connection between the second water pipe 2024 and the first flange 2068. The three-way ball valve is further comprised of two outlets, a first outlet 2069*a* and a second outlet 2069*b*. The first outlet 2069*a* connects the flow of high pressure fluids to the boring nozzles 2057 of the cutting head 2054 to begin decoking a coke barrel 12. The second flange 2069*b* connects to a water delivery pipe for the cutting nozzle 2058, of the cutting head 2054 for decoking barrels 12. Thus, the three-way ball valve 2060 allows high pressure fluids to flow into the system through the inlet flange 2068 and to be segregated into the outlet flange 2069*a* connected to the boring water delivery pipe 2028, or into the outlet flange 2069*b* connected to the cutting water delivery pipe 2030, or for the high pressure fluid to be turned off to both pipes. The boring water delivery pipe 2028 has a first end 2028*a* and a second end 2028*b*. The first end of the boring water pipe 2028 connects to the first outlet flange 2069*a* of the three-way ball valve 2060. The second end of the boring water delivery pipe 2028 connects to the union 2040. The present invention is further comprised of a cutting water delivery pipe 2030, which has a first end 2030*a* and a second end 2030*b*. The first end 2030*a* is connected to the second outlet 2069*b* of the three-way ball valve 2060. The second end of the cutting water pipe 30*b* is connected to the union 2040.

The two pipes 2028, 2030 that extend from the three-way ball valve 2060 are the boring water delivery pipe 2028 and the cutting water delivery pipe 2030. They extend parallel to each other for a distance. After such a distance, at a union 2040, the two delivery pipes 2028, 2030 integrate to form an integrated boring and cutting water delivery pipe 2032. This integrated boring and cutting water delivery pipe 2032 appear as a "pipe within a pipe." Specifically, the boring water delivery pipe 2028 becomes an inner pipe 2034, while the cutting water delivery pipe 2030 concentrically encompasses the boring water delivery pipe 2028 on the outside becoming an outer pipe 2036. The two pipes (2034, 2036) do not fluidly communicate with each other, but rather, enable the pressurized water to flow into either of the two pipes (2034, 2036), yet flow in the same overall device, which is the integrated boring and cutting water delivery pipe 2032. At a second end of the integrated boring and cutting water delivery pipe 2032, the integrated boring and cutting water delivery pipe 2032 attaches to a boring and cutting device 2052.

Where the second pipe 2024 divides, a switch valve 2042 exists that is comprised of an external switch 2044. The switch valve 2042 prevents the pressurized water from flowing into both pipes (2028, 2030) simultaneously. The switch valve 2042, through activation of the external switch 44, enables fluid to flow into either the boring water delivery pipe 2028 or the cutting water delivery pipe 2030, but not into both at the same time. A symbol 2046 appears that manifests externally to the operator which pipe 2028 or 2030 the pressurized water is in.

The present invention is comprised of systems and methods which allow an operator to remotely change a flow of high pressured fluids between the boring and cutting modes during the decoking process. The second end of the boring water delivery pipe 2028*b* and the second end of the cutting water delivery pipe 2030*b* intersect and integrate at a union 2040. The refinery operator first switches the switch valve 2042 by the external switch 2044 so that the pressurized water flows into the boring water delivery pipe 2028. The symbol 2046 is then activated indicating water is in the boring water delivery pipe 2028 and the system is in the boring mode. When the operator has completed boring, he or she then switches the switch valve 2042, resetting it so that the pressurized water flows into the cutting water delivery pipe 2030. The symbol 2046 reflects this change.

From a lower part 2050 of the union 2040, a rotatable integrated boring and cutting drill stem 2052, having a first end 2052*a* and a second end 2052*b*, and with similar dimensions and diameters as the integrated boring and cutting delivery pipe 2032, extends vertically downward. A motor is located within said rotatable integrated boring and cutting drill stem 2052. The motor is activated by the external switch described above. The similarity in dimensions enables the integrated boring and cutting water delivery pipe 2032 to fluidly communicate with the rotatable integrated boring and cutting drill stem 2052. At the same time, the union 2040 between the two pipes (2032, 2052) prevents the integrated boring and water delivery pipe 2032 from rotating yet allows the rotatable integrated boring and cutting drill stem 2052 to rotate. Thus, the union 2040 merely serves to connect the integrated boring and cutting water delivery pipe 2032 with the rotatable integrated boring and cutting drill stem 2052. The rotatable integrated boring and cutting drill stem 2052 connects to the union's 2040 lower end 2050 and, similarly to the integrated boring and cutting water delivery pipe 2032.

The rotatable integrated boring and cutting drill stem 2052 has an inner pipe 2034*a* and an outer pipe 2036*a*. At a lower end 2050 of the rotatable integrated boring and cutting drill stem 2052, there is a cutting head 2054 with orifices 2057, 2058 that allow the pressurized water to be ejected therethrough, and to cut the coke away from the interior of the coke drums 2012. The water ejects from the cutting head 2054 either through a nozzle or a plurality of nozzles 2057 attached to the cutting head 2054 to accomplish the bore hole.

A rotating combination drill bit referred to as the cutting tool is about eighteen inches in diameter with several nozzles, and is mounted on the lower end of the long hollow drill stem, which is about six inches in diameter. The cutting head 2054 is comprised of a plurality of nozzles 2057, 2058. The plurality of nozzles 2057, 2058 are separated into two categories. One set of nozzles 2057 allow high pressure fluids to eject from the cutting head 2054 to drill a bore hole initially through the coke in the coke barrel. The second set of nozzles 2058 eject high pressure fluid from the cutting head 2054 perpendicular to a rotatable integrated boring and cutting drill stem 2052. Thus, water which is ejected from the first set of nozzles 2057 produce the initial boring hole, while water ejected from the second set of nozzles 2058 cut away and dislodge the remaining coke from the coke barrel 12.

The rotatable integrated boring and cutting drill stem 2052 may also be activated by the switch valve 2042. While the switch valve 2042 is allowing the pressurized water to flow into the boring water delivery pipe 2028, the rotatable integrated boring and cutting drill stem 2052 begins to descend into a coke drum 12. As the drill stem 2052 descends, pressurized water enters the rotatable integrated boring and cutting drill stem 2052. The pressurized water flows through the inner pipe 2034*a* into the cutting head 2054 is ejected from the boring nozzle(s) 2057 and bores through the coke. Either at the bottom of the coke drum 2012, or after the rotatable integrated boring and cutting drill stem 2052 is lifted to the top of the coke drum 12 container (but not outside the container), the switch valve 2042 is then actuated, allowing the pressurized water to flow into the cutting water delivery pipe 2028. The pressurized water enters the outer pipe 2036*a* of the rotatable boring and cutting drill stem 2052, flows through the cutting head 2054 and is ejected from the cutting nozzle 2058 to continue cutting coke away from the interior of the coke drum 12. Consequently, after boring is completed, the switch valve 2042 is actuated, and the pressurized water flows into the cutting water delivery pipe 2030, into the outer pipe 2036 of the integrated boring and cutting water delivery pipe 2032, through the union 2040, into the outer pipe 2036*a* of the rotatable integrated boring and water delivery pipe 2052 through a cutting head 2054 at the bottom of the rotatable integrated boring and cutting drill stem 2052 where the pressurized water ejects from cutting nozzles 2058 perpendicularly to the drill stem 2052 and cuts the coke.

The system 2062 as a whole can be applied to, or modified to fit, current coke-cutting systems. Specifically, the system 2062 as described can be applied to currently operating coke-cutting overhead gantries and used in typical coke-cutting systems. Thus, the entire process is activated by the switch valve 2042 located where the second pipe 2024 divides into the boring side water delivery pipe 2028 and the cutting water side delivery pipe 2030. The process is controlled by the external switch mechanism 2044 and, therefore, the operator is able to determine through the entire coke-cutting process which mode, either boring or cutting, the rotatable integrated boring and cutting drill stem 2052 is in.

Figure 38:
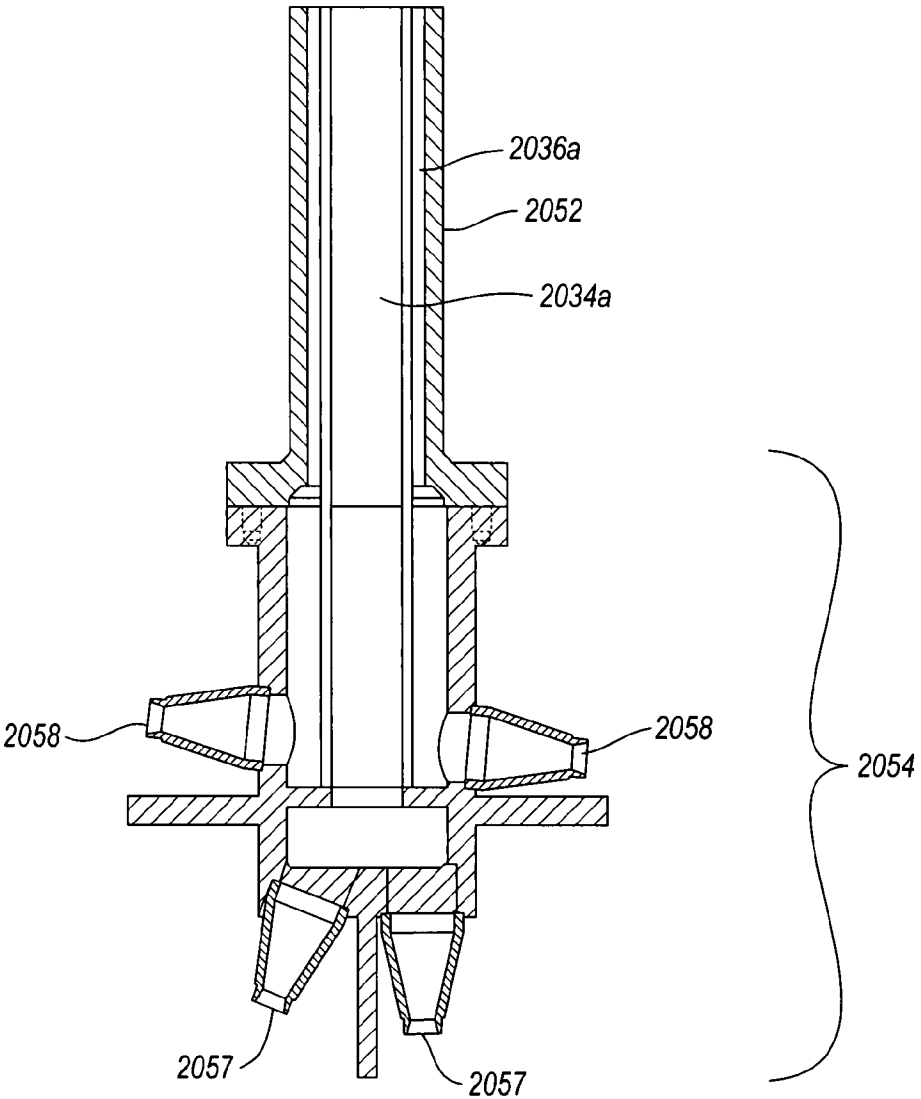
FIG. 38 depicts an embodiment of the cutting head.

FIG. 38 depicts an enlarged view of the rotatable integrated boring and cutting drill stem 2052 as it enters the coke drum 2056. The rotatable integrated boring and cutting drill stem 2052 may either bore down then cut up, or, bore down, and then be pulled up to cut down again, the latter of which is represented by this figure.

The present invention relates to a system for removing coke, solid carbonaceous residue, from large cylindrical vessels called coke drums 12. The present invention relates to a system that allows an operator to remotely activate the cutting of coke within a coke drum 12, and to remotely switch between the "boring" and the "cutting" modes while cutting coke within a coke drum 12 reliably, without raising the cutting head 2054 out of the coke drum 12 for mechanical alteration or inspection. Further, the present invention allows an operator to apprise the status of the cutting modes taking place within the coke drum 12 during the coke-cutting process. Hence, the present invention provides a system for cutting coke within a coke drum 12 with increased safety, efficiency and convenience.

One embodiment of the present invention features the use of a three-wall ball valve 2060, a union 2040, and a specialized cutting head 2054. In this preferred embodiment, the system is comprised of a cutting liquid tank filled with water or other liquid. A pipe 2020 is attached to this tank 18 and water flows from it into a high-pressure pump 2022. In the high-pressure pump, the water is pressurized. After leaving the high-pressure pump 2022, the pressurized water then flows into another pipe 2024 that, at a second end 2024*b*, divides into two pipes 2028, 2030. One of the two pipes 2028, 2030 created from this division is a boring water delivery pipe 2028 and the other is a cutting water delivery pipe 2028. In one embodiment of the present invention the delivery pipe is separated into two pipes by a three-way ball valve 2060. The three-way ball valve 2060 prevents the pressurized water from flowing into both pipes, the boring water delivery pipe 2028 and the cutting water delivery pipe 2030, simultaneously. Further, an operator may visualize with certainty which pipe the boring water delivery pipe 2028 or the cutting water delivery pipe 2030, the pressurized water is in, and consequently, the status of coke-cutting mode within the coke drum 12.

The two pipes 2028, 2030 extend parallel to each other for a distance. After such a distance, the two delivery pipes integrate to form an integrated boring and cutting water delivery pipe 2032. This integrated boring and cutting water delivery pipe 2032 appears as a "pipe within a pipe." Specifically, the boring water delivery pipe 2028 becomes an inner pipe 2034, while the cutting water delivery pipe 2030 concentrically encompasses the boring water delivery pipe on the outside becoming an outer pipe 2036. The two pipes do not fluidly communicate with each other, but rather, enable pressurized fluid to flow through either of the two pipes, yet flow in the same overall device, the cutting head 2054. Because the switch valve allows water to flow only through either the inner, boring water delivery pipe 2034, or the outer delivery pipe 2042, cutting water deliver pipe 2036, water is delivered only to boring 2057 or cutting 2059 outlet nozzles of the cutting head respectively.

The integrated boring and cutting water delivery pipe 32 attaches to, or is an integral part of a union 2040. From a lower part of the union 2040, a rotatable integrated boring and cutting drill stem 2052, with similar dimensions and diameters as the integrated boring and cutting delivery pipe 2032, extends vertically downward. This rotatable integrated boring and cutting drill stem 2052 features a motor that is also activated by the external switch. The motor enables the drill stem to rotate. The similarity in dimensions enables the integrated boring and cutting water delivery pipe 2032 to fluidly communicate with the drill stem 2052. At the same time, the union 2040 between the two pipes prevents the integrated boring and water delivery pipe 2032 from rotating yet allows the rotatable integrated boring and cutting drill stem 2052 to rotate. The rotatable integrated boring and cutting drill stem 2052 has an inner pipe and an outer pipe. At a lower end of the drill stem 2052*b*, there is a cutting head 2054. The cutting head is comprised of nozzles (2057, 2058),which allow the pressurized water to be ejected therethrough to cut the coke away from the interior of the coke drums. The boring nozzles 2058 eject high pressure fluid in a downward angle to produce the bore hole, and the cutting nozzles 2058 eject high pressure fluid in a direction roughly perpendicular to the drill stem.

The rotatable integrated boring and cutting drill stem 2052 is activated by an remote switching means. After the cutting head 2054 has been inserted into the top of the coke drum 12, pressurized fluids are ejected through a plurality of nozzles (2057 or 2058) of the cutting head 2054 at a pressure sufficient to cut and dislodge coke from the vessel 12. Initially, pressurized fluids are allowed to flow into the boring water delivery pipe 2028 when an operator actuates the switch valve 2042. As the cutting head 2054 descends through the coke barrel 12, pressurized liquid enters the drill stem 2052 through the inner pipe 2034 ejecting fluid through a plurality of nozzles 2057 attached to the cutting head at a pressure sufficient to bore coke from the vessel. Thus, a bore hole is drilled through the coke using the nozzle 2057 or plurality of nozzles 2057, which eject high pressure liquids in a downward direction from the cutting head 2054. After the initial bore hole is completed the flow of high pressure fluid is remotely switched to a plurality of nozzles 2058 attached to the cutting head 2054 at a pressure sufficient to cut and dislodge the remainder of coke from the vessel 12. This switching is accomplished by actuating a switch valve 2042, 2060, which is in a position remote from the coke barrel 12. In one embodiment of the present invention the operator remotely switches the flow of fluid from the boring nozzles 2057 to the cutting nozzles 58 by turning the handle, actuating a lever 2061, of a three-way ball valve 2060, which is in a location remote from the vessel 12 being decoked. Thus, when the cutting head 2054 has successfully completed its boring stroke the switch valve 2042 is activated allowing pressurized fluid to flow into the cutting water delivery pipe 2030. The pressurized fluid then enters the outer pipe 2036 of the drill stem 2052 and is ejected from the cutting nozzles 2058 of the cutting head 2054 to continue cutting the coke away from the interior of the coke drum 12. Subsequently, the remainder of coke in the drum 12 is cut and dislodged from the vessel 12.

Thus, the entire boring and cutting processes are activated by the external switch 2061, which activates the switch valve 2042 located where the pipe 2024 divides into the boring water delivery pipe 2028 and the cutting water delivery pipe 2030. The process is controlled by the external switch mechanism 2061 and, therefore, the operator is able to determine through the entire coke-cutting process which mode, either boring or cutting the rotatable integrated boring and cutting drill stem 2052 is in without having to remove the cutting head 2054 from the coke drum 12.

In some embodiments, the switch valve 2042 is controlled by a central processing unit, or other means, rather than a live operator. Thus, it is contemplated by the present invention that the switch valve 2042 could be controlled from a control room wherein an operator remotely controls the entire decoking process utilizing mechanical and electrical apparatus to remotely dictate the decoking process.

The present invention may be embodied in other specific forms without departing from its spirit of essential characteristics. The described embodiments are to be considered in all respects only illustrative and not restrictive. The scope of the invention is, therefore, indicated by the appended claims, rather than by the foregoing description. All changes that come within the meaning and range of equivalency of claims are to be embraced within their scope.

What is claimed and desired to be secured by Letters Patent is:

1. A system for providing a safe working environment during delayed coker operations, said system comprising:

a coke drum;

a first coke drum de-header system coupled to a bottom of the coke drum;

a second coke drum de-header system coupled to a top of the coke drum; and a containment system comprising a venting system coupled to the second coke drum de-header system.

2. The system for providing a safe working environment during the delayed coker operations as in claim 1, wherein the first coke drum de-header system comprises:

a main body removably coupled to the coke drum, wherein the main body comprises an orifice dimensioned to align with an opening of the coke drum;

a valve closure comprising a valve capable of oscillating to open and close said valve closure and for de-heading and re-heading said coke drum;

means for supporting said valve closure; and a metal to metal contact seal created between said valve closure and said means for supporting the valve closure, said contact seal shearing any accumulated coke upon actuation of said valve closure.

3. The system for providing a safe working environment during the delayed coker operations as in claim 2, wherein said means for supporting said valve closure comprises a seat support system.

4. The system for providing a safe working environment during the delayed coker operations as in claim 3, wherein said seat support system comprises independent seats positioned opposite one another on either side of said valve closure, wherein said independent seats are structured to apply opposing forces upon said valve closure, and wherein said seats are selected from the group consisting of a static seat and a live loaded seat.

5. The system for providing a safe working environment during the delayed coker operations as in claim 2, further comprising a steam purge system.

6. The system for providing a safe working environment during the delayed coker operations as in claim 2, wherein said valve closure is actuated by an element selected from the group consisting of a hydraulic apparatus, an electric motor, a manual actuator, and an actuator remotely controlled by a central processing unit.

7. The system for providing a safe working environment during the delayed coker operations as in claim 2, wherein the valve closure is selected from the group consisting of a plug type de-header valve, a ball-type de-header valve, an adjusting wedge gate-type de-header valve, a flexible wedge gate-type de-header valve, a parallel slide gate-type de-header valve, a solid wedge gate-type de-header valve, a sliding blind gate-type de-header valve, a globe-type de-header valve, and a goggle type de-header valve.

8. The system for providing a safe working environment during the delayed coker operations as in claim 1, wherein the containment system comprises: a drill stem guide, wherein the drill stem guide may move vertically up and down inside of the containment system.

9. The system for providing a safe working environment during the delayed coker operations as in claim 8, wherein the containment system is a structural can, rated to tolerate pressure swells.

10. The system for providing a safe working environment during the delayed coker operations as in claim 8, wherein the containment system provides continuous containment of pressurized gases and materials during a length of a drill stroke.

11. The system for providing a safe working environment during the delayed coker operations as in claim 8, wherein the drill stem guide slidably engages a drill stem.

12. The system for providing a safe working environment during the delayed coker operations as in claim 8, wherein a drill may safely operate in a fully raised or lowered position.

13. The system for providing a safe working environment during the delayed coker operations as in claim 8, wherein the containment system additionally comprises an access panel.

14. The system for providing a safe working environment during the delayed coker operations as in claim 13, wherein the access panel comprises at least one locking system.

15. The system for providing a safe working environment during the delayed coker operations as in claim 8, wherein the containment system comprises a hinged opening system for opening at least one side of the containment system.

16. The system for providing a safe working environment during the delayed coker operations as in claim 1, wherein the venting system comprises vent tubing, wherein the vent tubing is comprised of a first end of the vent tube, a terminal end of the vent tube and a vent plate, wherein the first end of the vent tubing is affixed to the containment system and the venting system allows excess gas produced during the coker operations to enter the vent tubing through the first end of the vent tubing, move through the vent tubing to the terminal end of the vent tubing and be released at a point distant from the containment system.

17. The system for providing a safe working environment during the delayed coker operations as in claim 1, further comprising a switching system, wherein the switching system comprises: a cutting head with at least one boring nozzle and at least one cutting nozzle, wherein the cutting head is removeably connected to a drill stem and wherein the drill stem slidably engages the containment system.

18. The system for providing a safe working environment during the delayed coker operations as in claim 17, wherein the switching system further comprises multiple cutting heads.

19. The system for providing a safe working environment during the delayed coker operations as in claim 17, wherein the cutting head is controlled by a central processing unit.

20. The system for providing a safe working environment during the delayed coker operations as in claim 17, wherein the switching system further comprises a switch valve, wherein said switch valve segregates high-pressure fluid into separate delivery pipes, wherein said delivery pipes comprise at least one boring delivery pipe for boring and at least one cutting delivery pipe for cutting, wherein said delivery pipes deliver fluid to the cutting head.

21. The system for providing a safe working environment during the delayed coker operations as in claim 20, wherein the switch valve is a three way ball joint.

22. The system for providing a safe working environment during the delayed coker operations as in claim 20, wherein the switching system further comprises at least one visual marker that indicates whether or not the high pressure fluid is flowing, and into which delivery pipe the fluid is flowing.

23. The system for providing a safe working environment during the delayed coker operations as in claim 20, wherein said switch valve is controlled by a central processing unit.

24. The system for providing a safe working environment during the delayed coker operations as in claim 20, wherein said switch valve and said cutting head are controlled remotely from a control room.

25. The system for providing a safe working environment during the delayed coker operations as in claim 20, wherein the switch valve is manually actuated.

26. The system for providing a safe working environment during the delayed coker operations as in claim 17, further comprising an integrated boring and cutting water delivery pipe, which begins where a boring water delivery pipe and a cutting water delivery pipe connect and integrate.

27. The system for providing a safe working environment during the delayed coker operations as in claim 17, further comprising a rotatable integrated boring and cutting drill stem comprising a cutting head and a motor.

28. The system for providing a safe working environment during the delayed coker operations as in claim 27, further comprising a union, wherein said union connects an integrated boring and water delivery pipe to said rotatable integrated boring and cutting drill stem.

29. A method for safely removing coke from a coke vessel, comprising the steps of:

coupling a coke drum to a main body of a deheader valve;

creating a metal to metal contact seal between said deheader valve and a means for supporting said valve, said contact seal shearing any accumulated coke upon actuation of said deheader valve;

pressurizing fluid;

allowing the pressurized fluid to enter a cutting head wherein the cutting head comprises at least one boring nozzle and at least one cutting nozzle;

ejecting the pressurized fluid from said boring nozzle;

ejecting the pressurized fluid from said cutting nozzle to begin cutting said coke within said coke vessel;

utilizing a continuous containment system to contain the pressurized fluid and excess gas produced while removing the coke from the coke drum; and venting the excess gas produced during the removal of the coke from the coked rum from the continuous containment system through a venting system.

* * * * *